US008162807B1

(12) United States Patent
Webber et al.

(10) Patent No.: US 8,162,807 B1
(45) **Date of Patent: *Apr. 24, 2012**

(54) EXERCISE MACHINE WITH MULTI-FUNCTION USER ENGAGEMENT DEVICE

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/871,356

(22) Filed: Aug. 30, 2010

Related U.S. Application Data

(63) Continuation of application No. 12/212,090, filed on Sep. 17, 2008, now Pat. No. 7,981,010, which is a continuation-in-part of application No. 10/633,805, filed on Aug. 4, 2003, now Pat. No. 7,594,880, and a continuation-in-part of application No. 11/846,472, filed on Aug. 28, 2007, now Pat. No. 7,563,209, and a continuation-in-part of application No. 11/848,012, filed on Aug. 30, 2007, now Pat. No. 7,654,940.

(51) Int. Cl.
*A63B 21/00* (2006.01)

(52) U.S. Cl. ..... 482/100; 482/137; 482/112; 482/104

(58) Field of Classification Search ..... 482/94, 482/96, 100, 142, 133–138
See application file for complete search history.

(56) References Cited

U.S. PATENT DOCUMENTS

| | | | |
|---|---|---|---|
| 3,116,062 | A | 12/1963 | Zinkin |
| 3,917,262 | A | 11/1975 | Salkeld |
| 4,149,714 | A | 4/1979 | Lambert, Jr. |
| 4,336,934 | A | 6/1982 | Hanagan et al. |
| 4,390,179 | A | 6/1983 | Szkalak |
| 4,448,412 | A | 5/1984 | Brentham |
| 4,478,411 | A | 10/1984 | Baldwin |
| 4,500,089 | A | 2/1985 | Jones |
| 4,511,137 | A | 4/1985 | Jones |
| 4,598,907 | A | 7/1986 | Ross |
| 4,666,152 | A | 5/1987 | Jones |
| 4,858,915 | A | 8/1989 | Szabo |
| 5,011,139 | A | 4/1991 | Towley |
| 5,050,873 | A | 9/1991 | Jones |
| 5,066,003 | A | 11/1991 | Jones |
| 5,066,004 | A | 11/1991 | Jones |
| 5,304,107 | A | 4/1994 | Jones |
| 5,366,432 | A | 11/1994 | Habing et al. |
| 5,417,633 | A | 5/1995 | Habing |

(Continued)

OTHER PUBLICATIONS

Body Masters brochure, 2002, 1 page.

(Continued)

*Primary Examiner* — Jerome W Donnelly
(74) *Attorney, Agent, or Firm* — Procopio, Cory, Hargreaves & Savitch LLP

(57) ABSTRACT

An exercise machine has a main frame and a user support movably mounted relative to the main frame for movement between a start position and an end position during an exercise. At least one multi-function user engagement device is movably mounted relative to the frames for engagement and actuation by a user during an exercise, and a connecting linkage translates movement of the user engagement device to movement of the user support. The user engagement device has two different modes of operation selectable by a user for performing different exercises which exercise distinct muscles or muscle groups. A load provides resistance for both exercises.

86 Claims, 61 Drawing Sheets

U.S. PATENT DOCUMENTS

| | | | |
|---|---|---|---|
| 5,484,365 | A | 1/1996 | Jones et al. |
| 5,499,959 | A | 3/1996 | Holmes |
| 5,518,477 | A | 5/1996 | Simonson |
| 5,549,533 | A | 8/1996 | Olson et al. |
| 5,575,743 | A | 11/1996 | Jones et al. |
| 5,575,744 | A | 11/1996 | Jones et al. |
| 5,597,375 | A | 1/1997 | Simonson |
| 5,616,105 | A | 4/1997 | Wang |
| 5,616,107 | A | 4/1997 | Simonson |
| 5,620,402 | A | 4/1997 | Simonson |
| 5,628,715 | A | 5/1997 | Simonson |
| 5,711,749 | A | 1/1998 | Miller |
| 5,833,585 | A | 11/1998 | Jones et al. |
| 5,897,473 | A | 4/1999 | Koenig |
| 6,220,993 | B1 | 4/2001 | Sencil |
| 6,244,995 | B1 | 6/2001 | Prsala |
| 6,244,996 | B1 | 6/2001 | Sencil |
| 6,254,516 | B1 | 7/2001 | Giannelli et al. |
| 6,287,241 | B1 | 9/2001 | Ellis |
| 6,350,219 | B1 | 2/2002 | Hobson |
| 6,517,468 | B1 | 2/2003 | Lapcevic |
| 6,659,919 | B2 | 12/2003 | Deola |
| 6,743,158 | B2 | 6/2004 | Giannelli et al. |
| 6,770,017 | B1 | 8/2004 | Leipheimer |
| 7,549,949 | B2 | 6/2009 | Webber et al. |
| 7,563,209 | B2 | 7/2009 | Webber et al. |
| 7,594,880 | B2 | 9/2009 | Webber et al. |
| 7,601,187 | B2 | 10/2009 | Webber et al. |
| 7,654,938 | B2 | 2/2010 | Webber et al. |
| 7,654,940 | B2 | 2/2010 | Webber et al. |
| 7,670,269 | B2 | 3/2010 | Webber et al. |
| 7,717,832 | B2 | 5/2010 | Webber et al. |
| 7,731,638 | B2 | 6/2010 | Webber et al. |
| 7,766,802 | B2 | 8/2010 | Webber et al. |
| 7,794,371 | B2 | 9/2010 | Webber et al. |
| 7,794,372 | B1 | 9/2010 | Webber et al. |
| 7,878,953 | B2 | 2/2011 | Webber et al. |
| 7,938,760 | B1 | 5/2011 | Webber et al. |
| 7,981,010 | B1 | 7/2011 | Webber et al. |
| 7,993,251 | B1 | 8/2011 | Webber et al. |
| 2007/0270290 | A1 | 11/2007 | Mosimann et al. |

OTHER PUBLICATIONS

CD 2400 Leg Extension/Leg Curl, Hoist Fitness Systems, Owner's Manual, 2005, 1 page.

Flex Fitness Brochure, (date unknown), is admitted prior art for this application, 1 page.

Hoist brochure, 1993 Hoist HLP brochure, 1998, 1 page.

Hoist Dual 600 Abdominals and Lower Back 1998, 1 page.

Hoist Prime 8 Brochure, Hoist Fitness Systems, 2000, 3 pages.

Hoist S-413, Innter/Outer Thigh, 1995, 1 page.

Tuff Stuff brochure, (date unknown), is admitted prior art for this application, 2 pages.

Tuff Stuff KDX-1 Gym, date unknown, is admitted prior art for this application, 1 page.

EXERCISE MACHINE WITH MULTI-FUNCTION USER ENGAGEMENT DEVICE

RELATED APPLICATION

The present application is a Continuation of U.S. patent application Ser. No. 12/212,090 filed on Sep. 17, 2008, which is a Continuation-In-Part of U.S. patent application Ser. No. 10/633,805 filed on Aug. 4, 2003, now U.S. Pat. No. 7,594,880 issued Sep. 29, 2009, and is also a Continuation-In-Part of U.S. patent application Ser. No. 11/846,472 filed on Aug. 28, 2007, which issued as U.S. Pat. No. 7,563,209 on Jul. 21, 2009, and is also a Continuation-In-Part of U.S. patent application Ser. No. 11/848,012 filed on Aug. 30, 2007, which issued as U.S. Pat. No. 7,654,940 on Feb. 2, 2010, and the contents of each of the aforementioned applications are incorporated herein by reference in their entirety.

BACKGROUND

1. Field of the Invention

This invention relates generally to exercise machines with moving user supports, and is particularly concerned with an exercise machine which has a multi-function user engagement device.

2. Related Art

Various exercise machines have been developed for exercising different muscles and muscle groups. Some of these have a stationary user support, while others have a pivoting or movable user support, which may or may not be linked to an exercise arm or user engagement means.

Movable user supports linked to the movement of an exercise arm are known in exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in other exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

In most or all exercise machines with moving user supports, the exercise arm or user engagement device is actuated to exercise only one muscle group, and other muscle groups are exercised on different machines or using different exercise arms.

SUMMARY

Embodiments described herein provide for an exercise machine with a moving user support and a multi-function user engagement device.

An exercise machine in one embodiment comprises a main frame, a user support frame pivotally associated with the main frame, a multi-function user engagement device movably mounted on one of the frames for actuating by a user in order to perform a selected exercise, and a connecting linkage which translates movement of the user engagement device to movement of the user support. A load provides resistance to movement of the user support frame, user engagement device and/or connecting linkage. The connecting linkage, user support pivot, and user engagement device mount are arranged so that movement of the user engagement device results in self-aligning movement of the user support. The multi-function user engagement device has two different modes of operation which are selected by a user in order to perform different exercises which exercise two distinct muscles or muscle groups.

The user support frame in an exemplary embodiment has both a primary user support, such as a seat pad or back pad, and one or more secondary user supports which travel with the primary user support during an exercise. One secondary user support may be a back pad, shoulder pad, thigh hold-down pads, chest pad, or the like. Another secondary or additional user support may be a foot rest, which may be mounted on, and travel with, the user support frame. Alternatively, a foot rest may be mounted on the main frame. In either case, the foot rest provides additional stabilization to the user, helping them to maintain a proper exercise position and providing additional comfort and support. In another embodiment, the secondary user support acts as a back pad in one mode of operation, and act as a chest pad in the other mode of operation of the user engagement device. The use of multiple support pads on the user support frame helps to position the exerciser properly and safely. In one embodiment, these supports are in fixed alignment to each other and travel together, keeping the user in the same braced position throughout the entire exercise range of motion. This allows the user to focus on the exercise rather than worrying about their positioning on a moving platform or seat.

The exercise arm or user engagement device is movably mounted on the main frame, the user support frame, or the connecting linkage. The connecting linkage translates movement of the exercise arm to movement of the user support, and is movably engaged with at least two of the main frame, exercise arm, and user support. In one embodiment, the user engagement device is movably mounted on the main frame and associated with the connecting linkage. The user support and exercise arm may both be movably mounted on the main frame, with the connecting linkage connected between them. The exercise arm may be mounted for linear movement or may be pivotally mounted for rotational movement, or may travel in a user-defined path.

The user support frame may be pivotally mounted on a base of the main frame so that it is relatively low to the ground and readily accessible to the user in entering and exiting the machine, via a single pivot or a multiple pivot assembly. In one embodiment, the user engagement device is also movably mounted on the base of the main frame. In other embodiments, the user engagement device is movably mounted relative to an upright portion of the main frame, or may be movably mounted on the user support frame or connecting linkage. The user engagement device may comprise completely rigid or partially rigid exercise arms with handles for gripping by the user which are movable between a start position and an end position, or may be a flexible line or lines with handles for gripping by a user, or may comprise a leg engaging device for engagement by the user's legs or feet. The user's hands may be at a different elevation in the end position than in the start position.

A pivot assembly which pivotally supports the user support frame may be located beneath the user support frame. The connecting linkage may be rigid, flexible, or partially flexible, and may be adjustable in length or position. The user engagement device or exercise arm may have one or two handles. If handles are provided, they may be rigid or flexible, fixed or self-aligning, and may provide two dimensional or three dimensional movement.

Where the user engagement device comprises two exercise arms, the exercise arms may be movable independently or in unison. In one embodiment, the user engagement device and connecting linkage are both movably associated with the main frame. The user engagement device may be a bi-directional exercise arm.

The pivot mounting of the user support defines a vertical gravitational center line of the pivotal movement, and in one embodiment portions of the combined weight of the user and user support frame are positioned on both sides of the vertical gravitational center line in at least one of the start and end positions of the exercise. In one embodiment, a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the gravitational center line of the pivoting movement, resulting in either a high initial lifting resistance, or else a resistance "drop off" at the end of the exercise.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage. Where the exercise resistance is a weight stack, multiple exercise stations may share the same weight stack or load for exercise resistance, or separate weight stacks may be provided for each station.

The exercise machine may have a single exercise station, or may be a multi-station exercise machine with one or more stations which have pivoting user supports as described above, and one or more of the exercise stations with moving user supports may have multi-function user engagement devices or exercise arms.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an exercise machine having a moving user support and a multi-function user engagement device which travel in a dependent relationship. The multi-function user engagement device allows a user to perform different exercises which work two distinct muscles or muscle groups.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
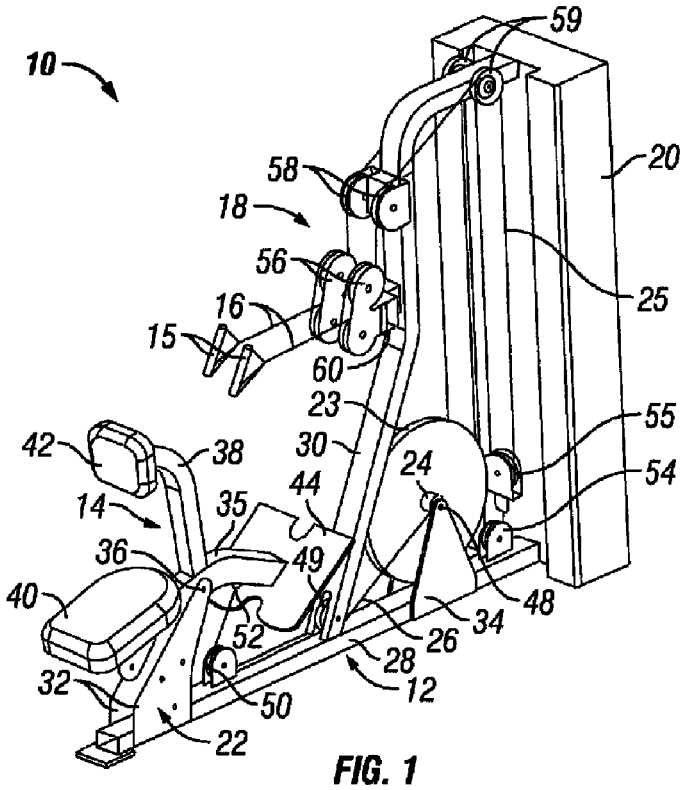
FIG. 1 is a front perspective view of an exercise machine with a multi-function user engagement device according to one embodiment, with the machine and user engagement device illustrated in a start position adopted at the beginning of an upper back exercise movement.
Figure 2:
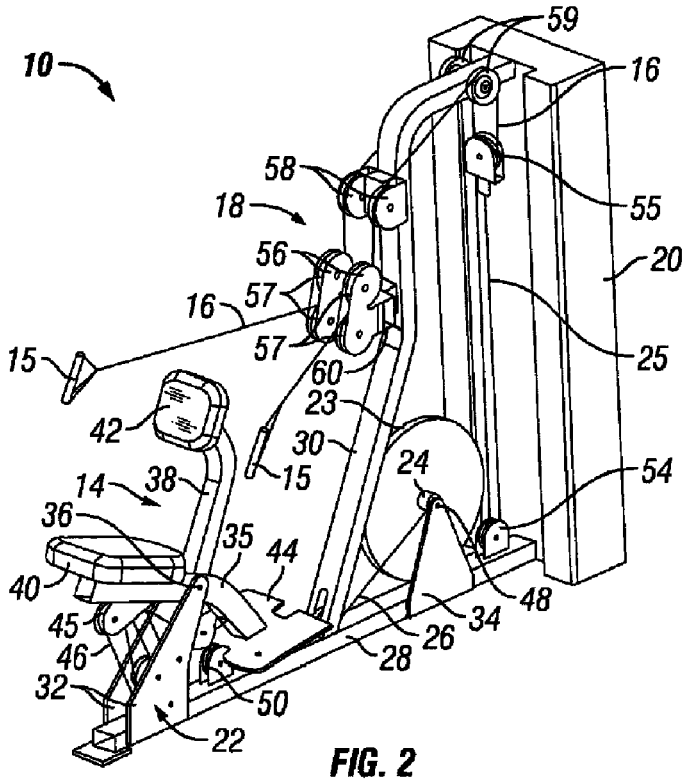
FIG. 2 is a front perspective view similar to FIG. 1, illustrating the machine in an exercise ending position.
Figure 3:
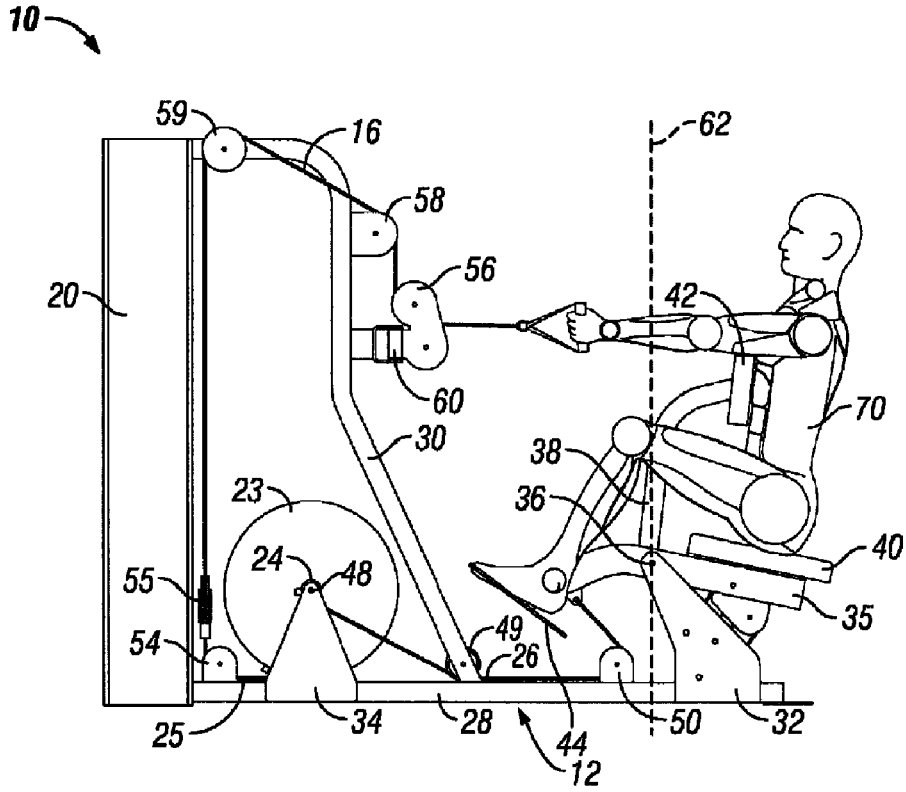
FIG. 3 is a side elevation view of the machine of FIGS. 1 and 2, with a user seated on the machine in the start position adopted at the beginning of the upper back exercise.
Figure 4A:
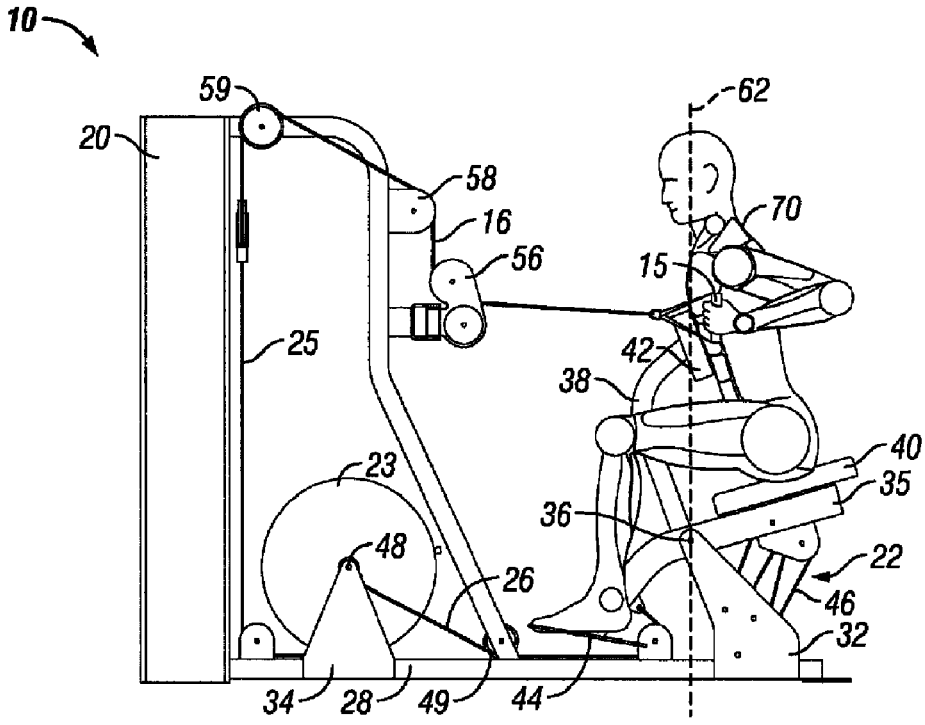
FIG. 4A is a side elevation view similar to FIG. 3, illustrating the user and machine in the end position of a mid row exercise.
Figure 4B:
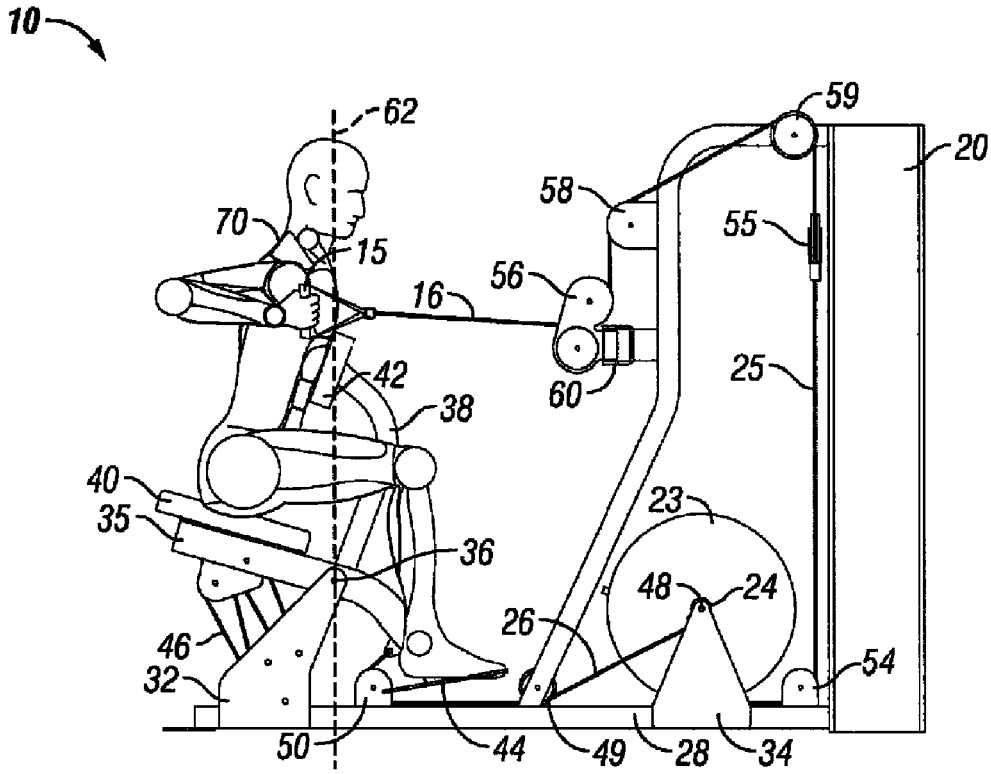
FIG. 4B is a side elevation view similar to FIG. 3, illustrating the user and machine in the end position of a rear deltoid exercise.
Figure 5:
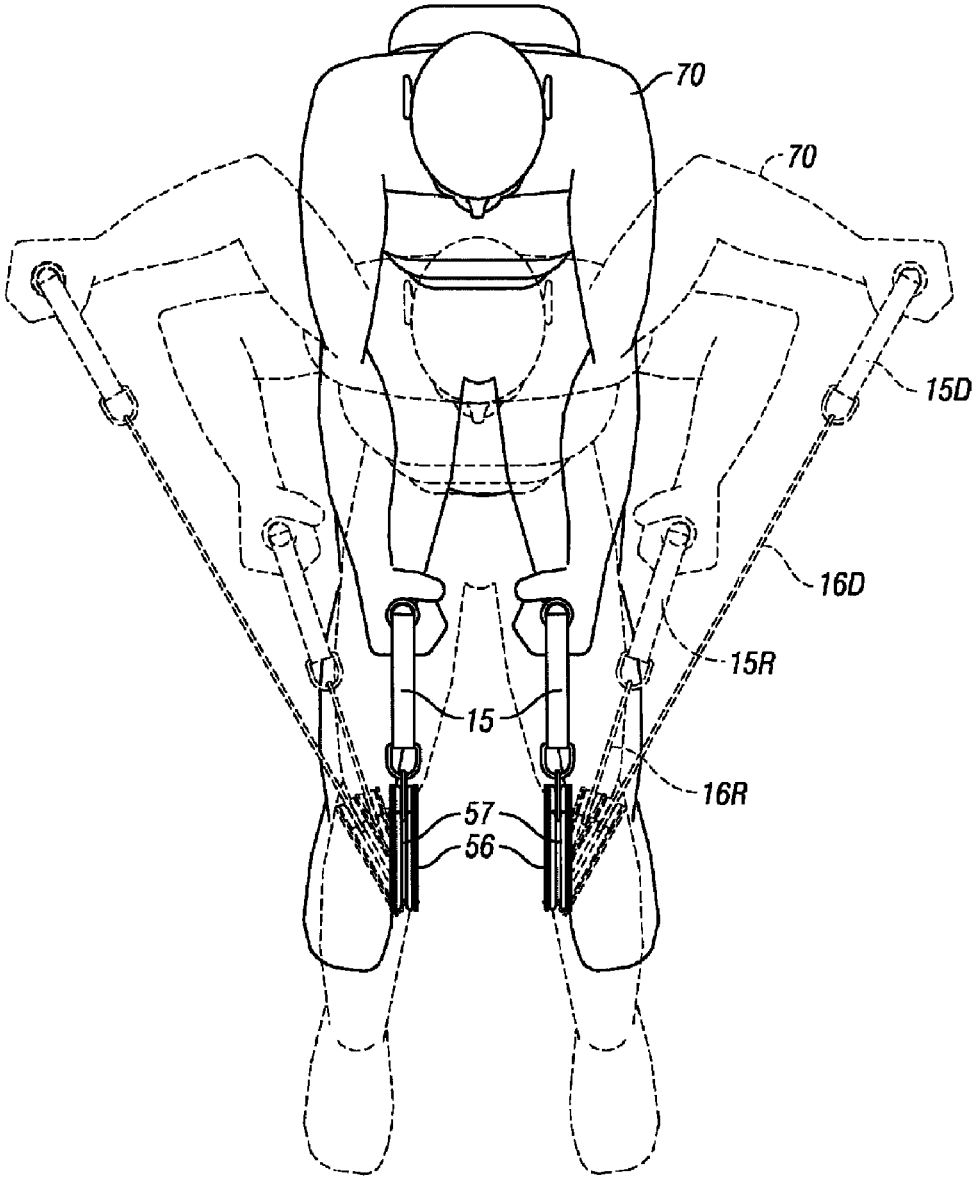
FIG. 5 is a top plan view of part of the user engaging handle part of the machine of FIGS. 1 to 4, with a seated user engaging the handles, illustrating user defined movement of the handles to perform different exercises.
Figure 6:
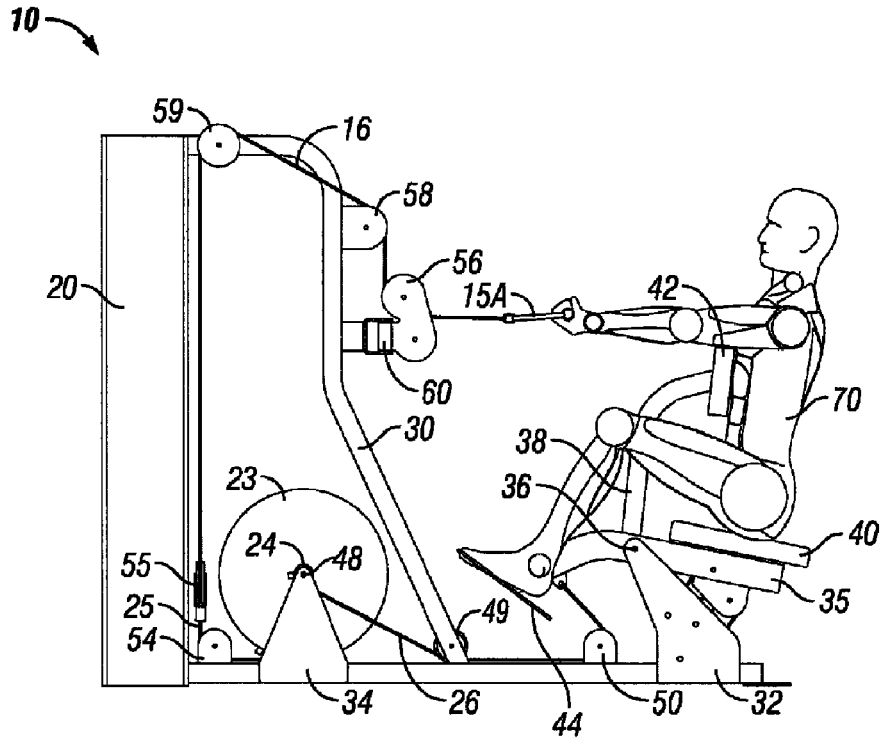
FIG. 6 is a side elevation view similar to FIG. 3, but illustrating the user engagement device in a start position for a biceps curl exercise.
Figure 7:
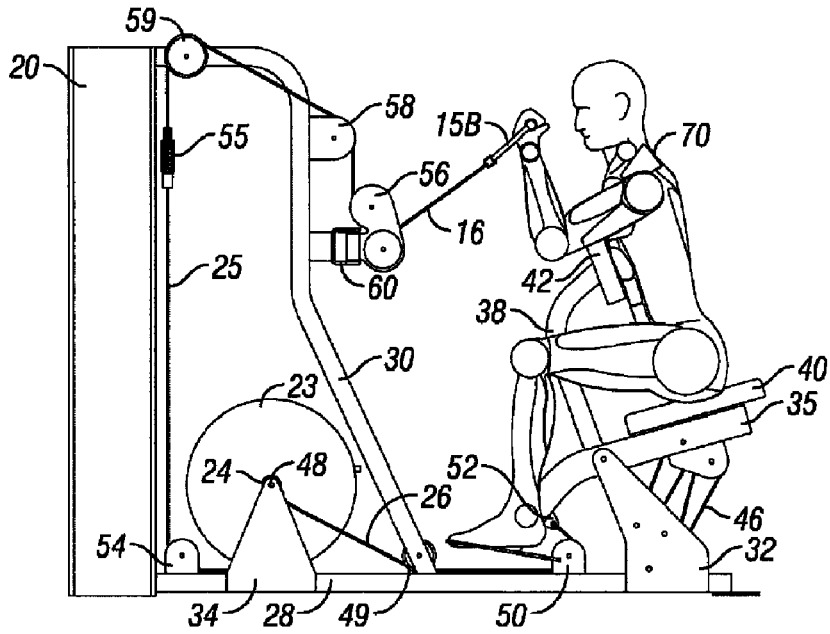
FIG. 7 is a side elevation view similar to FIG. 6, but illustrating the end position for a biceps curl exercise.
Figure 8:
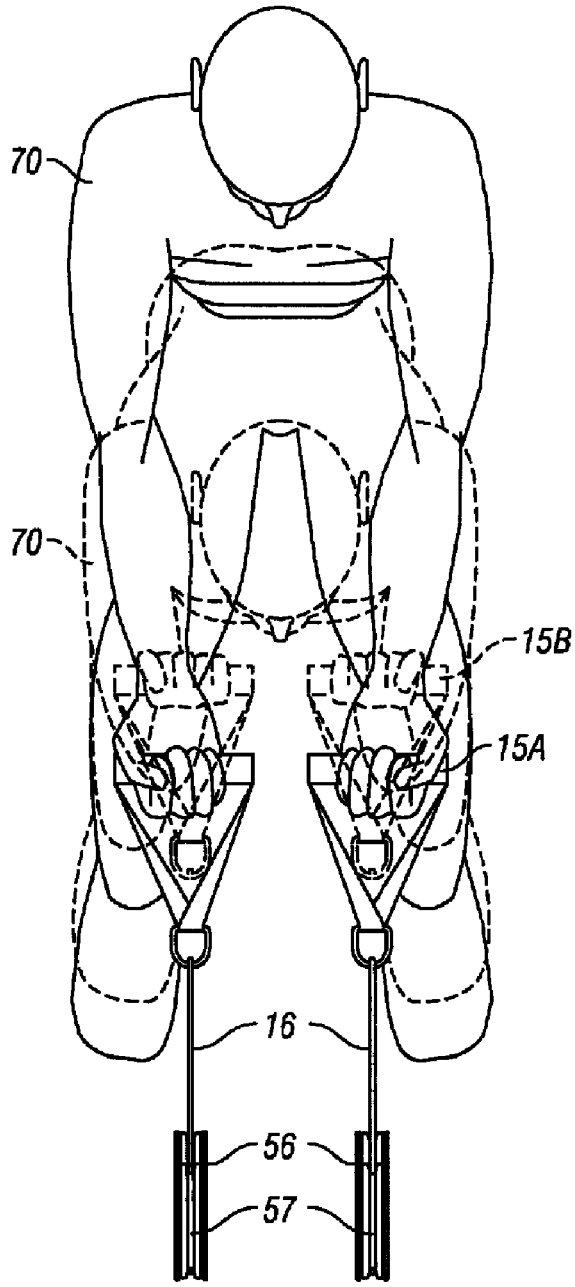
FIG. 8 is a top plan view similar to FIG. 5 but illustrating the user defined movement of the handles to perform a biceps curl exercise.

FIGS. 1 to 8 illustrate an upper back exercise machine 10 according to one embodiment. FIG. 1 illustrates the machine in a start position for one exercise, while FIG. 2 illustrates the machine in an end position for the exercise, with FIGS. 3 to 5 illustrating the same start and finish positions with a user seated on the machine, and FIGS. 6 to 8 illustrating start and finish positions for a different exercise.

The machine 10 has a main frame 12, a user support frame 14 pivotally mounted on the main frame, a multi-function user engagement device comprising user engaging handles 15 attached to opposite ends of a cable or flexible exercise arm member 16 extending around a series of pulleys in a cable and pulley assembly 18, an exercise resistance comprising a weight stack in housing 20 linked to the user support frame via a second cable and pulley assembly 22, and a multiple cam connecting linkage extending from the user engagement device to the user support frame. In this embodiment, the multi-function user engagement device 15, 16, 18 has two different modes of operation or actuation which allow a user to perform either upper back exercises or arm exercises, as described in more detail below.

The multiple cam linkage comprises a dual cam assembly 23, 24 and first and second cables or flexible links 25, 26 extending between cable 16 and a forward end of the user support frame, as explained in more detail below. The flexible links 25, 26 may comprise any suitable flexible elongate members such as cables, belts, lines, chains and the like.

The main frame 12 comprises a horizontal base section 28, an upright section 30, user support pivot mount plates 32 extending upwardly at the rear end of the base section, and a pair of cam pivot mounting plates 34 extending upwardly from the base section between the upright section 30 and the weight stack housing 20.

The user support frame 14 is generally T-shaped, with a base 35 pivotally mounted between the upper ends of the pivot mount plates via pivot pin 36, and an upright post 38 which curves rearward at its upper end. A user support seat pad 40 is mounted on the rear part of the base, while a chest support pad 42 is mounted at the upper end of post 38. A foot support or footplate 44 is secured to the forward end of the base 35. The rear part of the base 35 is linked to the weight stack via the second cable and pulley assembly 22. As best illustrated in FIG. 2, cable and pulley assembly 22 comprises a set of pulleys 45 mounted on the undersurface of base 35, a set of pulleys (not visible in the drawings) mounted between the pivot mounting plates 32, and a cable 46 extending from an anchor back and forth over the two sets of pulleys, and then running through the base 28 into the weight stack housing where it extends over further pulleys (not visible in the drawings) before linking in any conventional manner with the weight stack.

The forward end of the user support frame is linked to the user engaging handles via the connecting linkage 26, 24, 23, and 25, and the first cable and pulley assembly 18. The connecting linkage includes first and second cam portions 23, 24 of different diameter mounted on a pivot shaft 48 rotatably mounted between the upper ends of cam plates 34. The forward end of the user support base 35 is linked to the first, smaller cam 24 by a cable 26 extending from the cam around a pulley 49 at the lower end of upright 30, around a second pulley 50 on the frame base beneath the user support base, and tied off at anchor 52 on the underside of the base 35 close to the footplate 44 (see FIG. 1). Second cable 25 extends from the second, larger cam 23 around a fixed pulley 54 at the forward end of base 28 and is anchored to the housing of a floating pulley 55.

As noted above, the user engagement device in this embodiment comprises the handles 15 and flexible cable 16 which has opposite ends secured to the respective handles 15 and extends around a series of pulleys in cable and pulley assembly 18. The user device has several different modes of operation which can be selected by a user in order to perform different exercises, as explained in more detail below. Cable 16 extends from one handle between pulleys 57 of a first double swivel pulley assembly 56 mounted on upright 30, around one of a pair of fixed, side-by-side pulleys 58 on the upright above the swivel pulley assembly 56, then around one of a pair of parallel pulleys 59 on opposite sides of an upper, generally horizontal portion of the upright 30, and then downwardly around the floating pulley 55. From the pulley 55, cable 16 extends back up around the second one of the pulleys 59, around the second one of the pulleys 58, and is then reeved between the two pulleys in the second one of the swivel pulley assemblies 56, before connecting to the second handle 15. With this arrangement, rearward movement of one or both handles will pull up the floating pulley 55, rotating the cams 23 and 24. Cables 25 and 26 are oppositely connected to the respective cam portions 23 and 24 so that pulling on handles 15 unwinds cable 25 from cam portion 23 while winding cable 26 onto cam portion 24, rotating the user support frame upwardly about pivot 36. Handles 15 are partially flexible strap handles and can be rotated into any desired orientation.

The swivel mounts 60 of the two swivel pulley assemblies 56 allow the assemblies to pivot in and out as the user moves their hands in an exercise movement. FIGS. 3 to 5 illustrate a first mode of operation of the user engagement device which exercises a user's back muscles. In this mode of operation, the handles are actuated to perform mid row exercises which exercise the back muscles or rear deltoid exercises which use the rear deltoid or rear shoulder muscles. FIGS. 6 to 8 illustrate a second mode of operation of the user engagement device to perform arm exercises, specifically biceps curl exercises which exercise the biceps. Thus, the user engagement device 15, 16 has multiple functions and can be used in different modes of operation to exercise two distinct muscle groups, specifically the back muscles and the biceps muscles.

FIG. 3 illustrates a user gripping the handles 15 with their arms straight in front in the start position for either a mid row or rear deltoid ("delt") exercise. This position is also shown in solid lines in FIG. 5. The user moves their hands in a user selected path from this position to provide an exercise movement which exercises the upper back muscles. In order to perform an upper back exercise, the user 70 first sits on the user support in the position of FIG. 3 and the solid line position of FIG. 5, placing their feet on the footplate 44, their chest against the chest pad 42, and grabs the handles 15 with their arms straight in front of their body, slightly bent, and their hands close together, as indicated in FIG. 3 and in solid lines in FIG. 5. At the start of the exercise, the user is in a slightly reclined orientation at an angle of around 6 degrees to the gravitational centerline 62 or vertical centerline of the user support pivot 36, as illustrated in FIG. 3.

From the position illustrated in FIG. 3, the user pulls the handles or hand grips 15 rearward. Since the exercise arm in this embodiment is a flexible cable 16 which extends around pulleys 57 which can swivel inward and outward, the user controls the exercise path and thus the type of upper back exercise performed. In order to perform a rear deltoid exercise, the user moves their hands rearward and outward into an end position in which the user's arms are bent with their hands positioned out to the sides of their body, as illustrated in FIG. 4B and the outermost dotted line handle position 15D and cable position 16D of FIG. 5. As noted above, this movement also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 15. These factors together provide an enhanced workout by involving a greater number of muscles than a rear deltoid press performed in only one position, thereby combining multiple exercises into one. Instead of performing a rear deltoid exercise, a user may chose to perform a mid-row type of exercise, pulling their hands back and only slightly outwards, with the handles or grips 15 ending in the dotted line position 15R and the cable 16 ending in position 16R of FIG. 5. An end position for a mid row exercise is also illustrated in FIG. 4A. The user may define the travel path of the grips as desired throughout the exercise and may end the exercise with the handles in either of the positions illustrated in FIG. 5, or in any other desired position.

The gravitational centerline or vertical centerline 62 of the user support pivot runs through the exerciser's thigh, just behind the knee in the start position and ending at mid thigh in the finish position of the exercise illustrated in FIGS. 3 and 4. Regardless of whether the user performs a mid row or rear deltoid exercise, there is a balanced distribution of weight on each side of the centerline 62 both at the start and end position, minimizing the effect that the weight of the exerciser and user support has on the exercise resistance. The amount of weight positioned on each side of centerline 62 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 6 to 8 illustrate a user performing a biceps curl apparatus on machine 10. The user support is in the same position at the start of this exercise as for an upper back exercise, as illustrated in FIG. 6. The user sits facing in the same direction with their chest against chest pad 42, their feet engaging foot plate or plates 44, and their arms extending straight out in front. The only difference is the way in which the user grips the articulating handles 15. As illustrated in FIG. 6 and in the first, solid line position 15A of FIG. 8, the hand grips are oriented horizontally and the user clasps the grips from underneath with their hands facing upwards, in the start orientation for a biceps curl exercise.

FIG. 7 and the dotted line position of FIG. 8 illustrate the end position for the biceps curl exercise, in which the user's arms are bent upwards at the elbow with their hands in front of their face, in position 15B. The movement of handles 15 from position 15A to position 15B simultaneously pulls cable 16, raising floating pulley 55 from the position illustrated in FIG. 6 to the position illustrated in FIG. 7. This movement is translated by the connecting linkage 25, 23, 24, 26 into rotation of the user support about pivot axis 36, so that the forward end of the user support pivots down while the rear end pivots up, ending in a forward lean of about twenty degrees, as illustrated in FIG. 7. This is similar to the end position for an upper back exercise, as illustrated in FIG. 3.

In this embodiment, the user engagement device comprises handles attached to a flexible line or cable 16, to provide a unilateral, three dimensional user defined exercise motion. The machine is designed to mimic the natural elliptical movement of corresponding free dumbbell upper back or biceps curl exercises, and is able to combine the effectiveness of multiple exercises by rotating the user from reclined to flat to inclined positions throughout the exercise. The user can select a desired mode of operation depending on the muscles they wish to exercise, simply by controlling the path of handles 15 and cable or line 16. The connecting linkage which translates movement of the user engagement device into movement of the user support frame is partially flexible and includes at least two axially spaced cams or cam portions rotatably mounted about the same cam axis 48, arranged so that one cable or flexible link wraps around one of the cam portions while the other unwraps. Pulling on the handles or grips 15 in this machine, whether to perform an upper back exercise or a biceps curl exercise, rotates the dual cam assembly in a first direction (anti-clockwise as viewed in FIGS. 3 and 4), unwinding cable 25 from the larger cam 23, while winding a smaller amount of cable onto the smaller cam 24. Cams or separate cam portions of different relative diameters can be selected in order to change the ratio between handle movement and user support frame movement, depending on the desired end position for the user support frame.

The exercise machine 10 may be a stand-alone machine, or may be secured to other stations in a multiple station exercise machine, for example as described in co-pending application Ser. No. 12/142,636 filed on Jun. 19, 2008, the contents of which are incorporated herein by reference. This machine allows the user to choose the type of exercise and the muscles to be exercised, and also allows the user to define the travel path for the selected exercise, for example the handles may be moved in a linear or elliptical path.

FIGS. 9 to 16 illustrate a second embodiment of an exercise machine 75 with a pivoting user support 76 which supports a user in an exercise position, and multi-function exercise arms 78 which have two modes of operation to perform either a shoulder press exercise which exercises the shoulder muscles, or a lat pulldown exercise which exercises the lat muscles of the back.

Exercise machine 75 has a stationary main frame 80 on which the user support 76 is pivotally mounted, and the exercise arms 78 are pivotally mounted on opposite sides of a rear upright portion 84 of the main frame to extend on opposite sides of the user support. A multiple part connecting linkage 86 is provided between the exercise arms 78 and the user support 76 so that movement of the exercise arms is translated into movement of the user support. Exercise resistance is provided by a bi-directional hydraulic ram assembly 88 which is pivotally secured to the upper end of main frame upright portion 84 at one end, and to the connecting linkage 86 at the opposite end.

The main frame 80 comprises base 90 and rear upright portion 84. The base has a ground engaging foot 91 at its forward end, and a short stand off post 92 projects upwards from foot 91. The base is inclined upwardly from the front to the rear end, and is secured to a horizontal cross bar 93 of the rear upright portion at its rear end. Rear upright portion 84 has a pair of upright struts 94 connected together by a cross member 95 at their upper ends, and by cross bar 93 at a location spaced below their upper ends, with the upright struts 94 inclined outward to form a generally A-frame structure. A central, rearwardly inclined upright strut 96 extends from base 90 at a location spaced forward from cross bar 93 to cross member 95, and forms the support for the upper end of the bi-directional ram assembly 88. A forwardly inclined pivot support strut 89 extends upwardly from the base 90 at a location spaced forward from central upright strut 96.

Figure 10:
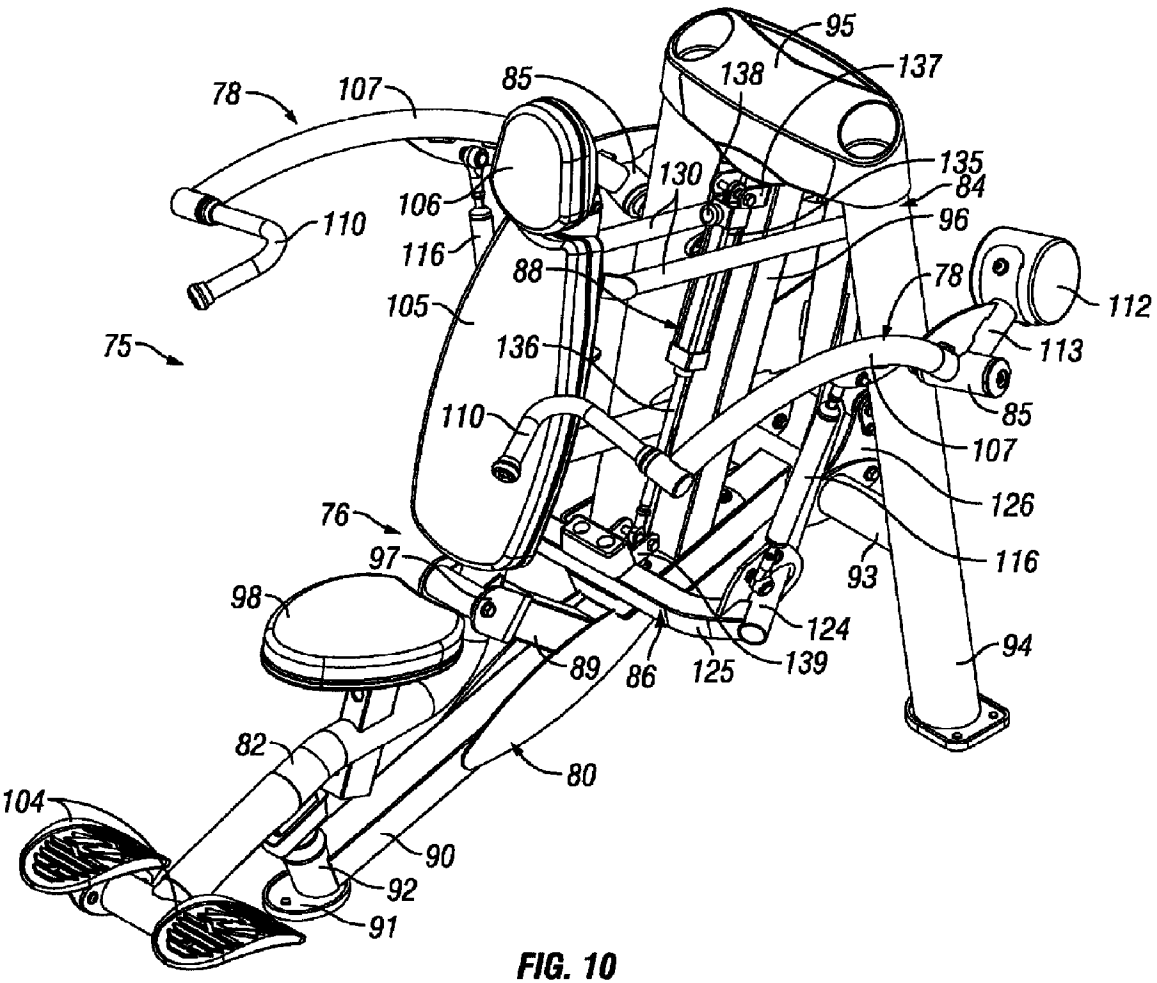
FIG. 10 is a front perspective view of the machine of FIG. 9 with the exercise arms in a second, lower position corresponding to the end of a lat pulldown exercise and the start of a shoulder press exercise.
Figure 11:
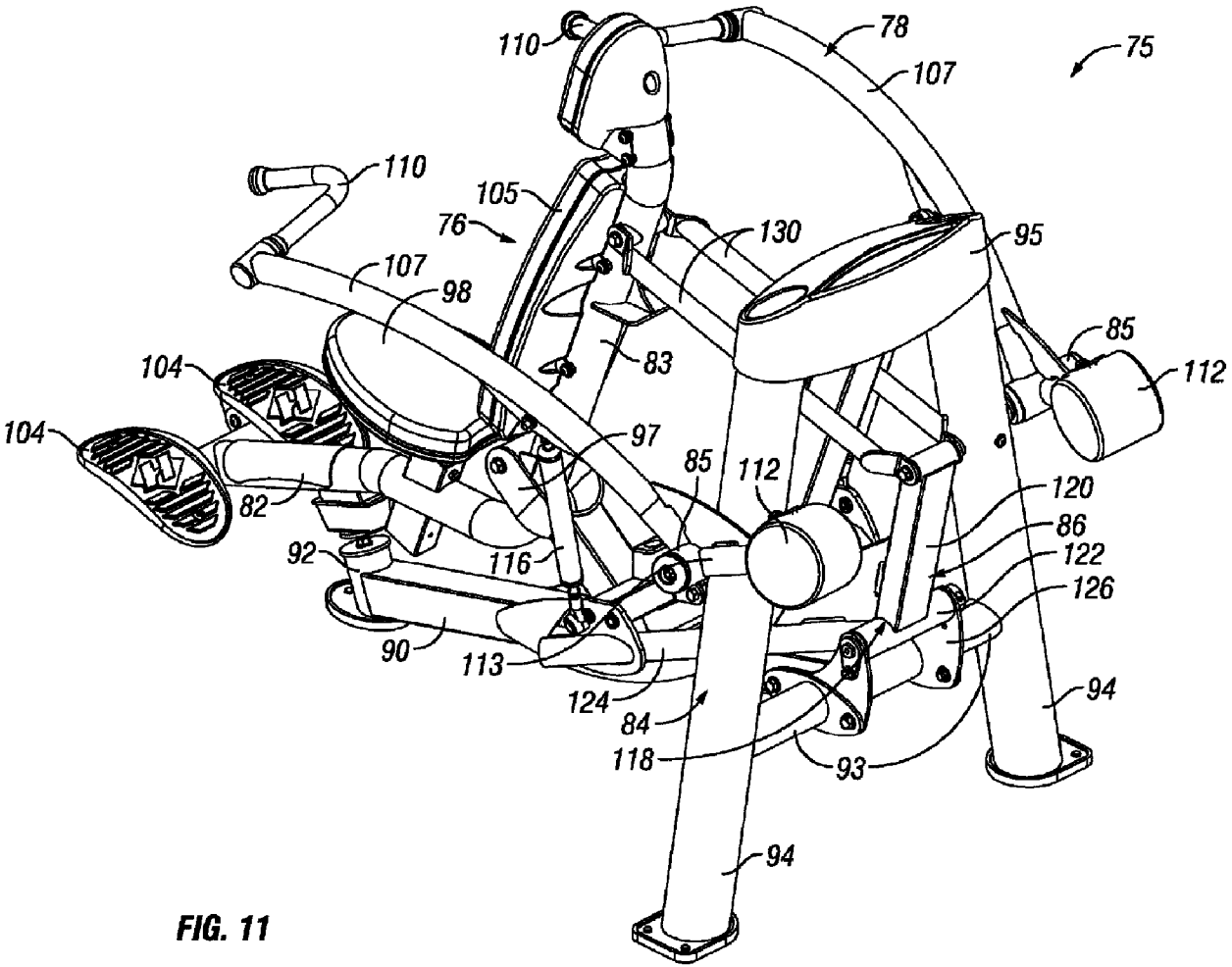
FIG. 11 is a rear perspective view of the machine of FIGS. 9 and 10 with the arms in the second position.
Figure 16:
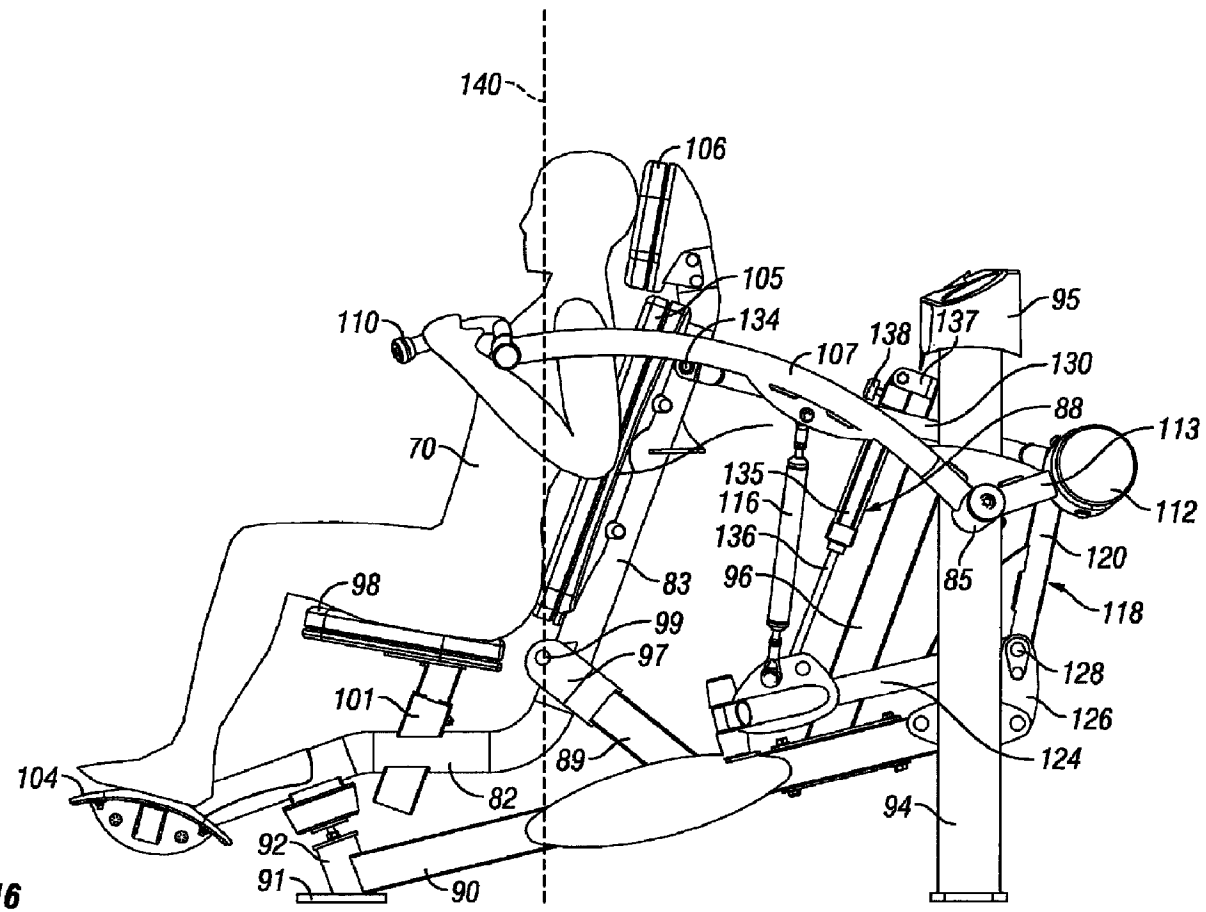
FIG. 16 is a side elevation view of the exercise machine similar to FIG. 15 but with the exercise arms and user support in the second position of FIG. 10.
Figure 17:
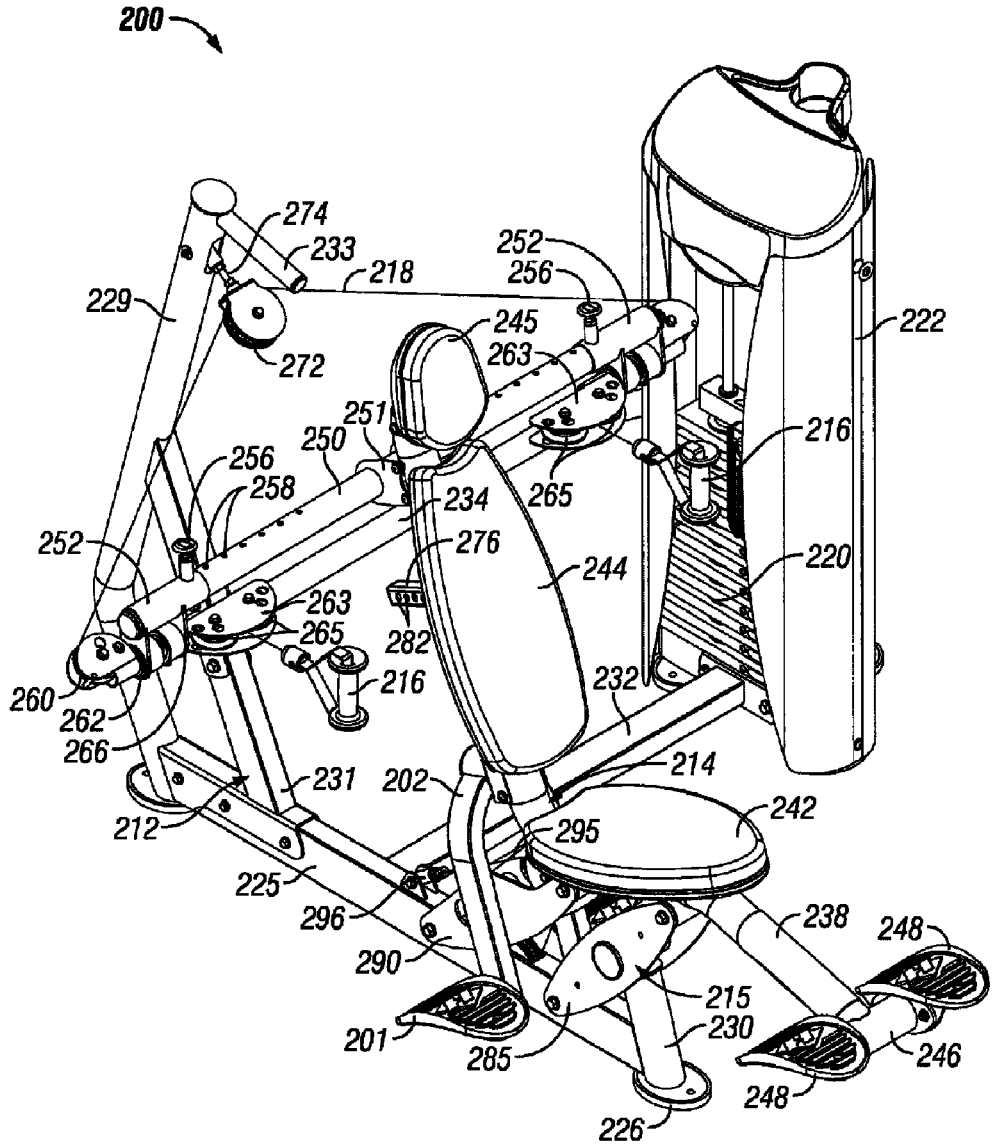
FIG. 17 is a front perspective view of another embodiment of an exercise machine with a multi-function user engagement device for performing pec fly and rear deltoid exercises, with the user engagement device shown in a start position for a pec fly exercise.

User support frame 76 is generally L-shaped with a base portion 82 and an upright portion 83, and is pivotally supported at the upper end of pivot support 89 for rotation about pivot axis 99 via pivot bracket 97 located above the junction or bend between the base portion 82 and upright portion 83 of the frame. A seat pad 98 is adjustably mounted on the base portion 82 via seat support post 100 which is telescopically engaged in an open upper end of a seat support tube 101 on the base portion. Seat support post 100 has a series of openings for releasable engagement with pull pin 103 to adjust the seat pad height based on user size and preference. The base portion 82 of the user support frame extends forward from the seat support tube 101 and a foot support bar 102 is transversely mounted at the forward end of base portion 82, with a foot support or foot rest 104 mounted at each end of bar 102 for engagement by a user's feet. A back pad 105 and a head rest pad 106 are mounted on the upright portion 83 of the user support frame. The base portion 82 of the user support engages the upper end of post or stand-off 92 in a first position of the user support, as illustrated in FIGS. 10, 11, and 16.

Figure 12:
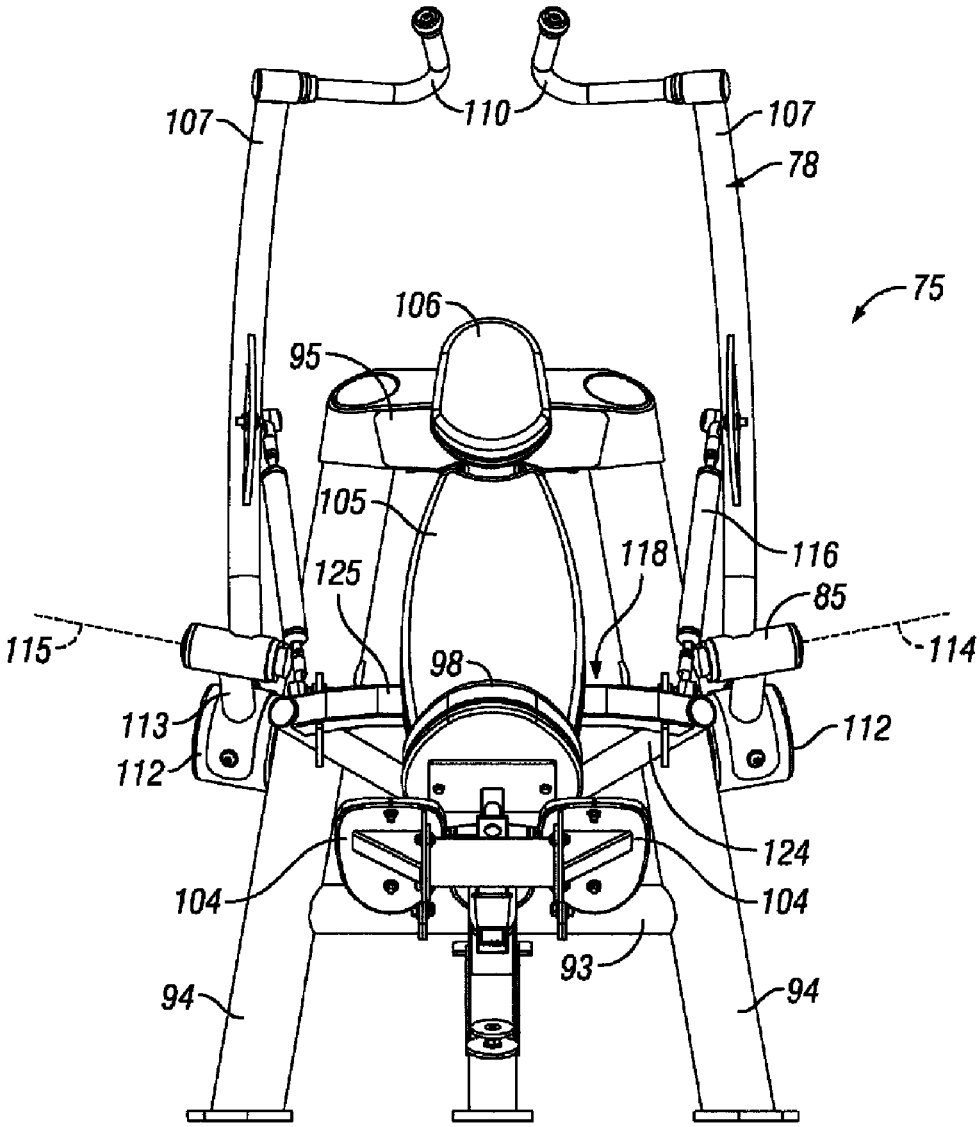
FIG. 12 is a front elevation view of the machine in the position of FIG. 9.
Figure 13:
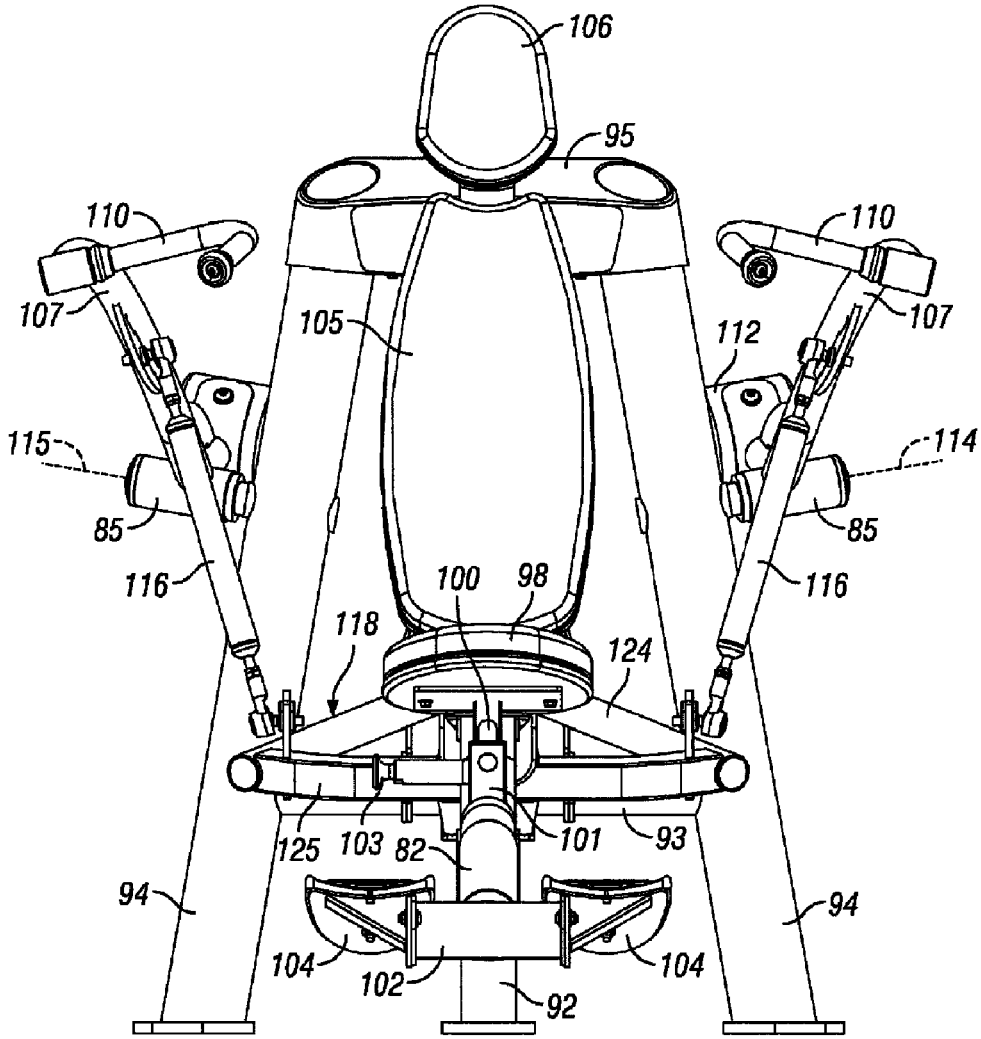
FIG. 13 is a front elevation view of the machine in the position of FIGS. 10 and 11.
Figure 14:
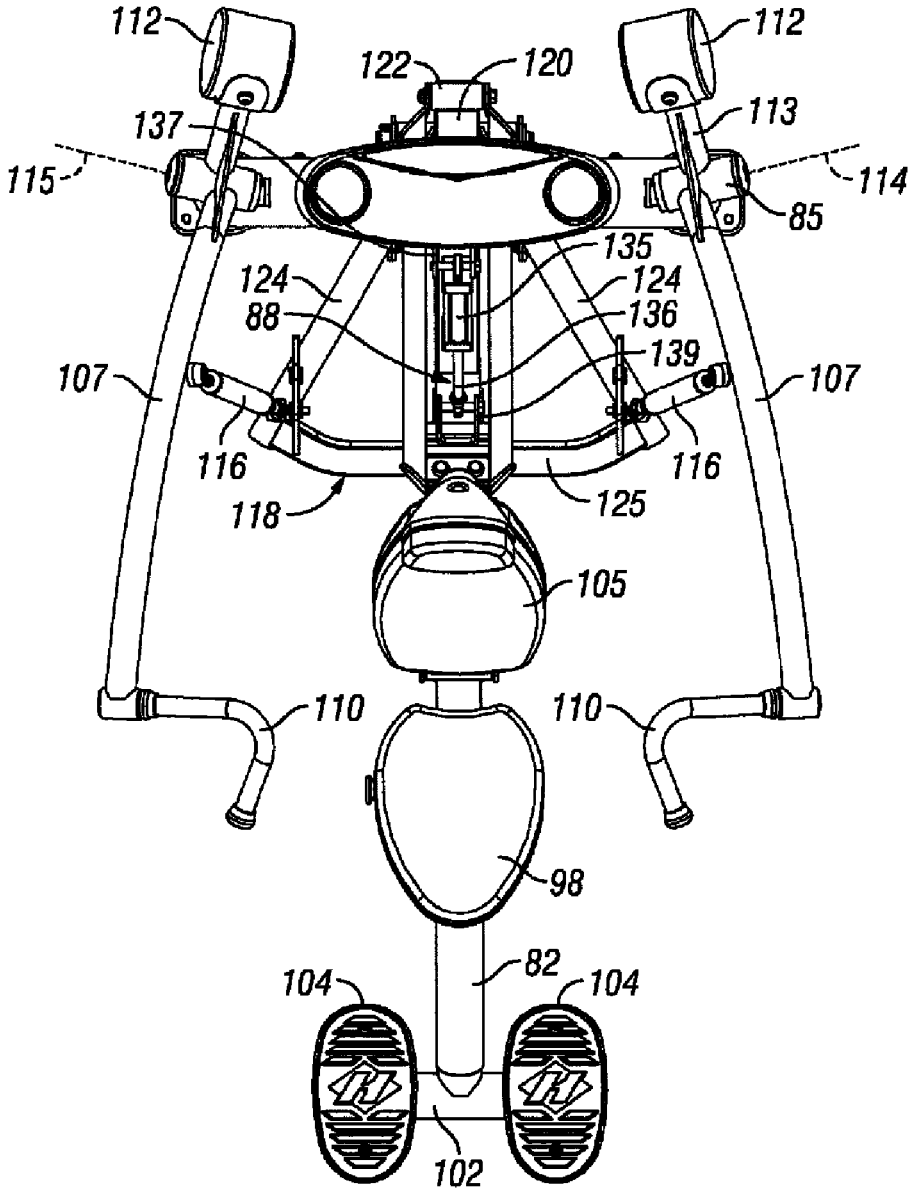
FIG. 14 is a top plan view of the machine in the position of FIG. 13.

Each exercise arm 78 comprises an arcuate member 107 having a first end secured to a respective pivot housing or sleeve 85. An inwardly directed angled handle or grip 110 is secured to the end of each arcuate member. A counterweight 112 is secured to a rearward projection 113 of pivot sleeve 85 to offset or counterbalance the weight of the exercise arm. Pivot sleeves 85 are each pivotally secured via skewed pivot pins to the respective rear upright 94, defining skewed, non-parallel pivot axes 114, 115, as best illustrated in FIGS. 12 to 14. Due to the skewed pivot mounts, each arm is rotated in an outward or diverging path as it rotates from the upper end position of FIGS. 9 and 12 to the lower end position of FIGS. 10 and 13, and moves in an inward or converging path as it rotates from the lower end position to the upper end position.

Figure 15:
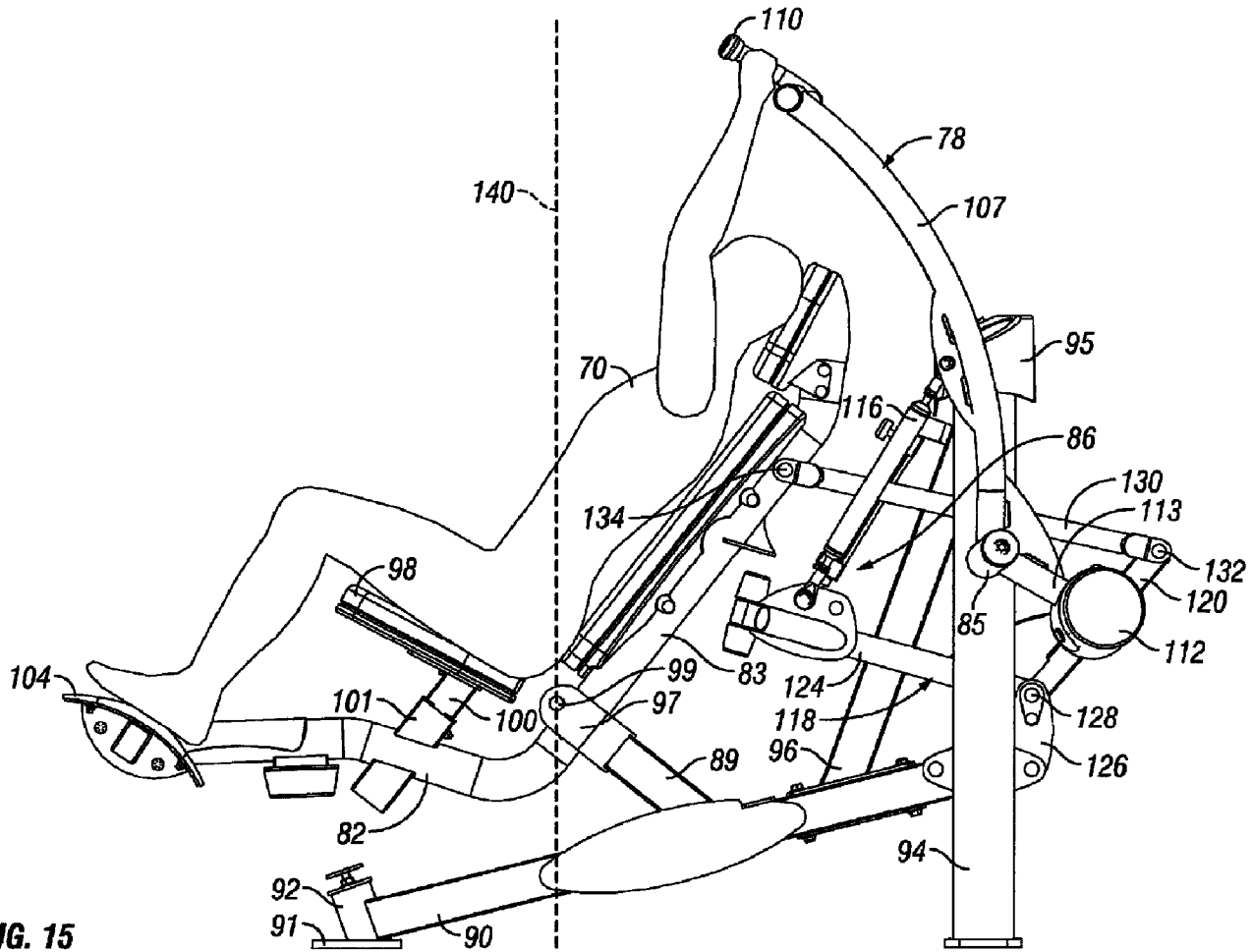
FIG. 15 is a side elevation view of the machine of FIGS. 9 to 14 with the arms in the position of FIG. 9 and a user seated in an exercise position on the machine at the start of a lat pulldown exercise or the end of a shoulder press exercise.

The connecting linkage 86 comprises multiple links between each exercise arm and the user support. A pair of first links or tie rods 116 each have a first end pivotally connected to the respective exercise arm member 107 at a location spaced between the pivot mount and handle, and a second end pivotally connected to the lower end of a link arm 118 which is generally L-shaped (see FIGS. 11, 15 and 16). Link arm 118 has a generally upwardly extending rear portion 120 secured to pivot sleeve 122 at its lower end (FIG. 11), and a pair of outwardly diverging rods or bars 124 extending forward from pivot sleeve 122, as illustrated in FIGS. 11 and 14. Rods 124 are secured together by a cross bar 125 at their forward ends, and the lower ends of tie rods 116 are pivoted adjacent the forward ends of the respective rods 124. Pivot sleeve 122 is rotatably mounted on a pivot pin extending between pivot brackets 126 mounted on the main frame cross bar 93 for rotation about pivot axis 128, as best illustrated in FIGS. 15 and 16. Two parallel second links 130 are each pivotally secured at their rear ends to the upper end of rear portion 120 of link arm 118 for rotation about pivot axis 132, and are pivotally secured at their forward ends to the rear upright 83 of the user support, for rotation about pivot axis 134 (see FIG. 15). This multiple pivot link arrangement translates movement of the exercise arms into movement of the user support.

As described above, the bi-directional hydraulic ram or gas shock assembly 88 provides exercise resistance to movement of the exercise arms. Assembly 88 comprises a cylinder 135 and a piston 136 telescopically engaged in cylinder 135 (see FIGS. 10, 14 and 16). Cylinder 135 is pivotally secured at the upper end between pivot brackets 137 close to the upper end of main frame upright 96, and piston 136 is pivotally secured at its lower end between pivot brackets 139 at or close to the center of the forward cross bar 125 of link arm 118. This arrangement provides resistance to both pulling of the piston out of cylinder 135 and pushing of the piston into cylinder 135.

Figure 9:
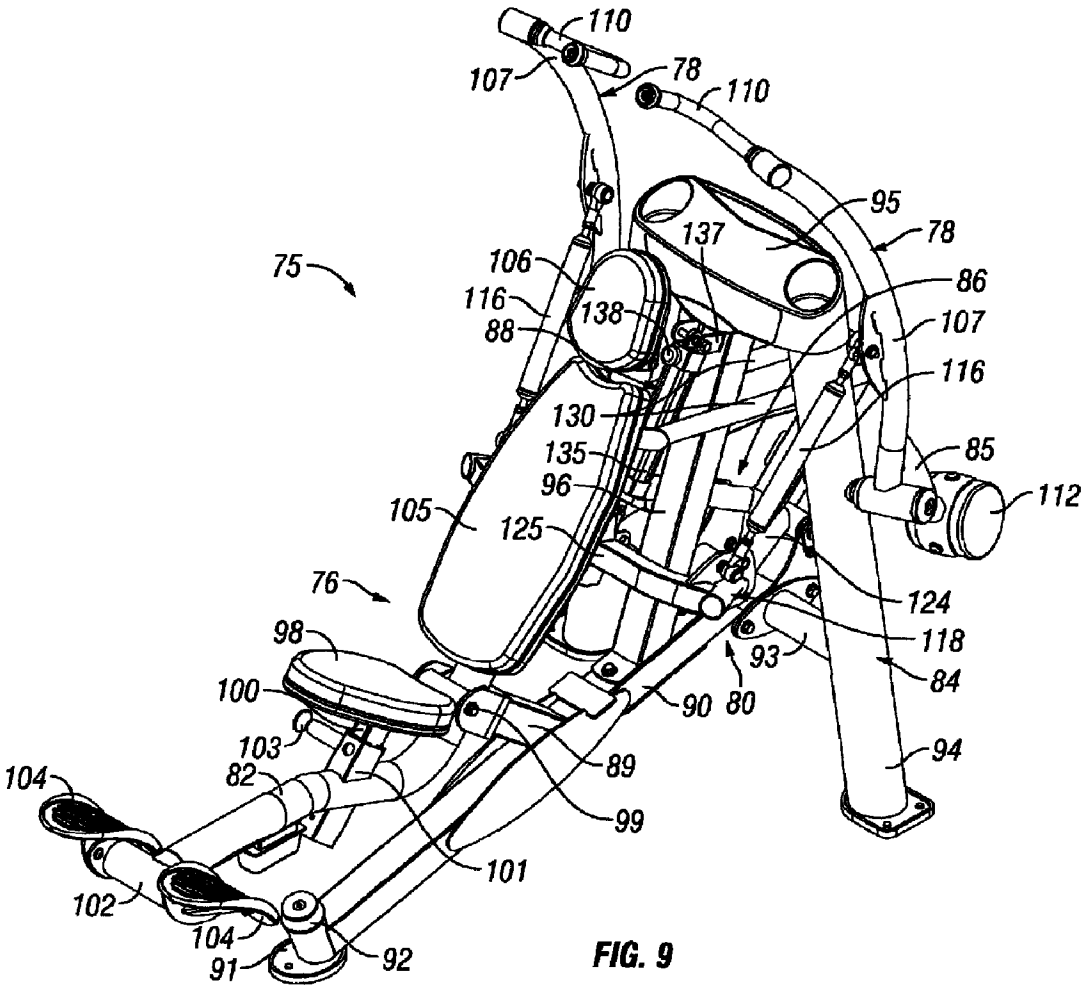
FIG. 9 is a front perspective view of another embodiment of an exercise machine with multi-function exercise arms, with the arms in a first position corresponding to the start of lat pulldown exercise and the end of a shoulder press exercise.

When the exercise arms are in the upper position of FIGS. 9 and 15, the gas shock or ram assembly 88 is at its shortest length with the piston 136 more or less completely retracted into cylinder 135. As the arms are pulled down from the upper position to the lower position of FIG. 10, links 116 push down the forward end of link arm 118, simultaneously pulling piston 136 out of cylinder 135 into the extended position of FIGS. 10 and 16 against the resistance of the gas in cylinder 135. The resistance can be adjusted using an adjustment knob 138 (FIG. 16) on the cylinder 135. When the exercise arms are pushed back up into the upper position, the link arm is raised at its forward end, pushing piston 136 back into the cylinder against the resistance of gas in the cylinder. Thus, exercise resistance is provided in both directions of exercise arm movement.

The exercise arms 78 may be selectively used in two different modes of operation, to perform either a lat pulldown exercise or a shoulder press exercise which exercise different muscles. In the first mode of operation, the user support and exercise arms start in the position of FIGS. 9 and 15, with the arms in the upper position and the user support inclined rearward, in order to perform a lat pulldown exercise. FIG. 15 illustrates a user 70 seated on the user support in this position with their arms raised above their head while gripping handles 110. From this position, the user pulls the handles downward, which in turn rotates the handles downward and outward in a diverging path, as can be seen by comparison of FIGS. 12 and 13, with the users hands following an equivalent path.

At the same time, the link arm 118 is pushed down at its forward end, rotating about pivot axis 128 to rotate the rear upright 120 forward, simultaneously urging the second links 130 forward and causing the user support to rotate forward about pivot axis 99, ending in a less reclined position with the base 82 resting on stop 92 at the forward end of the main frame. The end position for a lat pulldown exercise is illustrated in FIGS. 10, 11, 13, 14 and 16. In this position, the base portion 82 of the user support frame rests on stop post 92.

The multi-function exercise arms 78 can alternatively be used in a second mode of operation to perform a shoulder press exercise, exercising a different muscle group. The lower arm position of FIGS. 10 and 16 is the start position for a shoulder press exercise. The user 70 sits on the seat as illustrated in FIG. 16, grabs the handles 110 with their hands in front of their chest, and pushes the arms upward. Due to the skewed pivot mounting of the two exercise arms, the arms converge inwardly in arcuate paths as they move to the uppermost position, so that the user's hands follow a similar converging path (see handle positions in FIGS. 13 and 12). As the arms 78 are pulled up, links or tie rods 116 pull up the forward end of the link arm 118, simultaneously pushing the upper end of upright 120 rearwards and moving the user support 76 back into the more reclined end position of FIGS. 9 and 15.

Resistance to both pushing and pulling of arms 78 is provided by the bi-directional gas shock or ram assembly 88, as described above. In this embodiment, as in the previous embodiment, the gravitational centerline or vertical centerline 140 of the user support pivot runs through the user support and the user in both the start and finish position of each exercise. Regardless of whether the user performs a lat pulldown or shoulder press exercise, there is a balanced distribution of weight on each side of the centerline 140 both at the start and end position, minimizing the effect that the weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 17 to 25 illustrate another embodiment of an exercise machine 200 with a multiple function user engagement device or exercise arm assembly. The user engagement device in this embodiment also has two possible modes of operation to allow a user to perform two different types of exercise, in this case a pectoral fly exercise or a rear deltoid exercise, exercising either the pectoral muscles or the rear deltoid muscles. This exercise machine is also described in U.S. Provisional Application No. 61/059,035 filed on Jun. 5, 2008, the contents of which are incorporated herein by reference.

Machine 200 has a stationary main frame 212, a user support frame 214 pivotally mounted on the frame via a four bar pivot system or assembly 215, and a multi-function user engagement device comprising a pair of user engaging handles 216 linked to the user support frame and the main frame via at least one flexible line or cable 218 which extends from the handles around a series of swiveling pulleys, so that movement of one or both handles results in pivoting movement of the user support frame. The user support frame 214 is linked to a weight stack 220 mounted in weight stack frame or housing 222 via a cable and pulley linkage, as described in more detail below.

Figure 18:
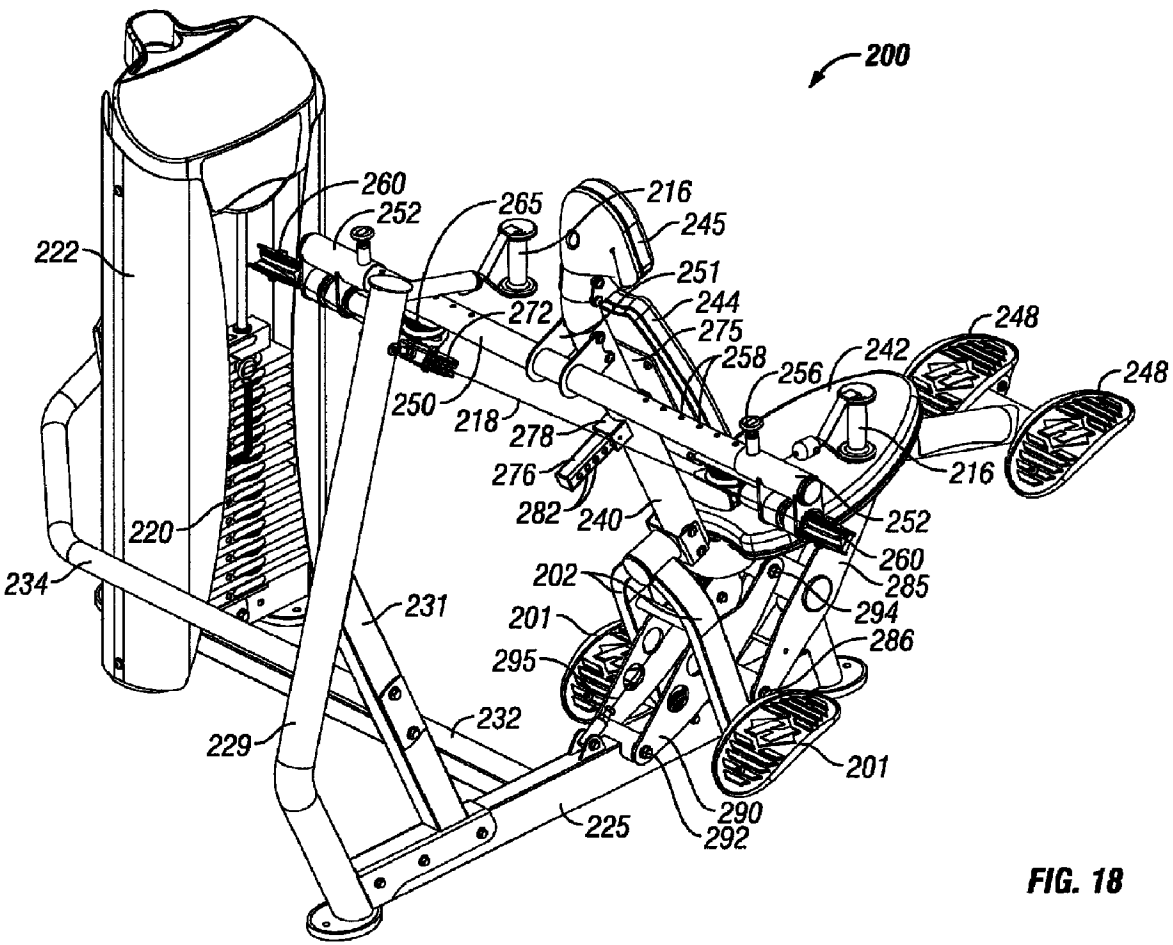
FIG. 18 is a rear perspective view of the machine in the position of FIG. 17.
Figure 19:
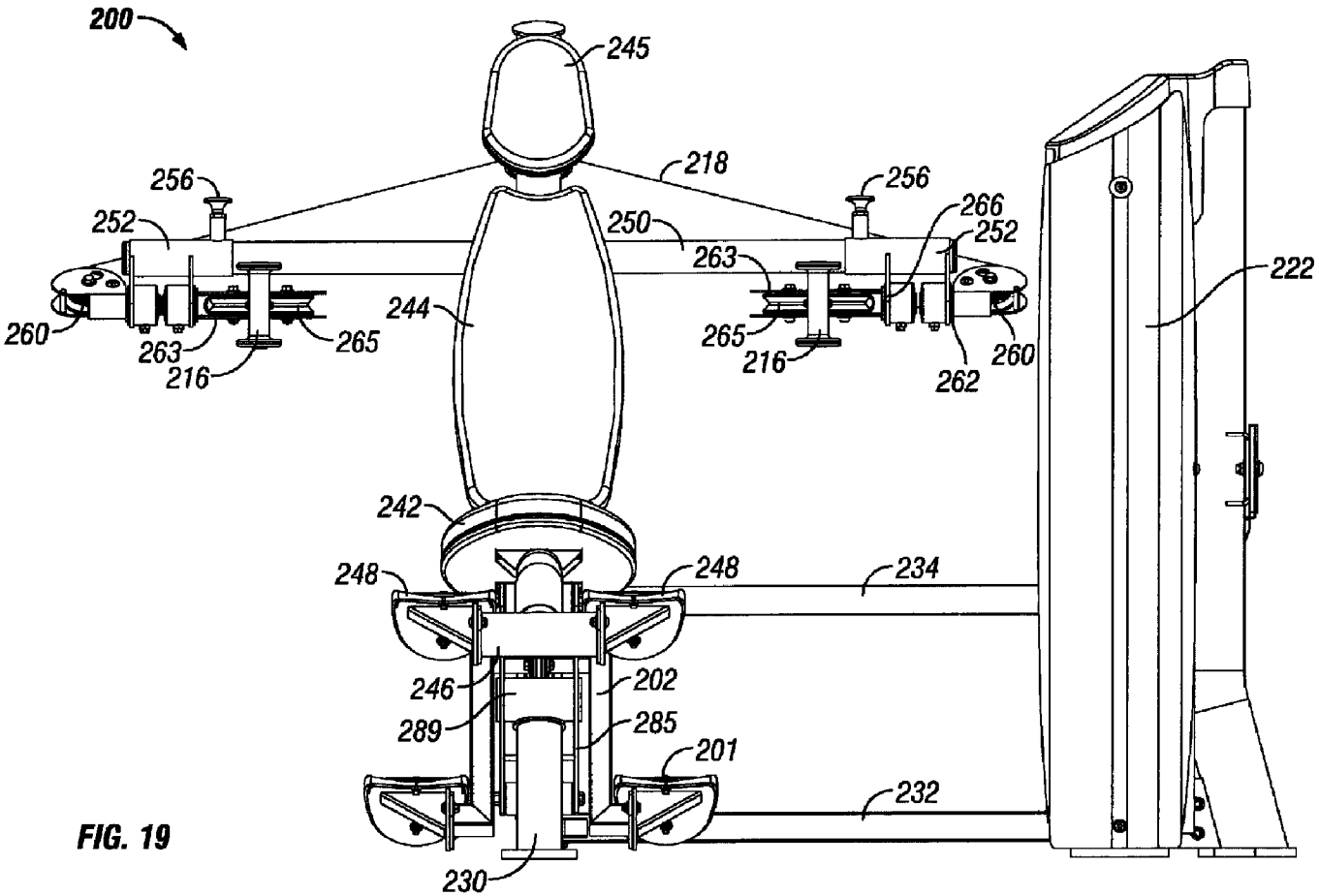
FIG. 19 is a front elevation view of the machine in the position of FIGS. 17 and 18.

The main frame 212 has a base section or strut 225 having a ground-engaging pad or foot 226 at each end, a first or rear upright strut 229 at the rear end of base strut 225, and a relatively short upright post or stand-off 230 at a forward end of base strut 225. Rear upright strut 229 has a forwardly inclined upper portion, and an angled support strut 231 extends from the base strut 225 to the angled portion of the rear upright strut. An upper stand-off or post 233 projects forward from the upper end of strut 229 to provide a rest for the user support frame in the end position. The weight stack housing 222 is connected to one side of the main frame via a guide tube 232 extending between the base strut 225 and the base of housing 222, and via a connecting strut 234 extending from support strut 231 to the outer side of housing 222, as best seen in FIG. 18.

User support frame 214 is generally L-shaped with a base portion 238 and an upright portion 240. A seat pad 242 is mounted on the base portion 238 and back pad or chest pad 244 is mounted on upright portion 240, along with pad 245 which is used as a head rest when the pad 244 is in use as a back pad. The base portion 238 of the user support frame extends forward from the seat pad 242 and a foot support bar 246 is transversely mounted at the forward end of base portion 238, with a foot plate or foot rest 248 mounted at each end of bar 246 for engagement by a user's feet when in a forward facing, pectoral fly exercise position. A second pair of foot plates or foot rests 201 is mounted at the ends of a pair of support rods or arms 202 projecting downwardly from the lower end of rear upright 240 of the user support frame on opposite sides of the user support pads 242, 244. Foot rests 201 are used to support the user's feet when seated in the rearward facing, rear deltoid exercise position of FIGS. 24 and 25.

A transverse support post or cross bar 250 is secured to an upper part of upright portion 240 via connecting brackets 251, so as to extend transversely across the rear of the user support frame in a T-shaped configuration at a location adjacent the upper end of back pad 244. The support post 250 provides a mount for some of the swiveling pulleys of the user engagement device, as explained in more detail below. An adjustment sleeve 252 is slidably mounted at each end of the support post 250 and provides a support for swivel mounted pulleys forming part of the user engaging assembly. Each sleeve 252 is secured in a selected position on support post 250 via a pull pin 256 engaging in a selected hole 258 in post 250. An outer swivel pulley 260 is mounted on each sleeve 252 via swivel mount 262. A pair of pulleys 265 are also mounted in a dual pulley housing 263 which is pivoted on each sleeve inboard of the outer swivel pulley 260 via swivel mount 266. As noted above, the user engagement assembly includes first and second handles 216 and a flexible line or cable 218 which links the handles to the user support frame and main frame. Cable 218 extends from one handle 216 in a path between the pair of swivel mounted pulleys 265, then around the outer swivel pulley 260 and a single swivel pulley 272 mounted at the upper end of the frame rear upright 229 via swivel mount 274. From pulley 272, the cable extends to the single swivel pulley 260 at the other side of cross bar 250, then between the other pair of pulleys 265 before connecting to the second handle 216. The swivel pulleys provide a connecting linkage which translates movement of one or both handles 216 into movement of the user support frame 214.

The single swiveling pulleys 260 and 272 are free pivoting and capable of independent movement, while the double pulley assemblies containing pulleys 265 are free pivoting independent of the single pulleys. Although the cable 218 is attached to partially flexible strap handles in the illustrated embodiment, alternative types of handles or hand grips may be secured to the ends of cable 218 in alternative embodiments. The outer swivel pulleys on the cross tube 250 track the movement of the central, swiveling pulley 272 on the main frame, while the double pulley assemblies of pulleys 265 track the movement of the handles 216, as can be seen in the drawings. This allows the user to determine the movement of their hands and arms in performing an exercise.

The user engagement device can be adjusted to allow a user to perform different exercises by adjusting the positions of the swivel pulleys 260 and 265. This is done by moving the sleeves 252 to selected positions along the cross bar 250. FIGS. 17 to 21 illustrate the sleeves 252 at or adjacent the outer ends of post or cross bar 250 to place the handles 216 in a start position for a pectoral fly exercise. FIGS. 22 to 25 illustrate the sleeves 252 moved inwardly towards one another on cross bar 250 so as to place the handles 216 in a start position for a rear deltoid exercise.

As noted above, the pad 244 on the user support is selectively usable as a back pad or chest pad, depending on whether the user wishes to perform pec fly or rear deltoid exercises. Pad 244 has a rear plate 275 and an adjustment post 276 extends from the rear plate and through an adjuster tube 278 which extends through the rear upright 240 of the user support frame. A spring loaded pull pin 280 (FIG. 22) extends through tube 278 into a selected one of a series of holes 282 in post 276 in order to secure the pad 244 at a selected spacing from the rear upright 240. In FIGS. 17 to 21, the post 276 extends through the tube 278 as far as possible and the pad is located adjacent rear upright 240 to provide a back rest for a user seated on seat pad 242 and facing forwards in a pec fly exercise start position. FIG. 21 illustrates a user 70 seated on the user support with the back pad 244 in this position. In FIGS. 22 to 25, the pad 244 is adjusted so that the post 276 projects forward from upright 240 to space the pad away from upright 240. In this position, pad 244 acts as a chest pad for engaging the chest of a user 70 seated on seat pad 242 and facing rearward in the start position of a deltoid press exercise, as illustrated in FIG. 24.

As noted above, the user support frame 214 is pivotally mounted on the main frame via four-bar pivot system 215 between the user support frame and main frame. This system allows the theoretical pivot of the pivotal movement to be positioned in the user support area but has the actual pivoting action take place below the user. The four-bar linkage is best illustrated in FIGS. 17, 18, 21 and 22 and has four spaced, parallel pivot axes. The linkage has a pair of spaced, parallel forward links 285 pivoted at one end to the base 225 of the main frame for rotation about first pivot axis 286 and at the opposite end to the base portion 238 of user support frame 214 for rotation about a second pivot axis 288 below a forward end of seat pad 242. The forward links or plates 285 are connected together at a location between their ends by connecting post 289, which rests on the upper end of stand-off 230 at the forward end of the main frame when the user support frame is in a rest or exercise start position. A pair of rear links or plates 290 are pivoted at one end to the base 225 of the main frame for rotation about a third pivot axis 292 spaced rearwardly from axis 286, and pivoted at the opposite end to the base portion 238 of the user support frame for rotation about a fourth pivot axis 294 spaced rearwardly from axis 288.

Figure 20:
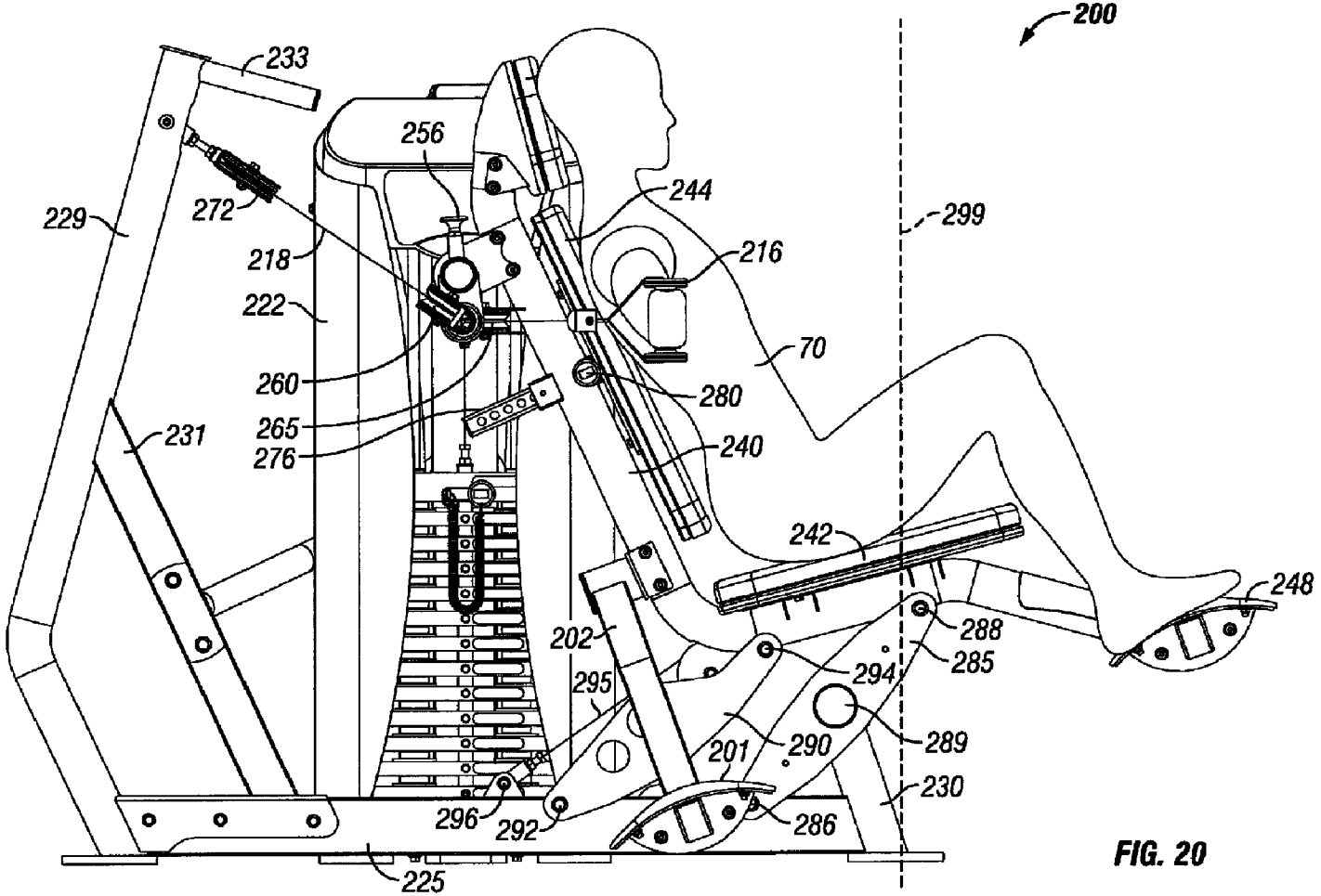
FIG. 20 is a side elevation view of the machine in the start position of FIG. 17 but illustrating a user in position on the machine and gripping the handles at the start of a pec fly exercise.
Figure 21:
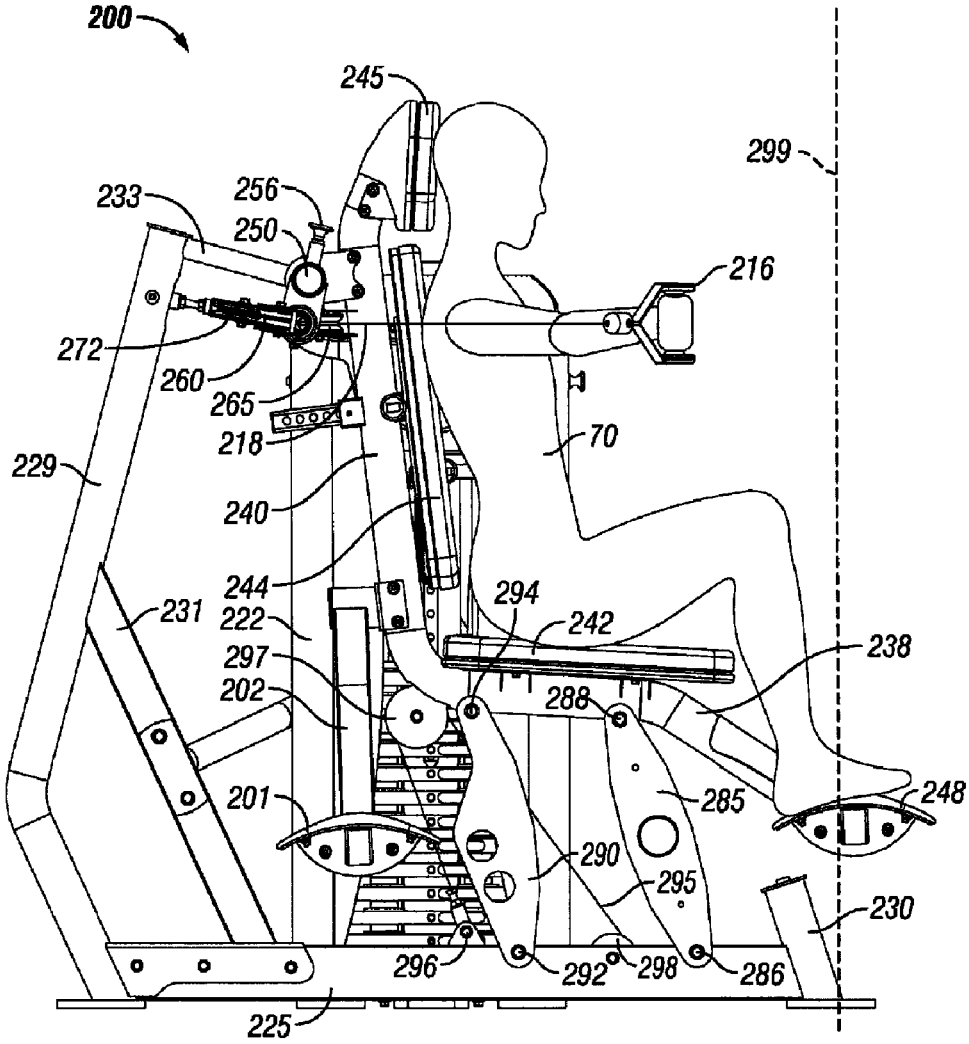
FIG. 21 is a side elevation view similar to FIG. 20 but illustrating the end of a pec fly exercise.

As best illustrated in FIGS. 20 and 21, the user support frame 214 is linked to the weight stack 220 by a cable and pulley assembly including a cable or line 295 secured to an anchor 296 at one end which is secured to the base 225 of the main frame at a location spaced rearwardly from the four bar pivot assembly 215. One or more cables 295 extend from the anchor around a pulley 297 on the underside of base portion 238 of the user support frame, around a pulley 298 on base strut 225 of the stationary frame, and then around a series of pulleys (not visible in the drawings) in base strut or tube 225 and guide tube 232 to the weight stack housing 222. The cable then extends around additional pulleys (not visible in the drawings) as needed to an anchor at the top of the weight stack 220. The cable and pulley linkage may include one or more cables in the path from anchor 296 to the top of the weight stack.

The user engagement device of this embodiment can be adjusted in order to perform two different exercises in different modes of operation involving different and distinct muscles. When a user wishes to perform a selected pec fly exercise in a first mode of operation, the pad 244 is located in the back rest position of FIGS. 17 to 21, resting against the rear upright 240 of the user support frame, and the sleeves 252 on cross tube 250 which carry the swiveling pulleys 265 are located in the outermost position. This position may be varied slightly for users having different length arms. The user 70 sits on the user support with their back against back pad 244 and their feet resting on foot rest or foot plates 248, with the user support frame in the start position of FIG. 20. In the start position of FIGS. 17 to 20, the back pad or back rest 244 is reclined slightly rearwards and the connecting post 289 between pivoted link plates 285 of the four bar pivot assembly engages the stand off post 230. The user then grips the handles 216 and moves their hands and arms into a pec fly start position as illustrated in FIG. 20. In the start position, the arms are extended out to the side with the elbow bent rearwards and the hands gripping the handles just below the shoulders. The user then pushes their hands forward and inward in an arcuate path, finishing with the handles side by side and spaced forward from the chest, as seen in FIG. 21. The hands can be kept at the same general elevation relative to the user's body in order to simulate a straight fly exercise, with the handles ending in the finish position of FIG. 21. The user can also choose to finish the exercise with their hands at different elevations, in order to perform different types of pec fly exercises, such as incline fly and decline fly exercises.

As the hands are extended forward and inward, pulling on cable 218, the user support frame is pulled rearward and rocked forward about a theoretical pivot axis by the four bar pivot linkage 215. As explained in Provisional Application No. 61/059,035 referenced above, the contents of which are incorporated herein by reference, the vertical gravitational center line 299 extends through the theoretical pivot axis of the pivotal movement produced by the four bar pivot assembly. The user finishes the exercise in a slightly forwardly inclined orientation, due to the swiveling pulleys which link cable 218 to the user support frame and to the main frame. In the finish position of FIG. 21, the rear cross tube 250 rests against the stop or stand-off 233 at the top of rear upright 229. At the same time, the base 238 of the user support frame is lifted upward, pulling the cable 295 of cable and pulley linkage against the resistance supplied by weight stack 220. The weight stack may be replaced by other types of exercise resistance in alternative embodiments, such as weight plates mounted on the user support frame.

Because the user support moves in conjunction with the user engaging handles, the arcuate path of the user's hands relative to the user support is reduced, resulting in a more natural feeling exercise movement which more accurately replicates the movement found in the corresponding free weight pec fly exercise. Handles of other dimensions may be used in alternative embodiments and the distance moved by the user's hands may vary in other embodiments based on the user's arm length.

Figure 23:
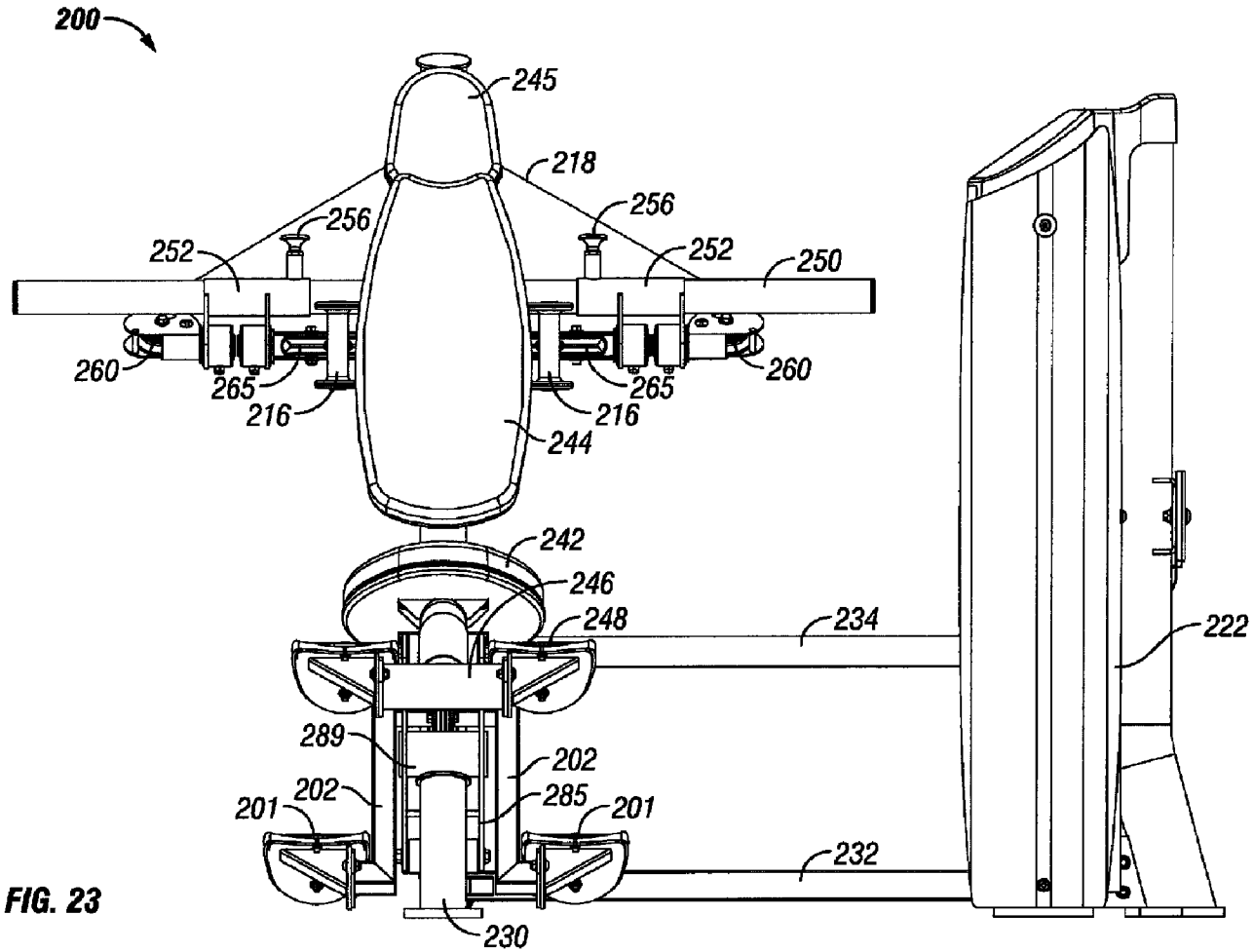
FIG. 23 is a front elevation view of the machine with the user engagement device in the position of FIG. 22.
Figure 24:
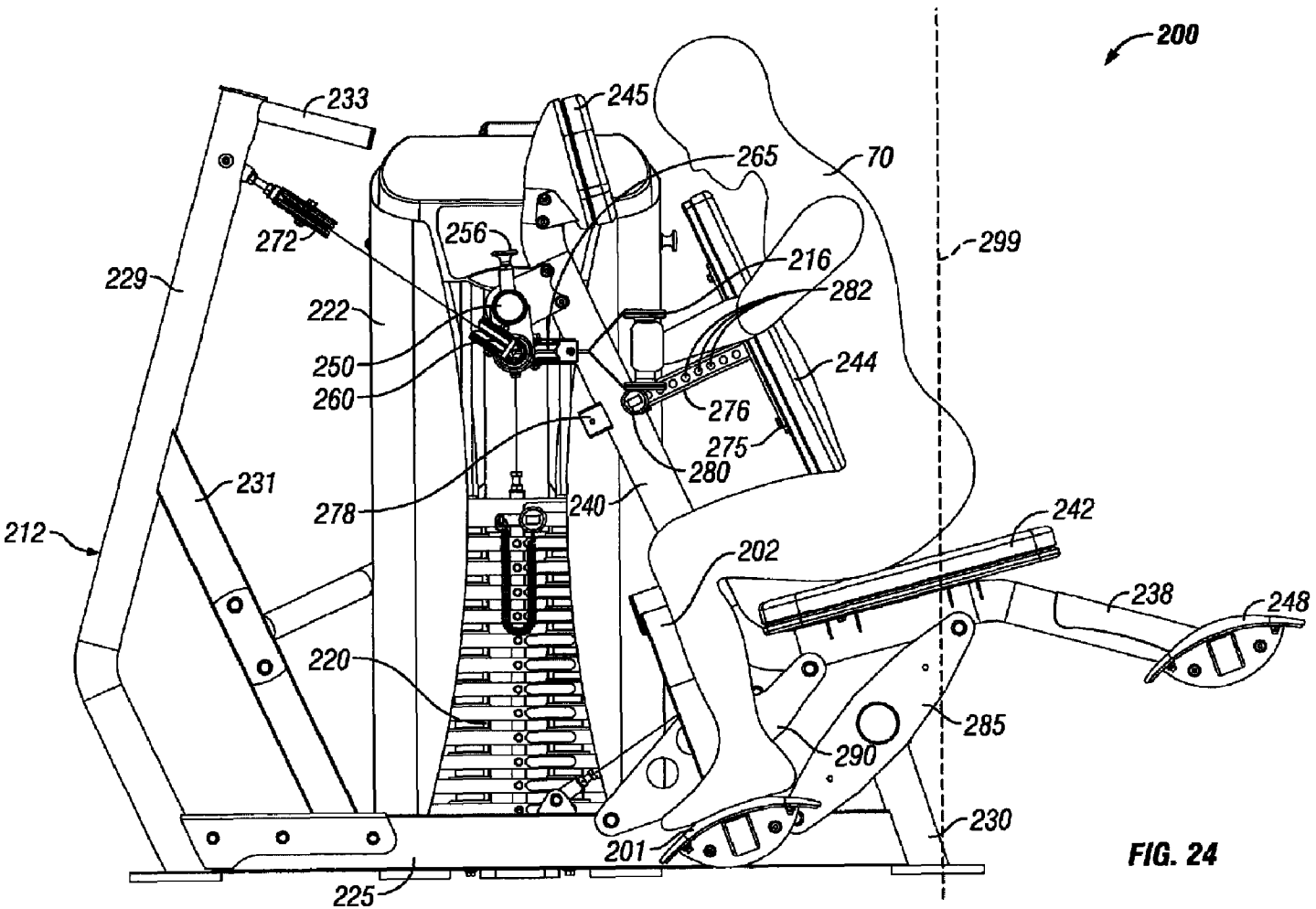
FIG. 24 is a side elevation view of the machine in the position of FIG. 21 but with a user positioned on the machine in the start position for a rear deltoid exercise.
Figure 25:
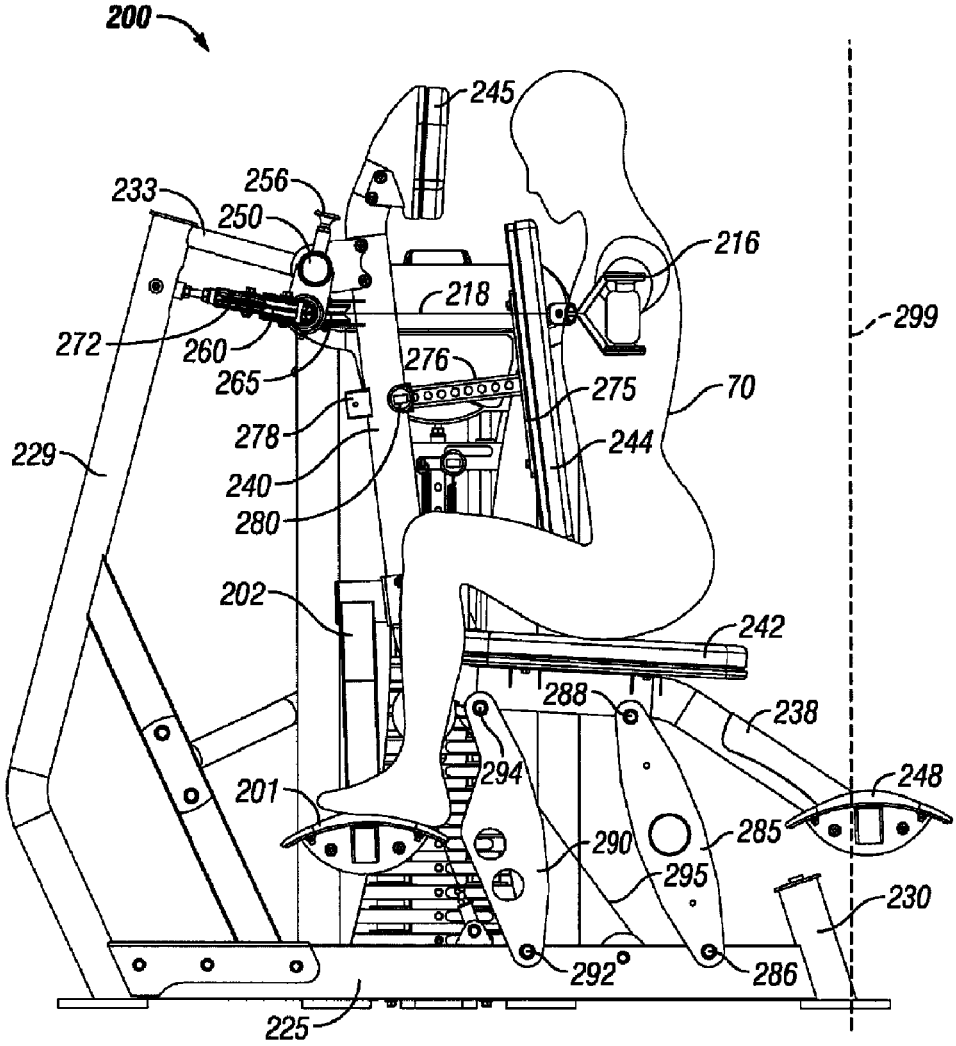
FIG. 25 is a side elevation view similar to FIG. 24 with the user in position, but illustrating the end position of the exercise.

FIGS. 22 to 25 illustrate the machine 200 adjusted for performing a rear deltoid exercise in a second mode of operation of the machine. When the user wishes to perform a rear deltoid or upper back exercise instead of a pectoral or chest exercise, the upper body pad 244 is adjusted outward, away from the user support upright 240 and the swiveling pulleys. This is done by releasing the pull pin 280 from the aligned opening in adjustment post 276, then pulling the pad 244 outwardly into the desired position before releasing the pull pin to engage in the newly aligned opening 282. The pad is shown in an adjusted position for performing a rear deltoid exercise in FIGS. 22 to 25, and in this position it acts as a chest pad which engages the chest of a user sitting on seat pad 242 in a rear facing position, as illustrated in FIGS. 24 and 25.

Figure 22:
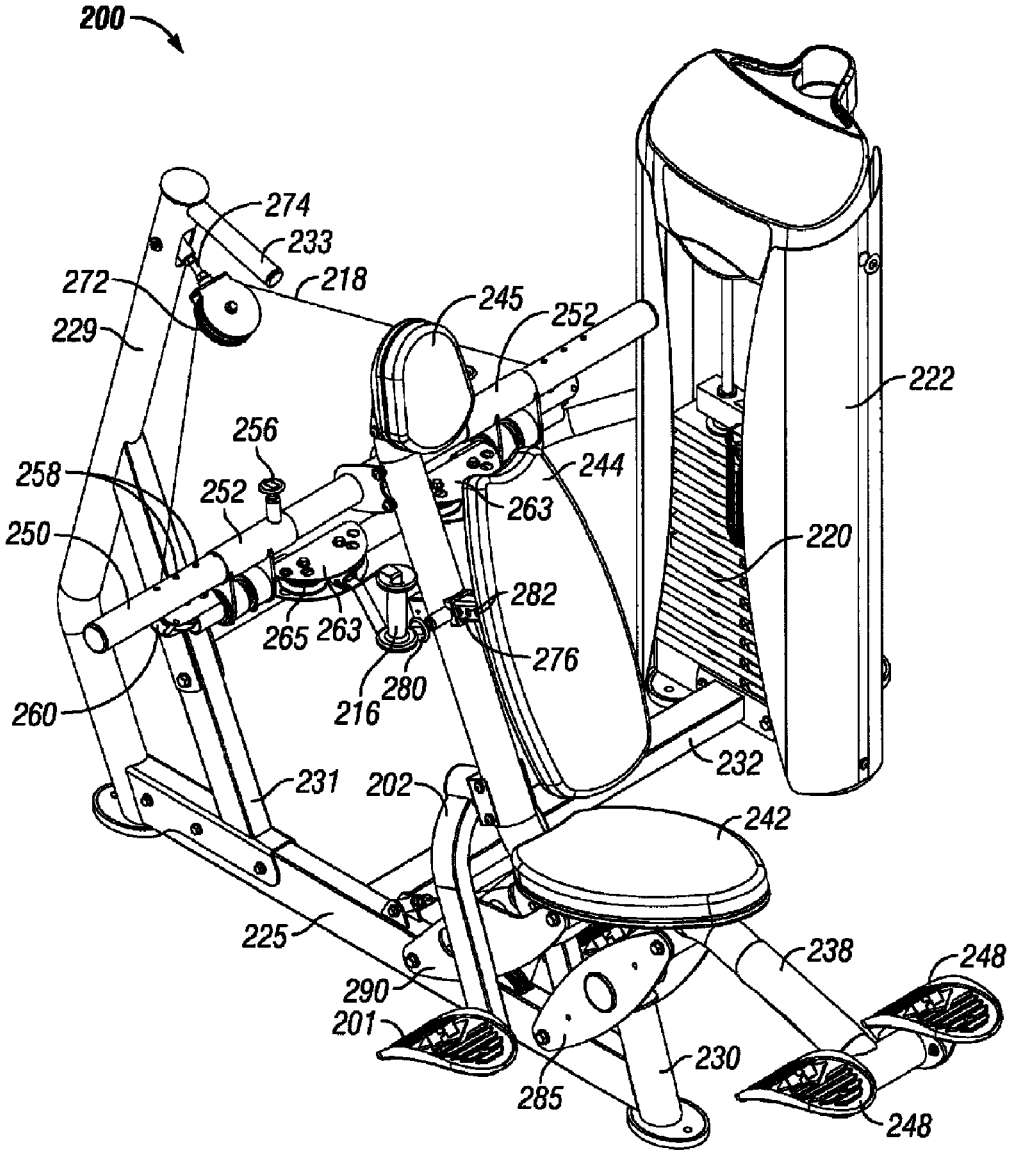
FIG. 22 is a perspective view of the machine of FIGS. 17 to 21, similar to the position of FIG. 17 but with the user engagement device adjusted into a start position for a rear deltoid exercise.

The positions of the swiveling pulleys on cross bar 250 are also adjusted inwardly, as best illustrated in FIGS. 22 and 23, bringing the handles in closer to the chest pad 244. This is done by releasing each of the pull pins 256 from the aligned openings, sliding the sleeves 252 inwardly towards one another along bar 250 until the desired position is reached, then releasing the pull pins 256 to engage in the aligned openings 258 in cross bar 250. This places the handles 216 in a convenient position for performing a deltoid exercise, spaced to the rear of chest pad 244 and on opposite sides of the chest pad, as seen in FIGS. 22 and 23.

As illustrated in FIG. 24, at the start of a deltoid exercise, the user 70 sits on seat pad 242 facing rearwards, with their feet engaging foot plates 201 and their chest engaging the chest pad 244. They then grip the two handles 216 with their arms bent and extending generally forward from their chest. This position is similar to the start position of a free standing rear deltoid exercise. In the start position, the seat pad is in a slightly downwardly inclined orientation, at the same inclination as the start position of FIG. 20 for a pec fly exercise. Starting in the position of FIG. 24, the user pulls the handles 216 towards their body and outward, ending in the position of FIG. 25 with their arms slightly bent and extending out from their sides, slightly below shoulder height. This is similar to the end position of a free standing rear deltoid exercise. The seat pad 242 travels through the horizontal position to a slightly downward inclination, similar to the end position for the pec fly exercise. Since the user is facing in the opposite direction for the deltoid press exercise, they start at a slight downward inclination and finish at a slightly rearward reclining position, which is the reverse of the pec fly user start and finish inclinations.

The user is in three different positions during the exercise, starting in a downwardly inclined position, and traveling through a straight, upright position into an end position in which they are reclined rearwards, as seen in FIG. 25. As with the chest or pec fly exercise, the movement of the user support frame also pulls the user support frame upwardly against the exercise resistance.

FIGS. 24 and 25 illustrate the position of the gravitational center line 299 of the pivotal movement of the user support frame. In the start position of FIG. 24, the gravitational center line passes through the user support frame at the seat pad 242, and through a rear part of the user's body. In the end position, the user and most of the user support frame are located on one side of the gravitational center line. The user's position on pad 242 can be adjusted horizontally by varying the horizontal spacing between upright 240 and pad 244. This adjustment changes the location where the gravitational center line in FIG. 24 passes through the user's body, so that more or less of the user's body is positioned in front of the gravitational center line in the start position.

A user performing rear deltoid exercises can control the travel path of the handles 216 due to the flexible line 218 which links the handles to the user support frame and main frame via the swiveling pulleys. The user can also opt to pull only one handle at a time. In this case, the travel of the user support frame is reduced since only one length of cable is pulled, rather than two. The end position of the user support frame is therefore not as close to the rear upright when only one handle is pulled. The user can repeat this exercise alternately with the right and left hands, if desired. In the illustrated rear deltoid exercise, the handles or handle are kept at the same general elevation relative to the user's body throughout the exercise, simulating a straight deltoid exercise.

Instead of keeping the handles at the same general elevation relative to the body during an exercise, as in the rear deltoid exercise of FIGS. 24 and 25, the user may choose to pull the handles in an upward or downward path, finishing the exercise with their hands at a lower or higher elevation. This simulates decline or incline deltoid exercises.

The user engagement device is multi-functional, and can be adjusted between the first and second modes of operation so as to allow a user to selectively perform either a chest exercise in order to exercise the chest muscles, or a rear deltoid exercise to exercise the upper back muscles. When performing either exercise, the user may opt to move one handle or both handles simultaneously in a level, upward, or downward path, as described in more detail in Application No. 61/059,035 referenced above. The exercise machine with a flexible line linkage to the user engaging handles allows the user to determine the start and finish position for an exercise, whether pec fly or rear deltoid.

FIGS. 26 to 33 illustrate an exercise machine 350 according to another embodiment which has a multi-function leg exercise arm 390 which has two modes of operation, and may be used to perform leg extension exercises which exercise the quadriceps muscles in a first mode of operation or leg curl exercises which exercise the hamstring muscles in a second mode of operation. Exercise machine 350 is identical to a machine described in co-pending application Ser. No. 11/846,472 referenced above, the contents of which are incorporated herein by reference. Machine 350 utilizes an adjustable bi-directional exercise arm assembly to provide resistance for both exercise movements. Machine 350 has a main frame on which a user support 358 is pivotally mounted, and a multi-functional leg exercise arm assembly 390 is pivotally mounted at a forward end of the user support. In this embodiment, movement of the leg exercise arm is linked to movement of the user support by means of a cable and pulley linkage, as explained in more detail below. The leg exercise arm assembly can be adjusted to perform either leg extension exercise or leg curl exercise which exercise different muscles of the leg.

The main frame of machine 350 has a base section or tube 352 with end supports or feet 353 for engaging the floor and an inclined upright tube 354 located approximately at a mid position on the base section. A pivot mount or pivot bracket 355 is located approximate the top end of upright tube 354. A short upright post 357 is located at a forward end of base section 352. A transverse guide tube 356 for connecting to a selectorized weight stack (not illustrated) extends from the base section 352.

Figure 27:
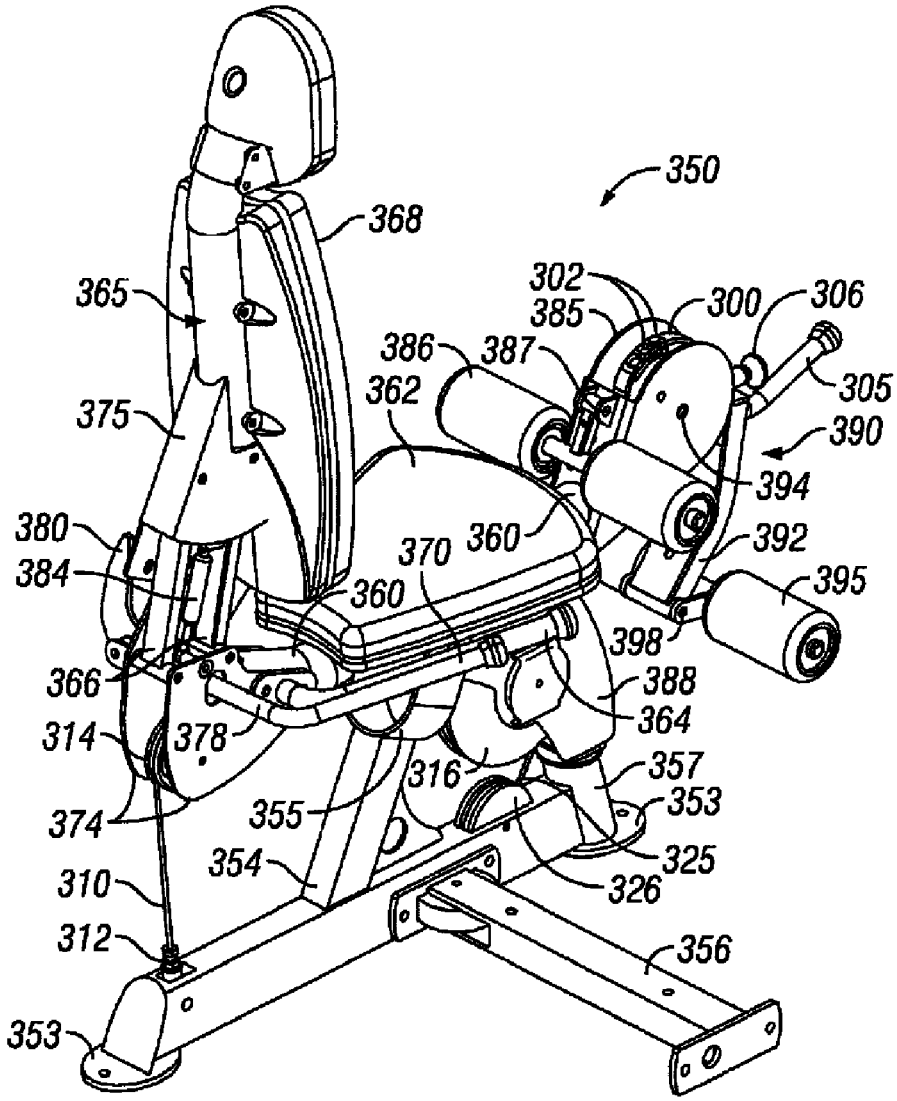
FIG. 27 is a rear perspective view of the machine of FIG. 26.
Figure 28:
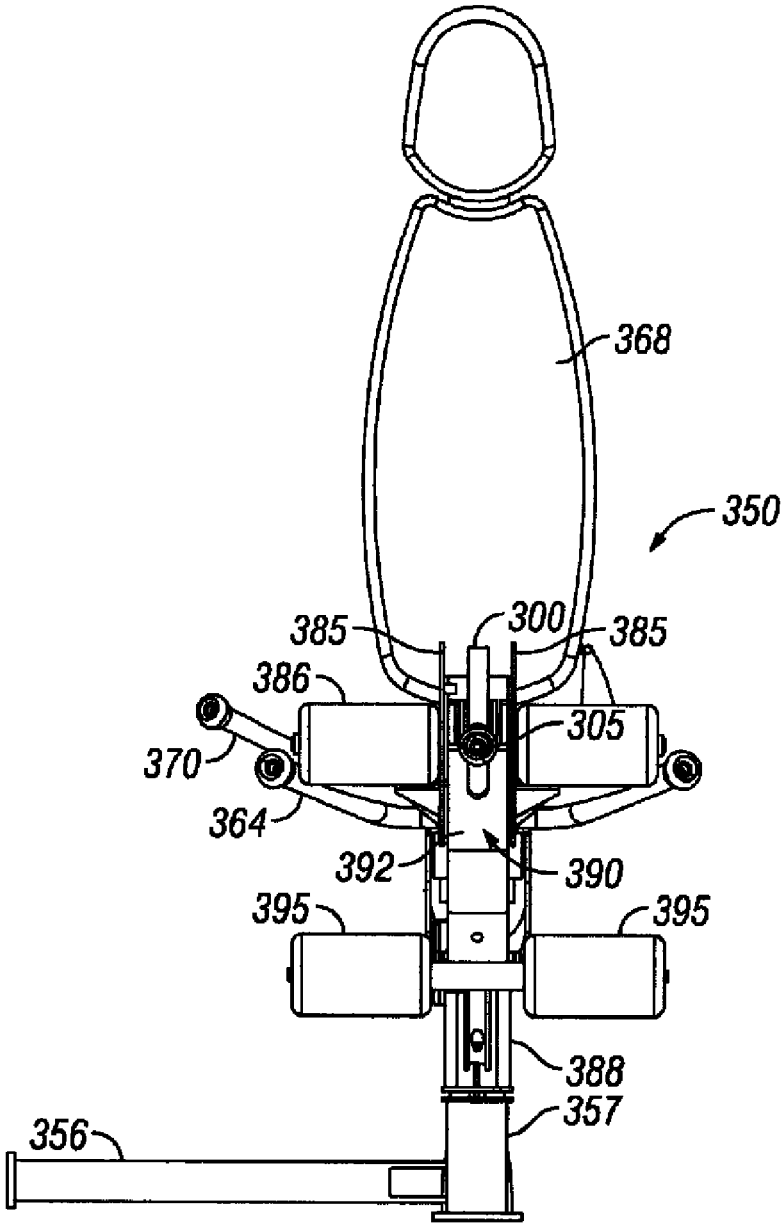
FIG. 28 is a front elevation view of the machine of FIGS. 26 and 27.
Figure 29:
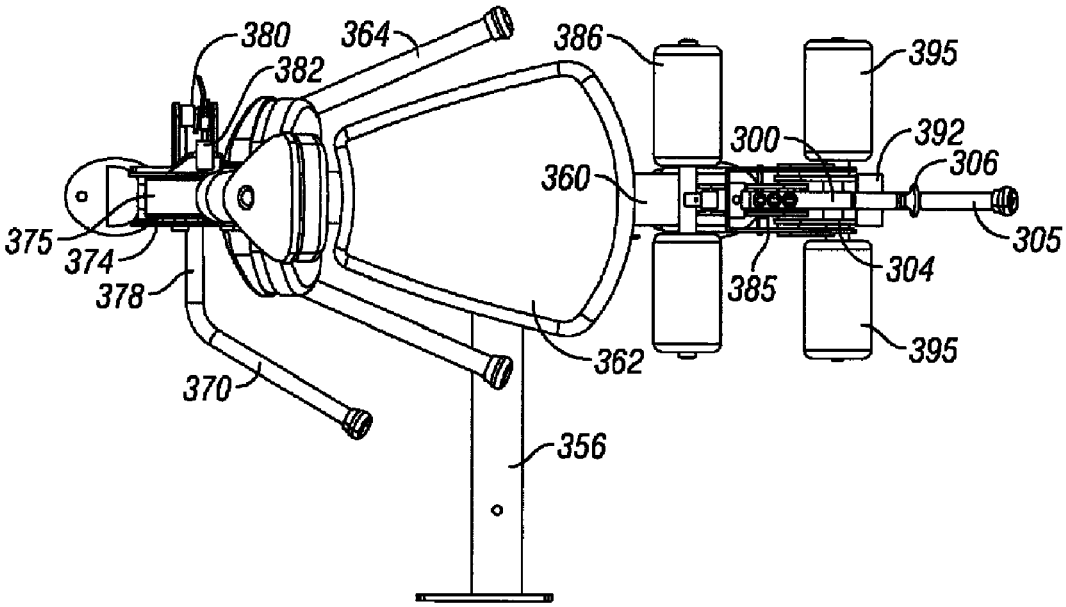
FIG. 29 is a top plan view of the machine of FIGS. 26 to 28.

The user support 358 is similar to that of the previous embodiments and has a seat frame having a seat support tube or base 360 with a seat pad 362 supported on top of the tube, and support handles 364 fixedly attached on opposite sides of the tube extending on opposite sides of the seat pad 362. A back rest frame 365 is adjustably mounted at the rear end of the seat support tube 360 via a four bar pivoting linkage system having a pair of linkage bars 366, as illustrated in FIG. 27. Back pad 368 is mounted in front of the back rest frame 365.

The adjustable mounting of the back rest frame allows adjustment of the back pad orientation and position for various size users. Adjustment handle 370 allows the user to adjust the back pad orientation via a range-of-motion (ROM) adjuster mechanism between the seat frame and back rest frame. ROM adjuster mechanism is illustrated in FIG. 27 and includes a pair of adjuster brackets 374 secured to the rear end of the seat support tube 360 and a ROM adjuster housing 375 at the lower end of back rest frame 365. Linkage bars 366 are pivotally secured between adjuster brackets 374 at their lower ends and between opposite sides of housing 375 at their upper ends. A range-of-motion adjuster plate 376 is fixedly attached to one face of the adjuster housing (see FIG. 26). Adjustment handle 370 has a bent shaft 378 (FIG. 27) extending through a hole in one of the adjuster brackets 374 and is pivotally mounted to the other adjuster bracket. The shaft 378 is linked via a pull pin linkage 380 to a pull pin 382 mounted on the ROM adjuster plate 376. The pull pin 382 engages with an aligned hole in the range-of-motion plate 376 mounted on the ROM adjuster housing to provide positioning adjustment for the back pad to accommodate various size users. Release of the pull pin by pulling up on handle 370 allows the angle of the back rest to be adjusted. The handle is released when the desired orientation is reached, and the pull pin then springs back into an aligned ROM plate opening. A gas-assist return shock device 384 extends between adjuster bracket 374 and the adjuster housing to return the back rest to a forward position when released.

Figure 30:
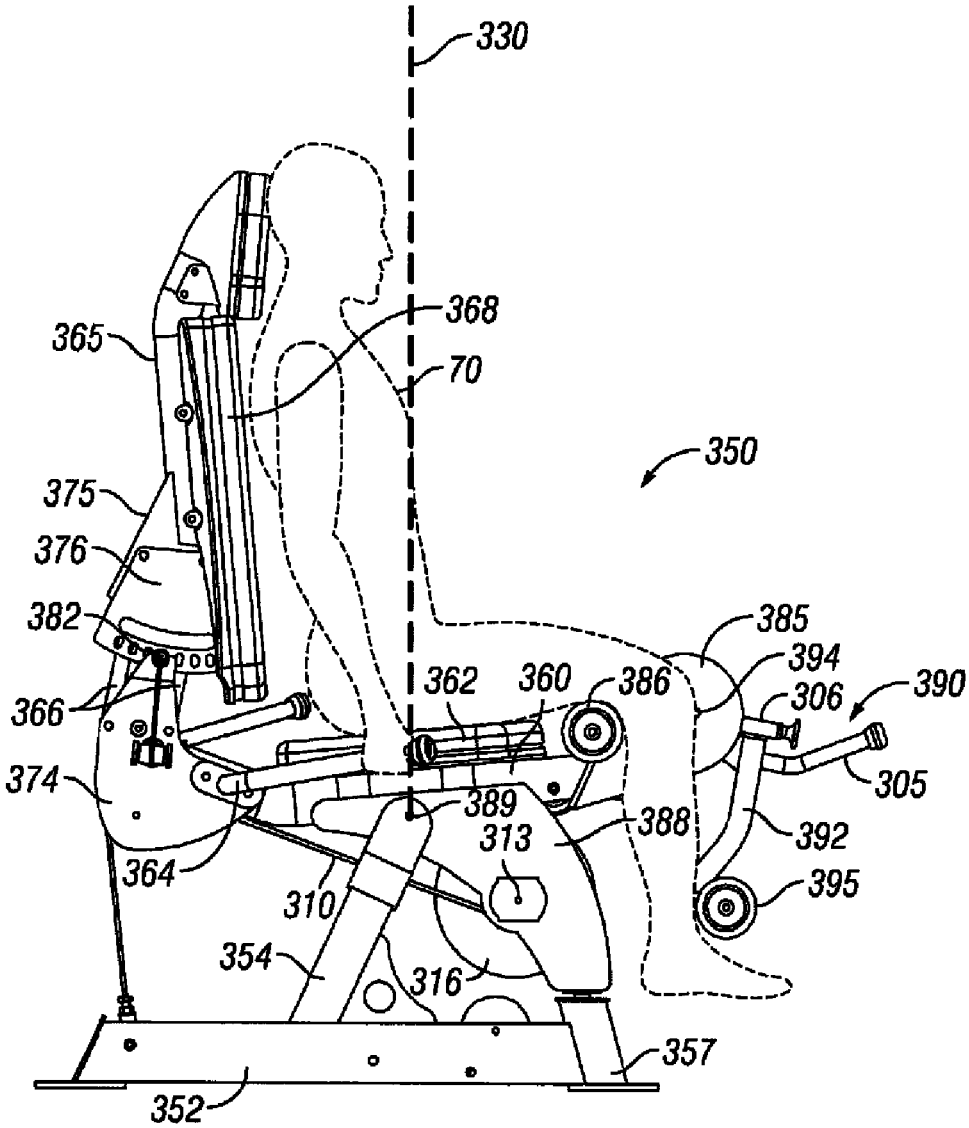
FIG. 30 is a side elevation view illustrating the machine of FIGS. 26 to 29 in a start position for a leg extension exercise, with a user seated on the machine and ready to perform the exercise.
Figure 31:
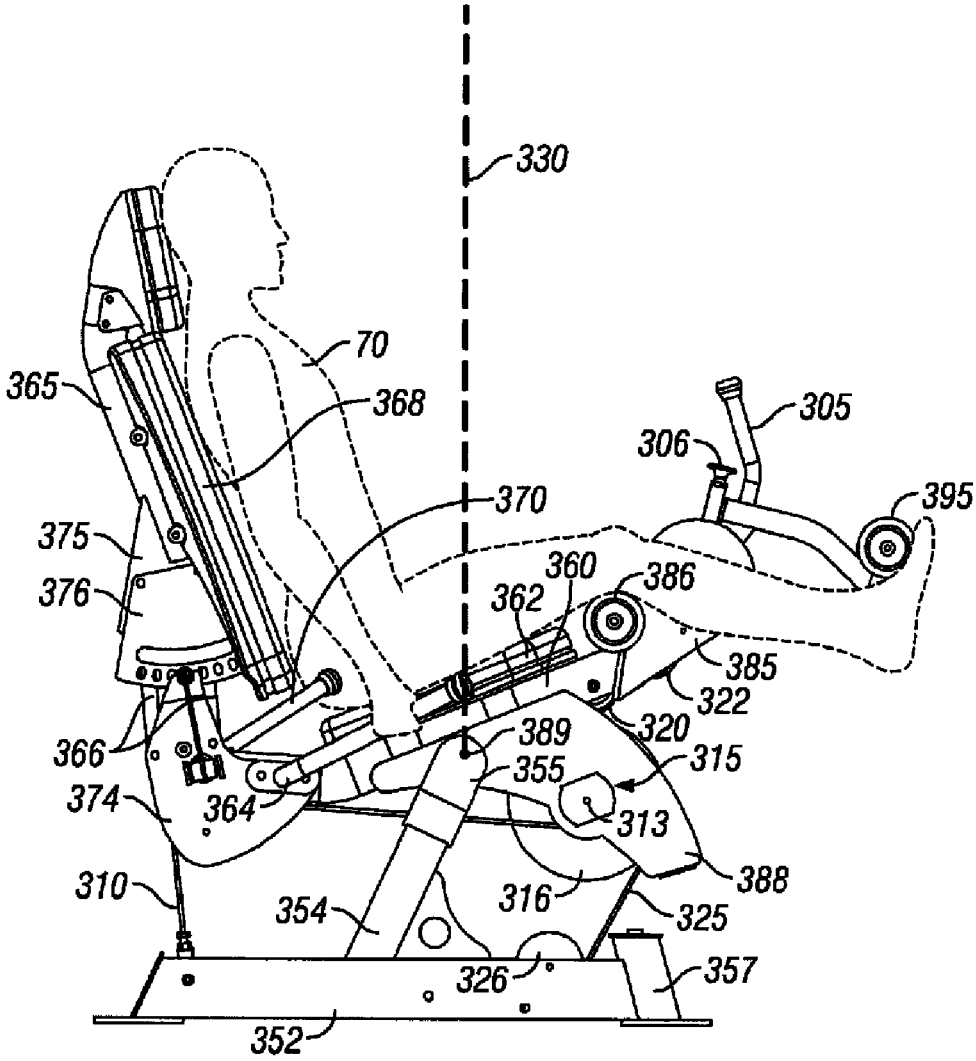
FIG. 31 is a side elevation view similar to FIG. 30 but illustrating a finish position for the leg extension exercise.
Figure 32:
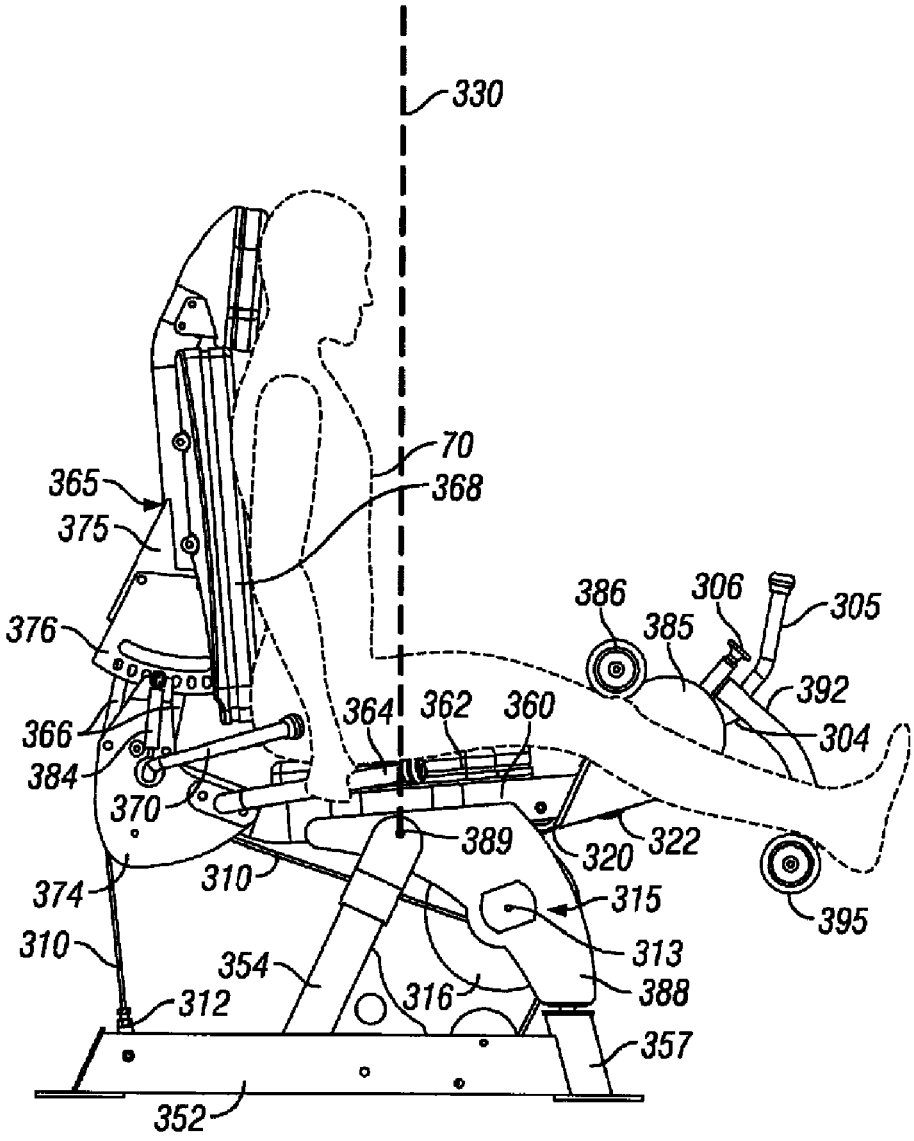
FIG. 32 is a side elevation view illustrating the machine of FIGS. 26 to 29 in a start position for a leg curl exercise, with a user seated on the machine and ready to perform the exercise.
Figure 33:
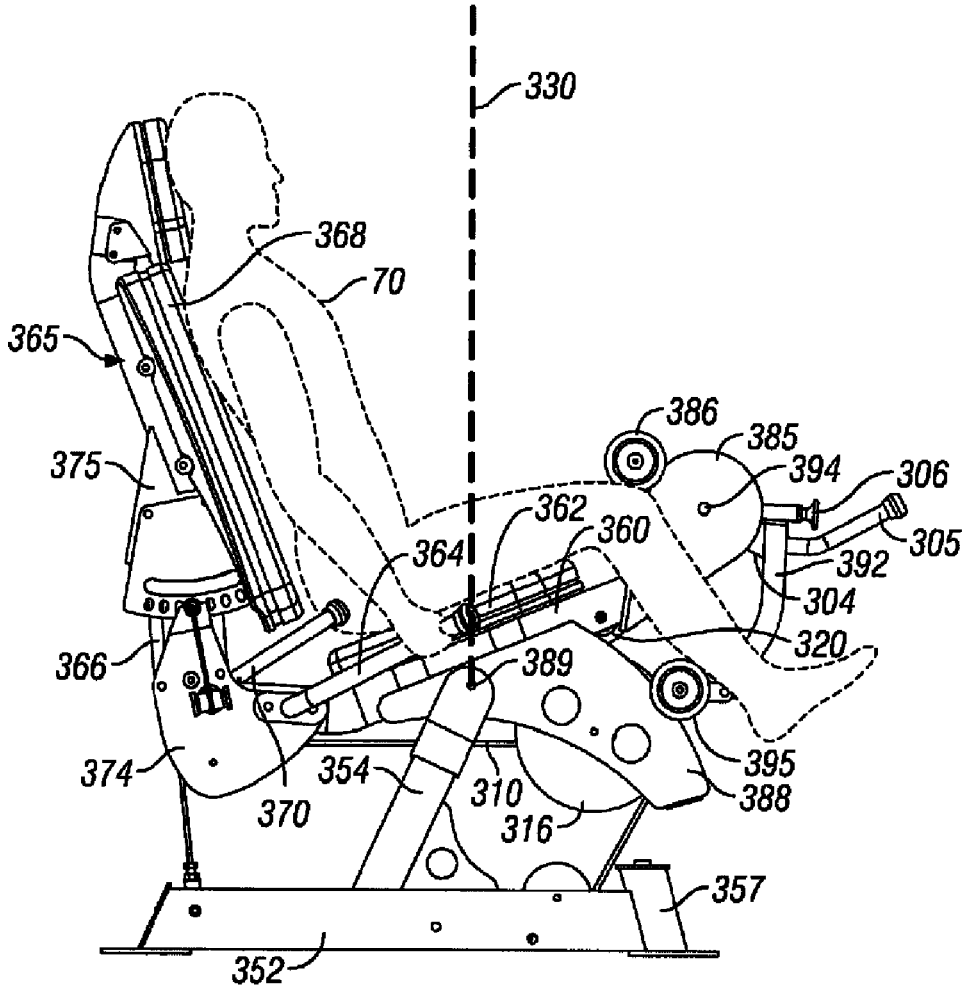
FIG. 33 is a side elevation view similar to FIG. 32 but illustrating a finish position for the leg curl exercise.

The adjuster handle 370 and associated structure may be custom designed for either left or right handed users, as illustrated in the drawings. In FIGS. 26 to 29 and 32, handle 370 is on the right hand side of the seat for convenient use by right hand users, while FIGS. 30, 31, and 33 illustrate a variation in which handle 370 is on the left hand side of the seat for left hand users, and the remainder of the adjustment mechanism on the rear of the seat is similarly reversed. The exercise machine in these figures is otherwise identical to that of FIGS. 26 to 29 and 32.

U-shaped pivot bracket 385 is attached approximate the forward end of the seat support tube 360, and a pair of thigh brace pads or rollers 386 are pivotally attached to the rear side of pivot bracket 385. A pair of large mounting plates 388 is mounted on the underside of seat support tube 360. The seat support tube 360 is pivotally attached to main frame pivot mount 355 for rotation about user support pivot axis 389, the user support pivot mount being housed between mounting plates 388 (see FIG. 30). Mounting plates 388 engage a bumper pad on the end of post 357 on the main frame in the rest or exercise start position, as illustrated in FIGS. 27, 30 and 32.

Figure 26:
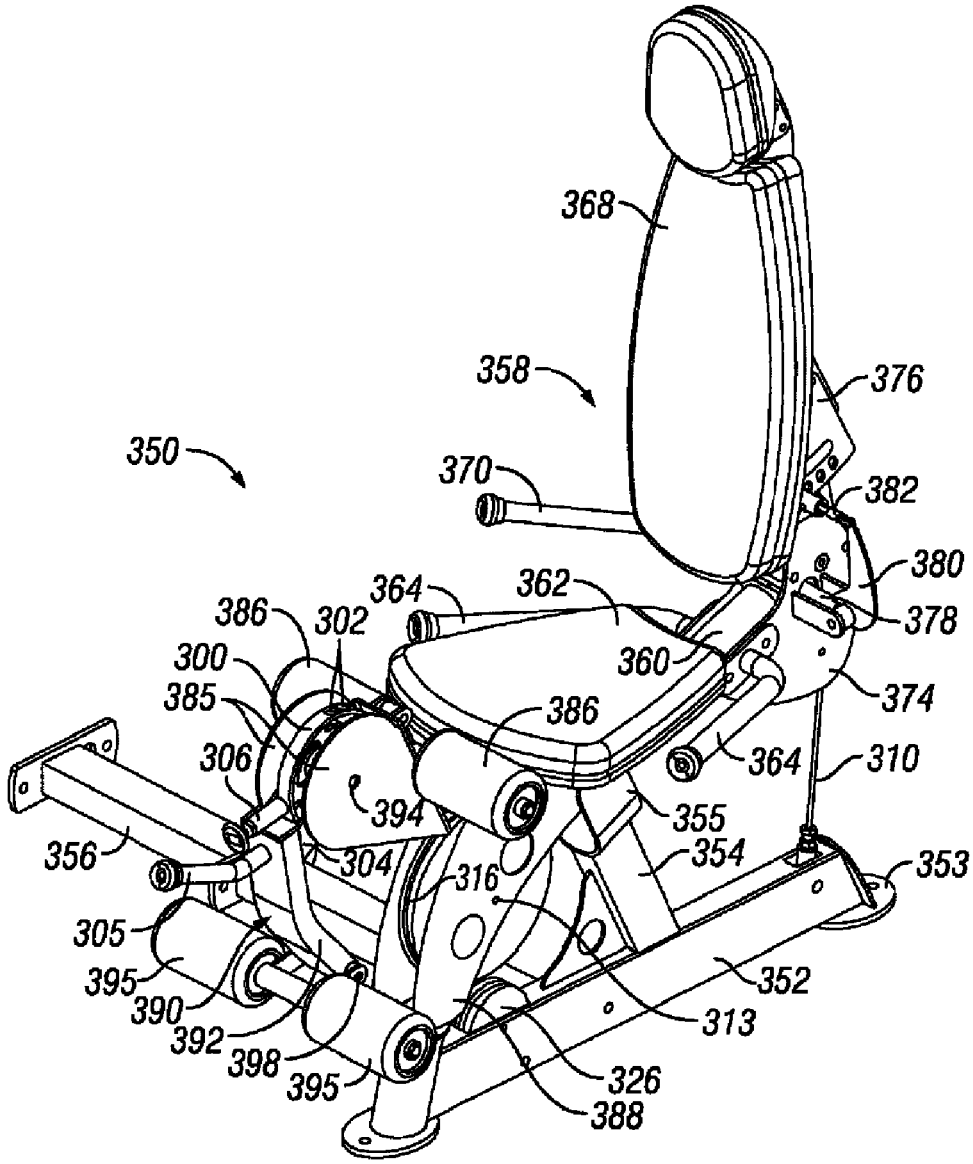
FIG. 26 is a front perspective view of another embodiment of an exercise machine having a combination or multi-function leg extension/leg curl exercise arm.

The exercise arm assembly 390 comprises a main tube 392 which is pivotally mounted at one end between pivot brackets 385 for rotation about pivot axis 394, and user engaging rollers or pads 395 pivotally mounted approximate the other end of tube 392 for rotation about pivot axis 398 (see FIGS. 26 and 27). The pivotal connection between the user engaging rollers and the main tube 392 enables the user engaging device to self-align to the user during the exercise and automatically adjust to the user's leg length.

A range-of-motion adjuster for the exercise arm assembly comprises a round cam 300 pivotally mounted between the user support pivot brackets 385. Cam 300 has spaced adjustment holes 302 around its circumference, for selective engagement with a pull pin or adjuster pin 306 at the end of the main tube 392 of the exercise arm assembly. Mounting brackets 304 approximate the first end of the main tube extend between the pivot brackets 385 and are pivotally mounted on the pivot pin which extends between the brackets 385. An adjuster handle 305 is attached to the main tube opposite the mounting brackets 304. The user can grip handle 305 while pulling out pull pin 306 from the ROM cam 300 and rotate the exercise arm assembly 390 to a desired position before releasing pin 306 to engage in an aligned hole 302 in the ROM adjuster. This allows the orientation of the exercise arm to be adjusted for leg exercise or leg curl exercises.

The connecting link between the exercise arm and user support comprises a pulley and cable system having a first cable 310 attached to the base section 352 of the main frame at anchor 312, reeved around a pulley 314 mounted between the adjuster brackets 374 attached to the rear of seat support tube 360 (FIG. 27), and finally anchoring to a dual cam 315 pivotally mounted between large mounting plates 388 in front of the user support pivot mount for rotation about pivot axis 313. The dual cam 315 comprises first and second coaxially mounted cams of different diameter, with only the larger diameter cam 316 being visible in FIG. 26. The first cable is anchored to the smaller cam of the two cams, to wrap around the cam in a counter-clockwise direction. A second cable, which is not visible in the drawings, is anchored to the larger diameter cam 316 of the dual cams to wrap around the cam in a clockwise direction, and is reeved around two pulleys 320, 322 on the user support before anchoring to the range-of-motion cam 300. The first pulley 320 is mounted at the forward end of seat support tube 360, and part of this pulley can be seen in FIGS. 31 and 32. The second pulley 322 is mounted between pivot brackets 385 and a small part of this pulley is also visible in FIGS. 31 and 32. The linkage is connected to rock the user support back in the same direction regardless of the type of leg exercise performed, as explained below.

In this embodiment, exercise resistance or load is supplied by a cable and pulley system connected to a weight stack. The weight stack is not illustrated in FIGS. 26 to 33 but may be equivalent to the weight stack arrangements illustrated in the embodiment of FIGS. 17 to 25. The load supplying cable and pulley system includes a load cable 325 anchored to the large mounting plates 388 under the seat support tube 360 and extending around a pulley 326 in the base section 352 of the main frame, as illustrated in FIGS. 26 and 27. From here, the cable extends around additional pulleys and through guide tube 356 where it is linked to the weight stack in any suitable manner.

FIGS. 30 and 31 illustrate a first mode of operation with a user 70 performing a leg extension exercise on machine 350. For this exercise, the user starts with their legs bent and then extends the legs forwardly. The exercise arm must therefore be positioned in a down position for the start of this exercise, as illustrated in FIG. 30. The user moves the exercise arm into the start position by adjusting the position of the upper end of the main tube 392 in ROM adjuster cam 300 so that the exercise arm extends downward. Thigh brace pads 386 are rotated down about pivot axis 387 into their lowermost position for a leg extension exercise.

In the start position, user 70 sits on the seat with their back against the back pad, knees bent over the thigh brace pads 386, and their feet behind the leg engaging rollers 395. They may grab the support handles 364 for additional bracing if desired. They then start the exercise movement by extending their lower legs outward. This movement causes the exercise arm to pivot about pivot axis 394 at its connection to the user support, which pulls the second cable attached to the larger cam 316 of the dual cam, causing the cam to rotate and pull the first cable 310 as it wraps around the smaller cam of the dual cam. This causes the user support to pivot rearward about pivot axis 389 at its pivotal connection to the main frame. As the user support tilts rearward, lifting its front end, the load bearing cable 325 is pulled, providing resistance. FIG. 31 illustrates the finish position for a leg extension exercise. The vertical line 330 in FIGS. 30 and 31 illustrates the gravitational center line extending through the user support pivot axis 389.

FIGS. 32 and 33 illustrate a second mode of operation in which user 70 is performing a leg curl exercise on machine 350. In order to perform a leg curl exercise, the user 70 adjusts the exercise arm 390 to extend outward by pulling pull pin 306 from the aligned hole in ROM cam 300 and then pulling up on handle 305 until the exercise arm 390 is in the correct position, releasing pin 306 to extend into the aligned opening 302. The user sits on the seat pad 362 with their back against the back pad 368. The thigh brace rollers 386 are pivoted up to rest on top of the user's legs and the user's feet rest on top of the leg engaging rollers 395. The user may grab the support handles 364 for additional bracing if desired. They then start the exercise movement by curling their lower legs downward and continue to bend their legs down until the finish position is reached. This action causes the same reaction as the leg extension, pulling the cable attached to the large cam 316 of the dual cam so that the cam rotates and winds cable 310 onto the smaller cam. This in turn causes the user support to pivot back about pivot axis 389 into the reclined position of FIG. 33.

In this embodiment, a user can selectively perform either a leg extension or a leg curl exercise to work different leg muscles. In either case, the user support moves from a relatively flat start position which is at or close to horizontal into a rearward inclined finish position. As in the previous embodiments, the user support pads travel together in this embodiment, to keep the user in the same position throughout the exercise motion. The user does not have to worry about balancing on a moving platform or pad. The combined exercise arm and user support movement provides a self-aligning exercise motion that allows the user to achieve a full range of exercise motion. The user can easily switch between a leg extension and a leg curl exercise mode simply by releasing pull pin 306 from the ROM plate and rotating the exercise arm to the proper start position. Regardless of the exercise performed, the gravitational center line of the pivotal movement extends through the user and user support in both the exercise start and finish positions. The amount of weight positioned on each side of centerline 330 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user. Adjustment of the backrest orientation using the ROM adjustment mechanism also results in a variation of the amount of the user's body on each side of gravitational center line 330.

FIGS. 34 to 44 illustrate another embodiment of an exercise machine 400 which has two multi-function arm assemblies or user engagement devices 390, 402 which each have at least two different modes of operation. The first multi-function exercise arm assembly is a leg exercise arm assembly 390 which is similar to the multi-function leg exercise arm of the previous embodiment, and like reference numbers have been used for like parts as appropriate. The second multi-function exercise arm assembly 402 is suspended from a part of the main frame above the user and can be selectively used for performing chest press or mid row exercises, as described in more detail below.

Machine 400 has a stationary main frame 404, a user support 405 pivotally mounted on the frame via a pair of pivot links 406, 408 forming a four bar pivot linkage, and a connecting linkage comprising a cable and pulley assembly 409 which connects both of the multi-function exercise arm assemblies 390, 402 to the user support, so that movement of either exercise arm is translated into movement of the user support, as explained in more detail below. The multi-function, bi-directional leg exercise arm assembly 390 is pivotally mounted at the forward end of the user support 405. The multi-function exercise arm assembly 402 is suspended from an overhead portion 415 of the stationary main frame, and is adjustable between a chest press and mid row exercise position via a ROM adjustment mechanism 416 which is similar to the ROM mechanism described in U.S. Pat. No. 5,938,574, the entire contents of which are incorporated herein by reference. In addition to the multi-function exercise arms, machine 400 also has a non-ride lat pulldown exercise device 418 located at the forward end of overhead portion 415. Non-ride low pulley exercises can also be performed by a user off the user support by connecting exercise handles to the low pulley connection 420 at the forward end of base strut 422 of the main frame. A cable and pulley linkage 410 extends from both of the ride stations and user support pivot link 406 to a weight stack 412 mounted in weight stack housing 414 at the rear end of the main frame. The cables of both cable and pulley linkages 409 and 410 are omitted in FIG. 34 for clarity, but are shown in FIGS. 37 to 44.

The main frame 404 comprises base strut 422, upright strut 424, and overhead portion 415 which includes a pair of spaced mounting plates 425 between which pulleys of the cable and pulley linkage are mounted. A mid-pulley connector 426 mounted on the upright strut 424 allows a user to perform additional exercises, as described in more detail below. A sort stop post 427 on the base strut 422 below the user support provides a rest for the user support in the exercise start position. A second stop 419 on the upright strut 424 behind the user support provides a rest for the user support in the exercise end position.

Figure 43:
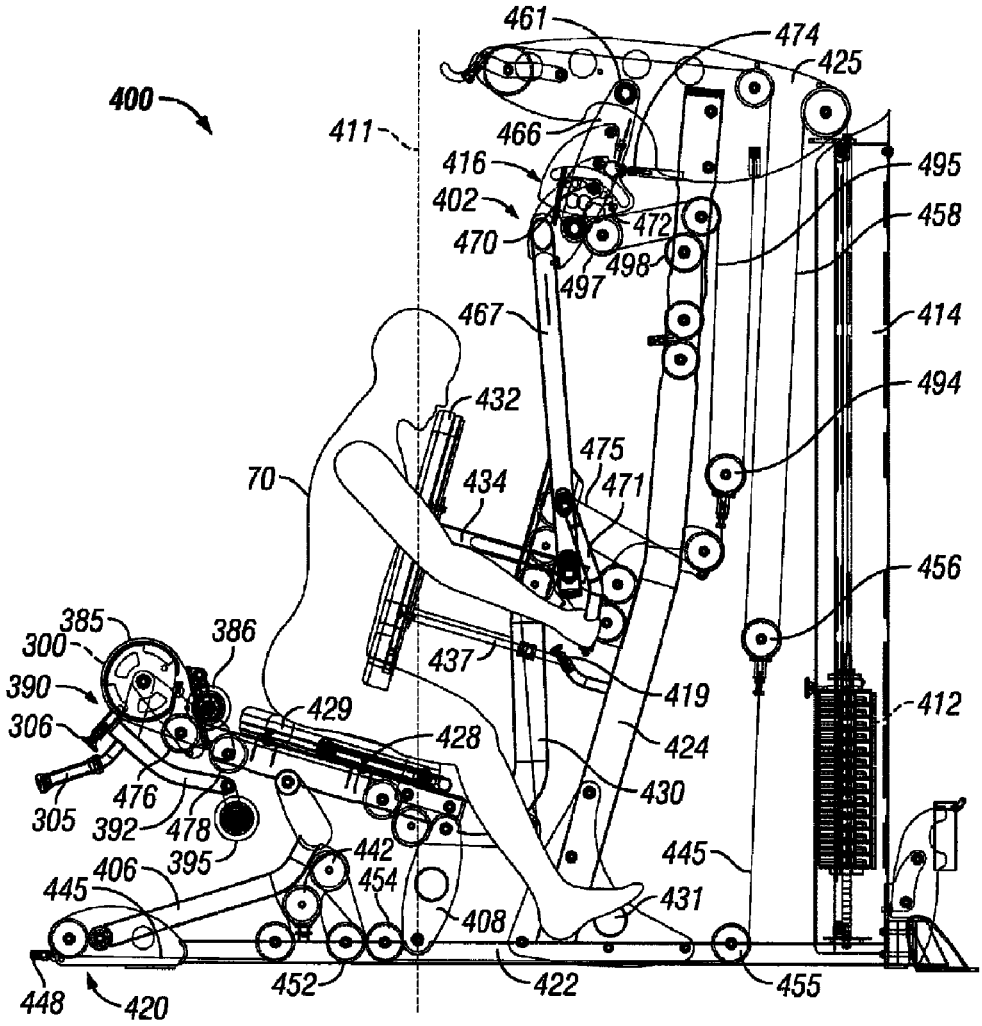
FIG. 43 is a side elevation view of the machine of FIGS. 34 to 42 with a user seated on the machine and engaging the second multi-function arm in a start position for a mid row exercise.
Figure 44:
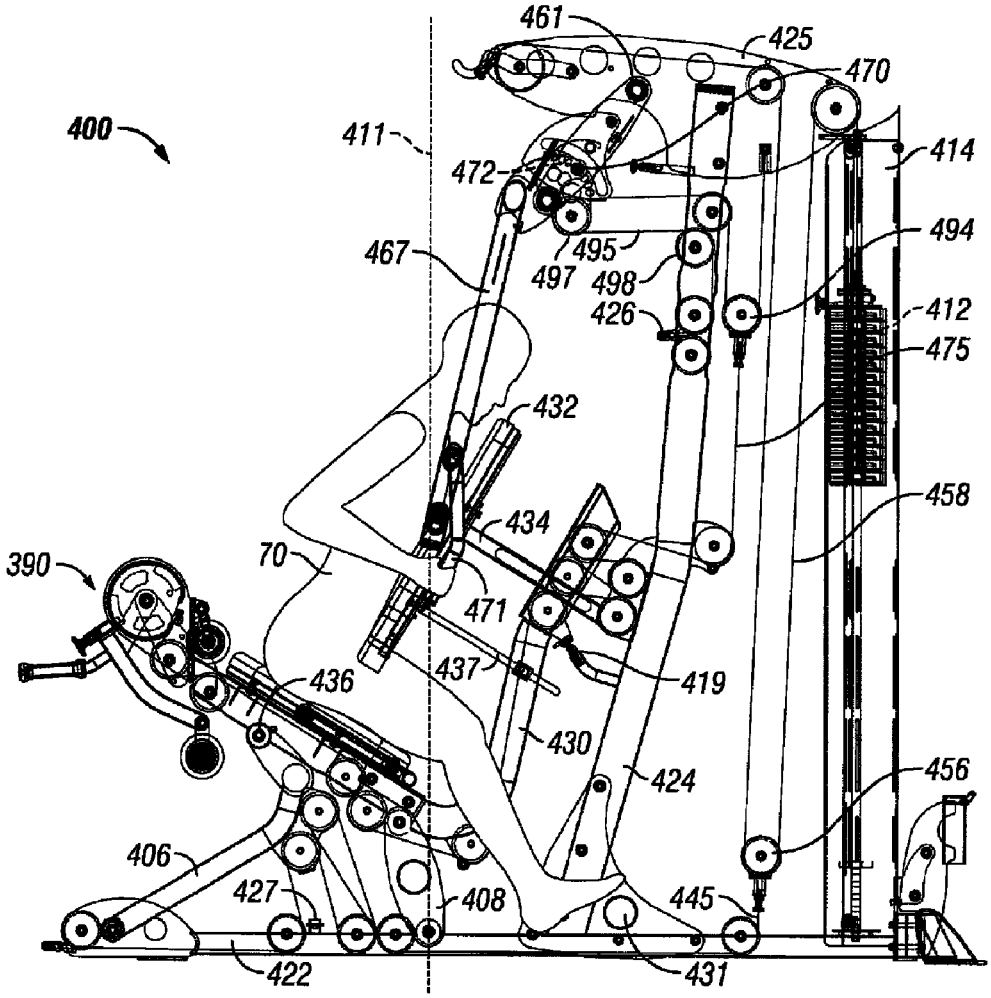
FIG. 44 is a side elevation view similar to FIG. 43 but illustrating the end position for a mid row exercise.
Figure 45:
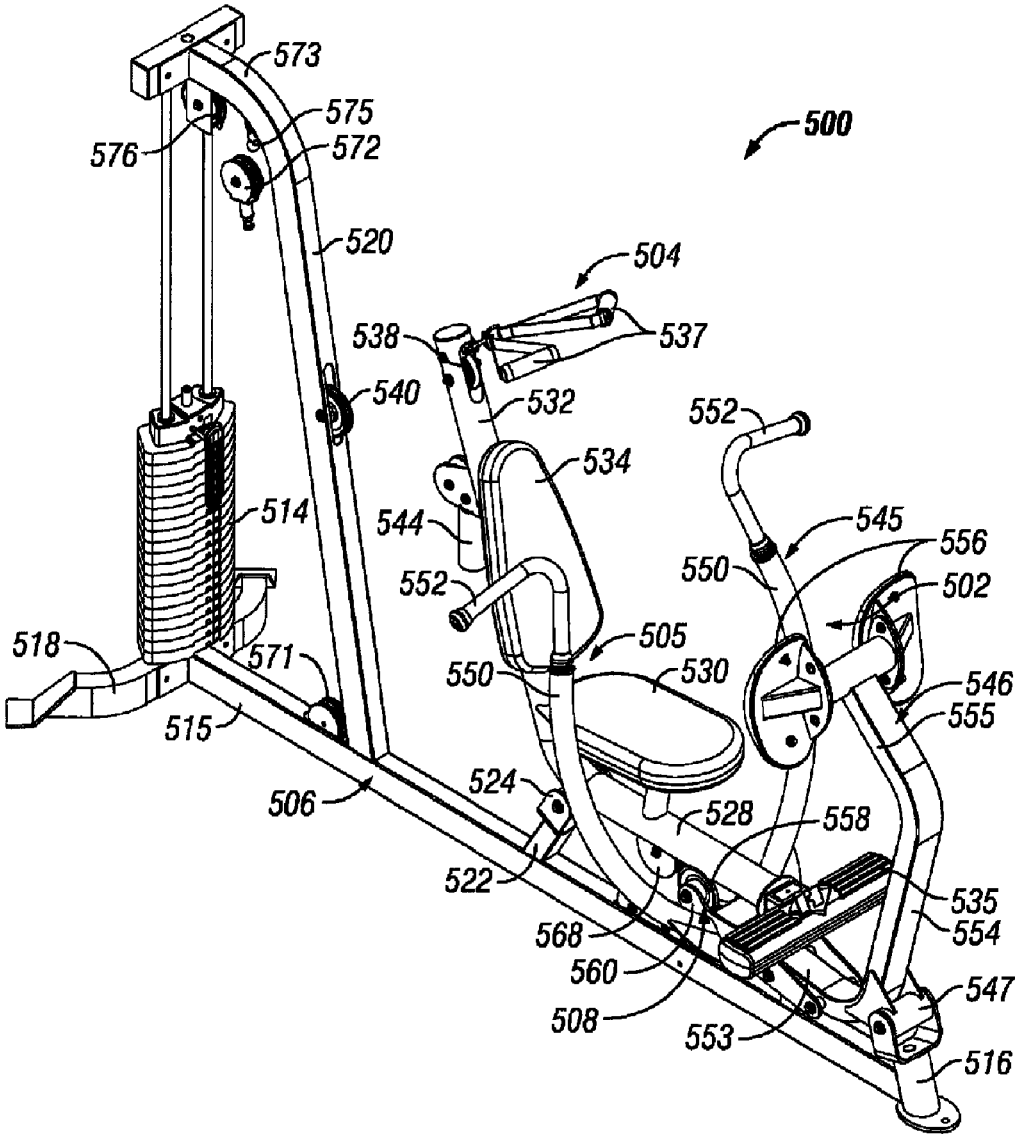
FIG. 45 is a front perspective view of another embodiment of an exercise machine with a multi-function user engagement device which can be used to perform leg press and chest press exercises, with the machine in a start position for either a leg press or a chest press exercise.

The user support frame is generally L-shaped with a base portion 428 on which a seat pad 429 is mounted, and a generally upright portion 430 on which support pad 432 is adjustably mounted. As in the embodiment of FIGS. 17 to 25, support pad 432 is adjustably mounted on the upright portion 430 of the user support frame via adjuster tube 434 extending through the upright portion 430, and can be secured in a first position as illustrated in FIGS. 36 to 42 to act as a back pad when a user 70 is performing leg exercises or chest press exercise, or in a second, extended position as illustrated in FIGS. 43 and 44 when the user is performing mid row exercises. Stabilization rod 437 extends between the pad 432 and rear upright portion 430 for additional stability in the extended position. An optional foot support peg 431 may be provided on the main frame for supporting a user's feet when performing a mid row exercise, as illustrated in FIGS. 43 and 44. Handles 433 are mounted on opposite sides of the seat for gripping by a user when performing leg exercises.

Figure 34:
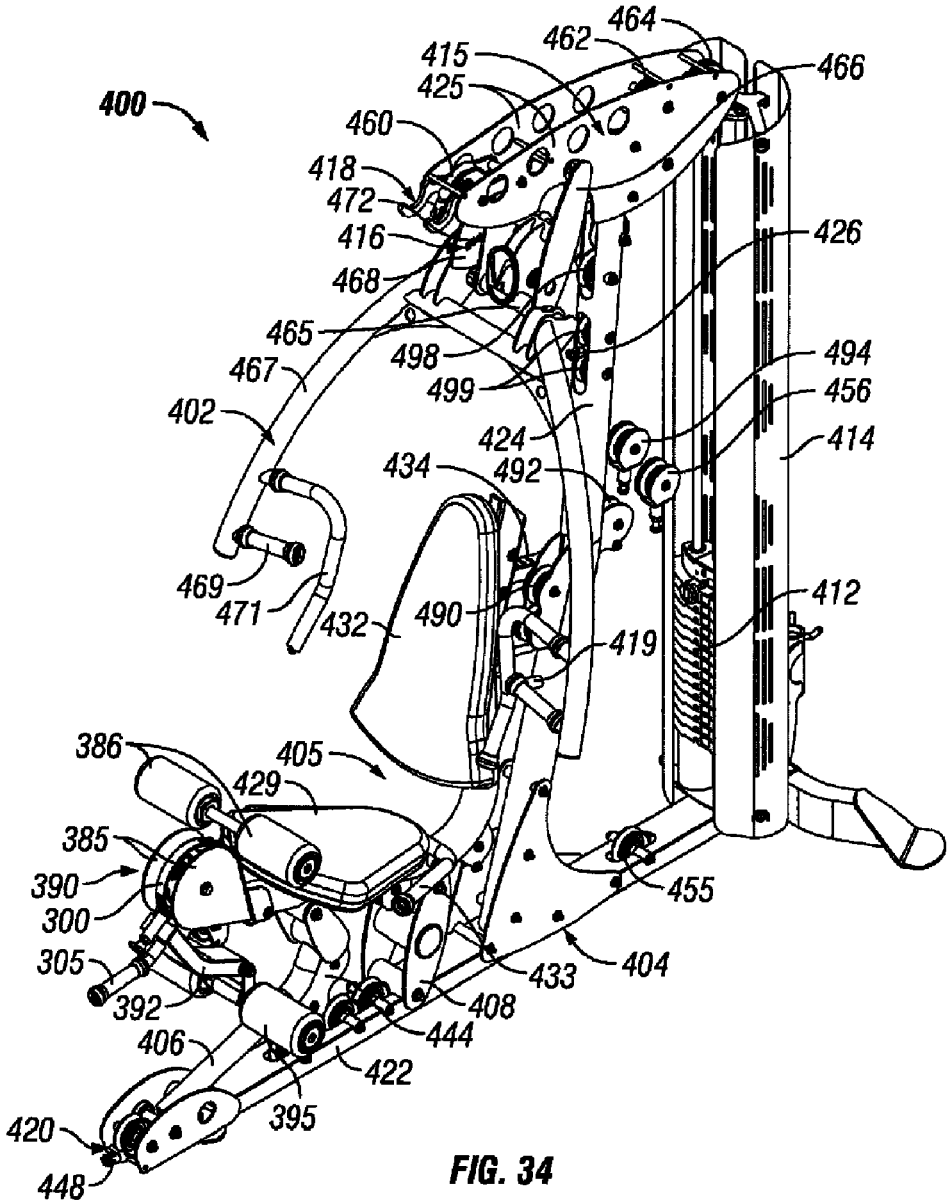
FIG. 34 is a front perspective view of a multi-function exercise machine including a multi-function leg exercise arm similar to that of FIGS. 26 to 33 and a second multi-function exercise arm for performing chest press and mid row exercise, with the leg exercise arm in a start position for a leg extension exercise.
Figure 36:
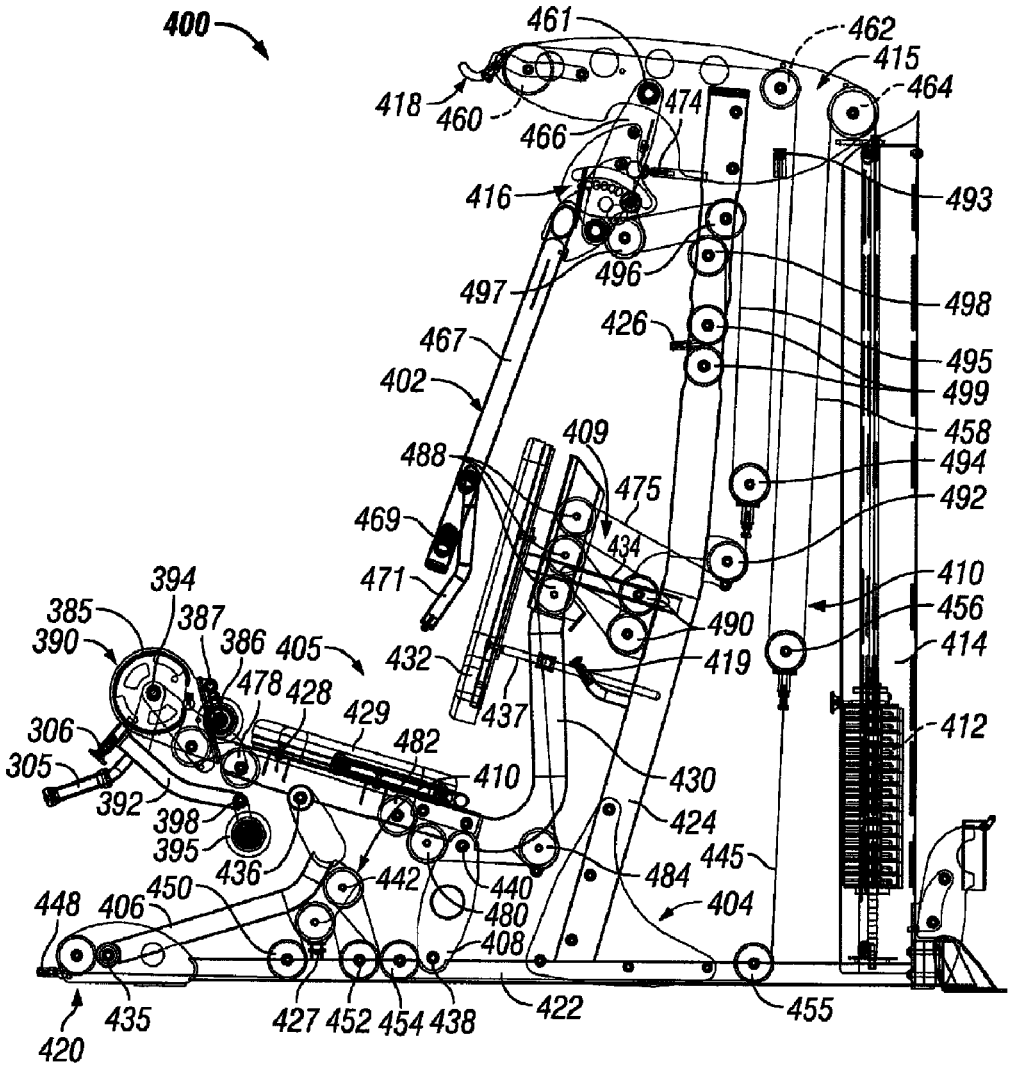
FIG. 36 is a side elevation view of the machine of FIG. 34 with the leg exercise arm in the same position, illustrating the cabling.

As noted above, user support 405 is pivotally mounted relative to the main frame by a four bar pivot assembly comprising the first pivot link 406 pivoted between the forward ends of the main frame base strut and the base portion 428 of the user support, and the second pivot link 408 which is spaced rearward of link 406 and is also pivoted between base strut 422 and the user support base portion 428. The first pivot link 406 pivots about pivot axis 435 on the base strut at one end and about pivot axis 436 on the user support base portion at the opposite end. Second pivot link 408 pivots about pivot axis 438 at its lower end and about pivot axis 440 at its upper end. A pair of pulleys 442 is mounted between mounting plates 444 on the rear side of pivot link 406, as illustrated in FIGS. 34 and 36.

The load bearing cable and pulley assembly 410 includes cable 445 which has a connector 448 at one end to which exercise handles or the like can be attached. Cable 445 extends from connector 448 around pulley 450 on the base strut, then around the first pulley of pair 442, around another pulley 452 on the base strut, then around the second pulley of pair 442 on connecting link 406. The cable 445 extends from connecting link 406 around spaced pulleys 454, 455 on the base strut 422, and extends upward from pulley 455 to anchor to floating pulley 456. A second cable 458 of the load bearing cable and pulley assembly has a first end secured to the lat pulldown exercise device or connector 418 and extends from connector 418 around high pulley 460 at the forward end of the upper frame portion 415, around a second pulley 462 in upper frame portion 415 to the rear of upright strut 424, then around the floating pulley 456 and back up around a rear pulley 464 above the weight stack before anchoring to the weight stack inside housing 414.

As noted above, the leg exercise arm assembly 390 is similar to that of the previous embodiment and like reference numbers are used as appropriate. As in the previous embodiment, a pair of thigh brace pads or rollers 386 are pivotally attached to the rear side of pivot bracket 385 at the forward end of seat pad 429. The exercise arm assembly 390 comprises a main tube 392 which is pivotally mounted at one end between pivot brackets 385 for rotation about pivot axis 394, and user engaging rollers or pads 395 are pivotally mounted approximate the other end of tube 392 for rotation about pivot axis 398. The pivotal connection between the user engaging rollers and the main tube 392 enables the user engaging device to self-align to the user during the exercise and automatically adjust to the user's leg length. Exercise arm assembly 390 includes the same range-of-motion adjuster 300, 302, 306 as in the previous embodiment, allowing the orientation of the exercise arm to be adjusted for leg extension or leg curl exercises. However, the dual cam assembly of the previous embodiment is eliminated.

The second multi-functional exercise arm 402 comprises a generally U-shaped yoke having a central portion pivotally secured by pivot pin 465 between the lower ends of a pair of plates 466. The U-shaped yoke has opposite arm portions 467 which extend down on opposite sides of the user support, as best illustrated in FIG. 34, and each arm has a first, inwardly projecting handle 469 gripped by a user when performing chest press exercises, and a second, inwardly directed and downwardly bent handle 471 which is gripped by a user when performing mid row exercises.

Figure 35:
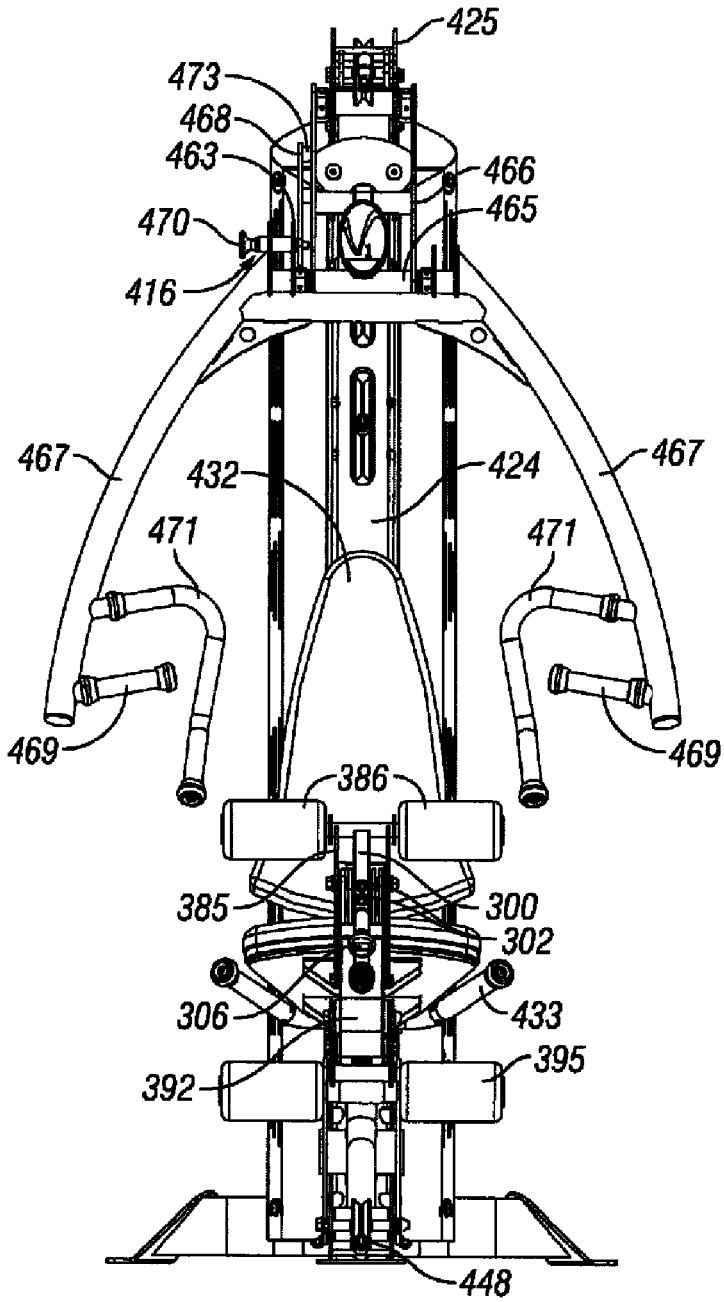
FIG. 35 is a front elevation view of the machine of FIG. 34.

Plates 466 are pivoted to the upper frame portion 415 at their upper ends for rotation about pivot axis 461. A ROM adjuster mechanism 468 is secured to one of the plates 466 by stand offs 473, and arm 402 is secured at a selected orientation relative to plates 466 by a adjuster pin 470 which extends through an opening in plate 463 secured to arm 402 and a selected opening 472 in ROM adjuster 468 (FIGS. 34 and 35). This allows arm 402 to be adjusted between a first start position for performing chest press exercises (FIG. 41) and a second start position for performing mid row exercises (FIG. 43). Upper stop pin 474 engages the ROM mechanism in each exercise start position so that the arm does not swing back against the frame when released.

As noted above, a connecting linkage comprising a cable and pulley assembly 409 links the user support 405 to each of the multi-function exercise arms 390, 402, and also to the mid pulley exercise connector 426. Cable and pulley assembly 409 comprises a first cable 475 anchored to the range of motion cam 300 of the leg exercise arm, and extending from cam 300 between pulleys 476, 478 at the forward end of the base portion of the user support 405, then between pulleys 480, 482 towards the rear end of base portion 428, and around pulley 484 at the junction between the base portion and upright portion of the user support. From pulley 484, the cable 475 extends upward and then back and forth between pulleys 488 on the upright portion of the user support and opposing pulleys 490 on upright strut 424 of the main frame. Cable 475 extends from the uppermost pulley 488 around a pulley 492 on the rear side of upright strut 424, and then anchors to the housing of a floating pulley 494. A second cable 495 extends from an anchor 493 on the upper frame portion 415, around the floating pulley 494, around an upper pulley 496 on the upright strut opposite ROM mechanism 416, around a pulley 497 secured to the rear of exercise arm assembly 402, and then around a pulley 498 below pulley 496 on upright strut 424, and finally extends between pulleys 499 on the upright strut below pulley 498 before connecting to mid pulley connector 426, which can also be connected to handles or the like for performing other exercises, if desired.

Figure 37:
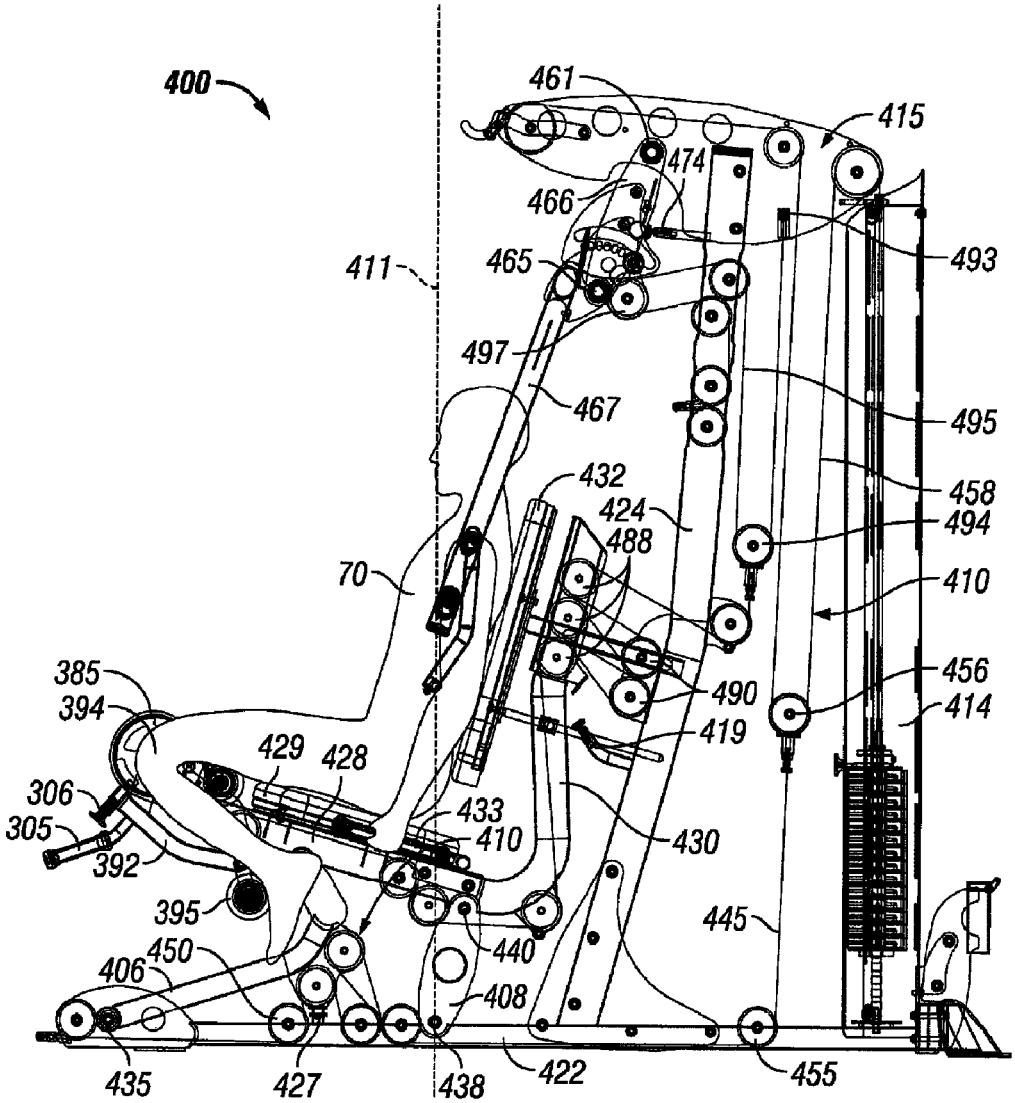
FIG. 37 is a side elevation view of the machine in the same position as FIG. 36, but with a user seated on the machine in the start position for a leg extension exercise.
Figure 38:
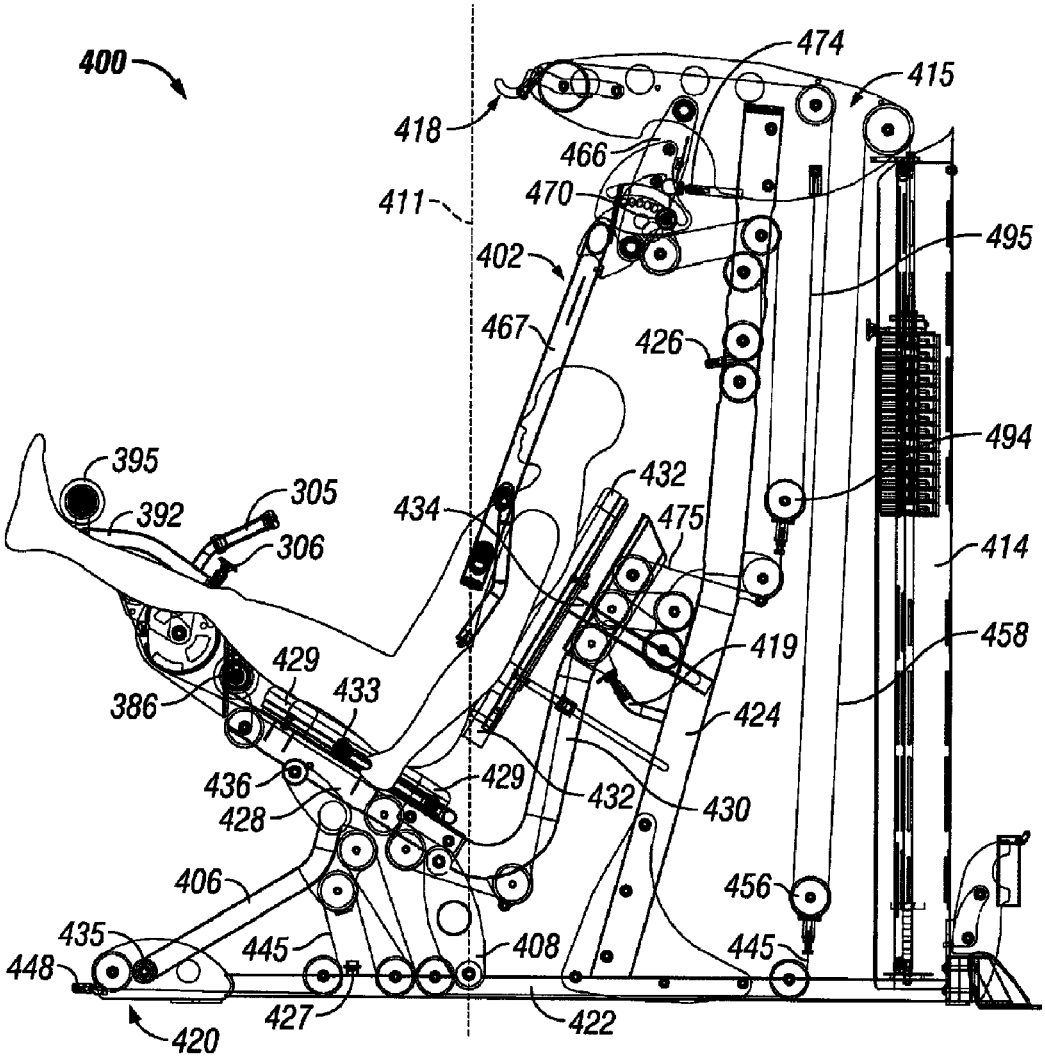
FIG. 38 is a side elevation view similar to FIG. 37 but illustrating the end position for a leg extension exercise.

FIGS. 37 and 38 illustrate a user 70 performing a leg extension exercise on machine 400. For this exercise, the user starts with their legs bent and then extends the legs forwardly. The exercise arm is positioned in a rearward position for the start of this exercise, as illustrated in FIG. 37, and the user support rests on stop post 427 on the base 422 of the main frame. The user moves the exercise arm into the start position by adjusting the position of the upper end of the main tube 392 in ROM adjuster cam 300 so that the exercise arm extends rearward. Thigh brace pads 386 are rotated down about pivot axis 387 into their lowermost position for a leg extension exercise.

In the start position, user 70 sits on the seat with their back against the back pad, knees bent over the thigh brace pads 386, and their feet behind the leg engaging rollers 395. They may grab the support handles 433 for additional bracing if desired. They then start the exercise movement by extending their lower legs outward. This movement causes the exercise arm to pivot about pivot axis 394 at its connection to the user support, which pulls the cable 475. This causes the user support to pivot rearward about its pivotal connection to the main frame. As the user support tilts rearward from the position of FIG. 37 to that of FIG. 38, lifting its front end. At the same time, the load bearing cable 445 is pulled by the lifting of the front end of the user support, pulling floating pulley 456. This pulls on cable 458 connected to the weight stack, providing resistance to the exercise. FIG. 38 illustrates the finish position for a leg extension exercise, with the exercise arm main tube 392 and the user's legs extending out in front of the user support. The rear upright 430 of the user support rests against stop 419 on the main frame upright in the exercise end position, as seen in FIG. 38. The vertical line 411 in FIGS. 37 and 38 illustrates the gravitational center line extending through the theoretical pivot axis of the user support pivotal movement, as determined from the four bar pivot linkage of pivot links 406 and 408.

Figure 39:
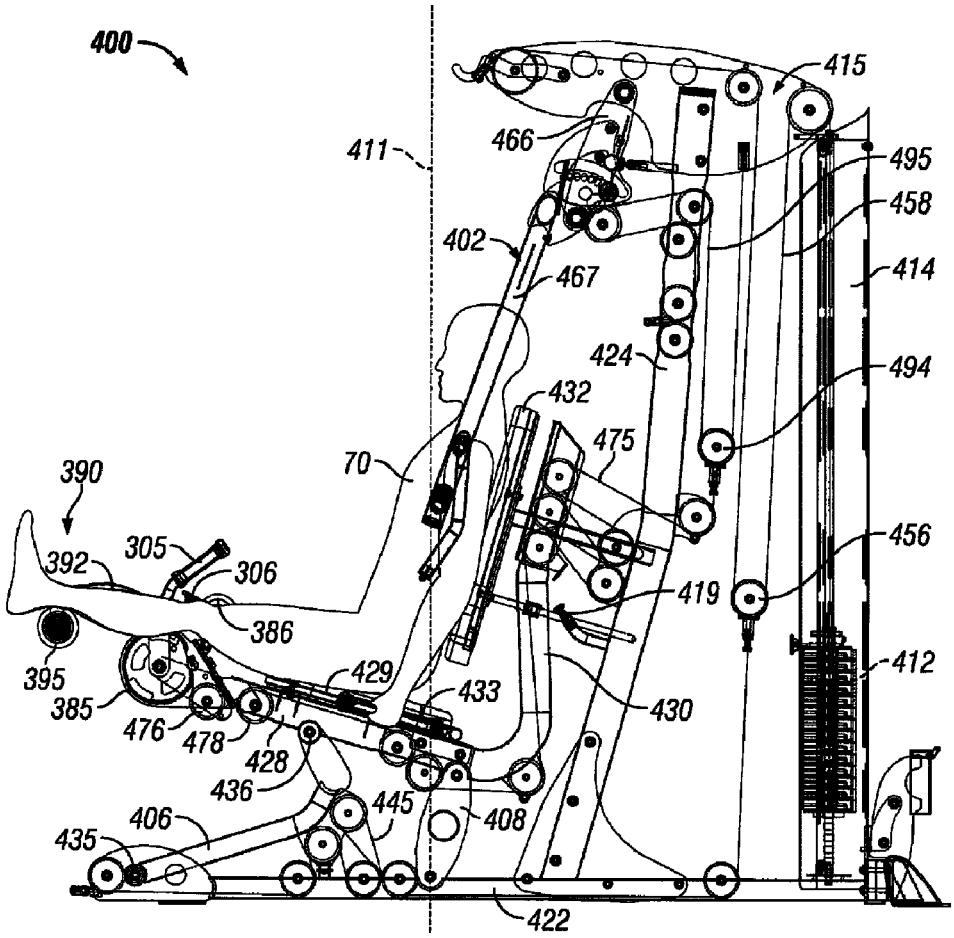
FIG. 39 is a side elevation view of the machine of FIGS. 34 to 38 but illustrating the leg exercise arm adjusted into the start position for a leg curl exercise, with a user seated on the machine and engaging the leg exercise arm.
Figure 40:
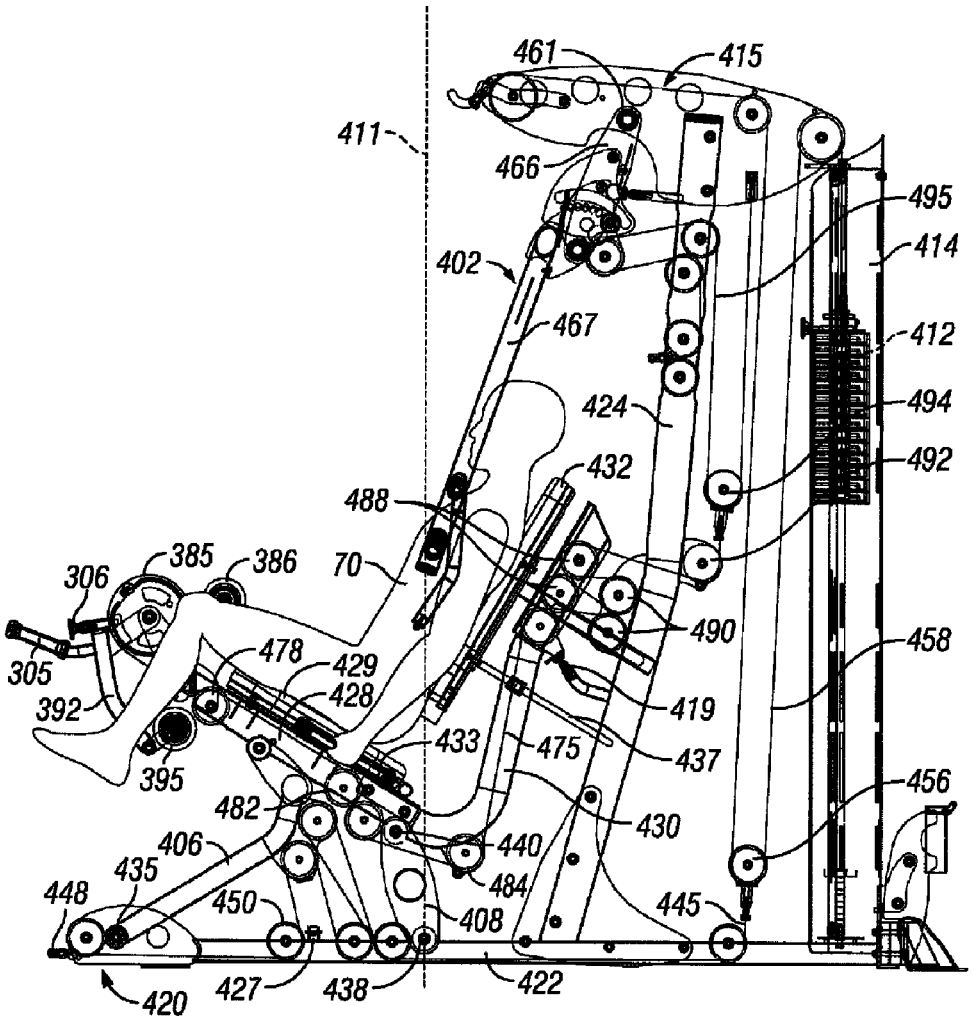
FIG. 40 is a side elevation view of the user and exercise machine similar to FIG. 39 but illustrating the end position for a leg curl exercise.

FIGS. 39 and 40 illustrate the start and finish position of a leg curl exercise on machine 400. In order to perform a leg curl exercise, the user 70 adjusts the exercise arm 390 to extend outward by releasing pull pin 306 from the aligned hole in ROM cam 300 and then pulling up on handle 305 until the exercise arm 390 is in the correct position, before releasing pin 306 to extend into the aligned hole 302. The user sits on the seat pad 429 with their back against the back pad 432. The thigh brace rollers 386 are pivoted up to rest on top of the user's legs and the user's feet rest on top of the leg engaging rollers 395. The user may grab the support handles 433 for additional bracing if desired. They then start the exercise movement by curling their lower legs downward and continue to bend their legs down until the finish position is reached. This action causes the same reaction as the leg extension, pulling the cable 475 of the connecting linkage which is attached to the adjuster cam 300. This in turn causes the user support to pivot back about the theoretical pivot axis into the reclined position of FIG. 40, with rear upright 430 resting against stop 419.

In this way, a user can selectively perform either a leg extension or a leg curl exercise to work different leg muscles. In either case, the user support moves from a slightly reclined start into a more rearwardly reclined finish position. As in the previous embodiments, the user support pads travel together in this embodiment, to keep the user in the same position throughout the exercise motion. The user does not have to worry about balancing on a moving platform or pad. The combined exercise arm and user support movement provides a self-aligning exercise motion that allows the user to achieve a full range of exercise motion. The user can easily switch between a leg extension and a leg curl exercise simply by releasing pull pin 306 from the ROM plate and rotating the exercise arm to the proper start position.

Figure 41:
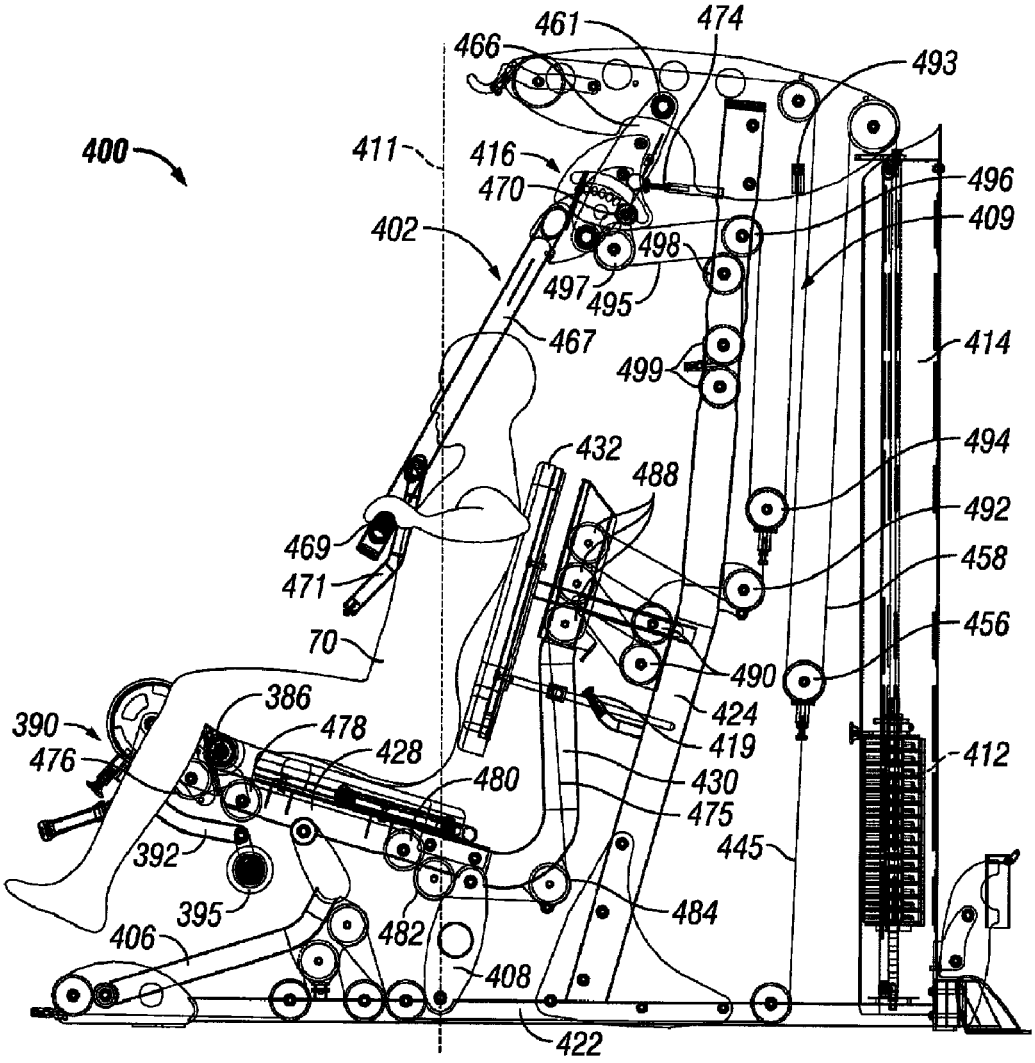
FIG. 41 is a side elevation view of the machine of FIGS. 34 to 40 with a user seated on the machine and engaging the second multi-function arm in a start position for a chest press exercise.
Figure 42:
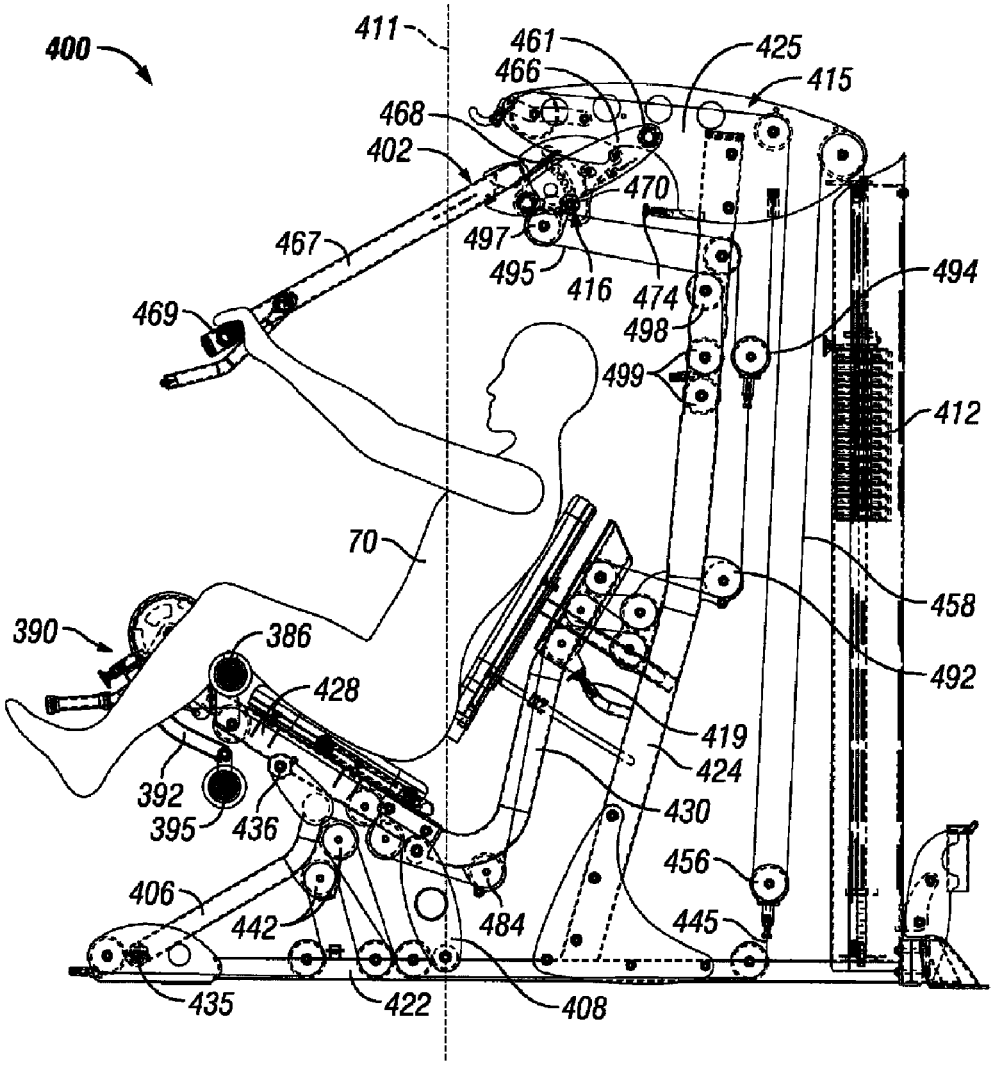
FIG. 42 is a side elevation view similar to FIG. 41 illustrating the end position for a chest press exercise.

FIGS. 41 and 42 illustrate start and finish positions for a chest press exercise using exercise arm 402. For this exercise, arm 402 is adjusted into the start position illustrated in FIG. 41 using ROM mechanism 416, if it is not already in this position. Stop pin 474 is extended to hold arm 402 in the start position with handles 469 located in front of the user's chest, as in FIG. 41. For this exercise, leg exercise arm 390 is rotated rearward into the same position as the start of a leg extension exercise. The user 70 sits on the seat facing forward with their thighs extending over pads 386 at the forward end of the seat and their legs bent down at the knee. They then grip handles 469 with their hands just in front of their chest, which is the normal start position for a chest press exercise. The user then pushes the exercise arm 402 out away from their body, moving the exercise arm, including pulley 497, outwardly and away from upright 424. This simultaneously pulls cable 495, pulling up floating pulley 494 and pulls cable 475, pivoting the user support back into the end position of FIG. 42. At the same time, the load bearing cable 445 is pulled, exactly as described above in connection with the leg exercises.

FIGS. 43 and 44 illustrate start and finish positions for a mid row exercise, which also uses exercise arm 402. For this exercise, the pad 432 is adjusted outwardly via adjuster post 434, away from user support rear upright 430, and the user sits on seat pad 429 facing rearward with their chests engaging pad 432, which in this case acts as a chest support pad. The user may rest their feet partly on the ground and partly on foot support pins 431. Prior to sitting in the exercise ready position, the user can adjust the start position of the exercise arm assembly 402 using ROM adjuster 416, so that it hangs down in front of the user in the mid row start position of FIG. 43. This is done by releasing pin 470 from the aligned hole 472, rotating arm 467 relative to plates 466 until the desired position is reached, then releasing pin 470 to engage the newly aligned hole 472 in ROM plate 468. Once seated, the user grabs the mid row handles 471 with their arms extending straight out in front of their body, as indicated in FIG. 43. They then pull the handle inwards towards their body, into the end position of FIG. 44, until their hands are positioned on opposite sides of chest pad 432. This simultaneously pulls cable 495, lifting floating pulley 494 which pulls cable 475 so that user support 405 rotates into the more inclined end position of FIG. 44.

The mid pulley connector 426 allows a user to perform another ride movement exercise when seated on the user support or when standing. Pulling on connector 426 also pulls cable 495 and rocks the seat between start and finish positions, depending on the amount of cable pulled.

Regardless of the exercise performed, whether leg extension, leg curl, chest press, or mid row, the gravitational center line 411 of the pivotal movement extends through the user and user support in both the exercise start and finish positions. The amount of weight positioned on each side of centerline 411 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 45 to 49 illustrate another embodiment of an exercise machine 500 which has one multi-function user engagement device or exercise arm 502 which has two different modes of operation and can be used to perform either leg press or chest press exercises, and a second user engagement device 504 associated with a mid pulley, which can be used to perform various exercises, such as abdominal crunch and overhead triceps extension exercises. As in the previous embodiments, exercise machine 500 has a moving user support 505 which is pivotally mounted relative to a stationary main frame 506. A first connecting linkage 508 translates movement of multi-function exercise arm 502 into movement of the user support. A second connecting linkage 510 translates movement of second user engagement device 504 into movement of the user support. A cable and pulley assembly 512 extends between the first exercise arm 502, user support 505, and a weight stack 514 which provides the exercise resistance.

Main frame 506 has a base strut 515 having a first pivot support 516 at its forward end and a weight stack support portion 518 at its rear end, and an upright strut 520 rear of the user support which is connected to the top of a weight stack support frame. A second pivot support post 522 provides the pivot mount for user support 505 which is pivotally mounted on pivot bracket 524 at the top of post 522 for rotation about pivot axis 525. A stop post 526 towards the forward end of base strut 515 engages part of exercise arm 502 in the start position of FIGS. 46 and 48.

User support 505 comprises a generally L-shaped frame with a base portion 528 on which a seat pad 530 is mounted, and a rear, generally rearwardly inclined portion 532 on which a back pad 534 is mounted. The seat pad mount may be adjustable in a similar manner to seat pad 98 of the second embodiment. A foot rest 535 is provided at the forward end of base portion 528. The second user engagement device 504 comprises flexible strap handles 537 located at the upper end of user support rear upright and secured to a cable 536 of the second connecting linkage which extends over mid-pulley 538 on rear upright 532, a pulley 540 located on the main frame rear upright 520 behind the user support, and a second, lower pulley 542 on the user support rear upright 532. A counter weight 544 is attached to the end of cable 536 to eliminate slack in the flexible line or cable 536 as the user support rocks when the exercise arm assembly 502 is in use.

The multi-function exercise arm assembly 502 comprises two user engaging parts or arms 545 and 546 which are connected together so as to move together in unison, and is pivotally mounted via pivot sleeve 547 on forward post 516 of the main frame for rotation about pivot axis 548. The first part 545 comprises a generally U-shaped yoke with opposite arms 550 extending upwardly on opposite sides of the user support 505 and having outwardly directed handles 552 at their upper ends. The second part 546 comprises a leg exercise arm which is bent to form a first portion 553 extending forward from a central part of the U-shaped yoke beneath the seat, a second portion 554 bent upward from the forward end of portion 553 and pivoted to pivot post 516 adjacent the bend between portions 553 and 554, and a third portion 555 bent rearward from the upper end of portion 554 and having foot engaging pads 556 mounted at is upper end. A roller wheel 558 is rotatably mounted between mounting plates 560 which extend to the rear of the junction between the first and second parts of the combined arm assembly 502. Roller wheel 558 is in rolling engagement with the underside of the user support base portion 528, and provides the connecting linkage 508 to translate movement of the exercise arm into movement of the user support.

Cable and pulley assembly 512 comprises a cable 562 extending from anchor 564 on the base strut 515 beneath the user support, around a pulley 565 secured to the combined or multi-functional exercise arm assembly 502, and around a first pulley 566 on the base strut 515 adjacent anchor 564, around a pulley 568 on the base portion 528 of the user support, then around a second pulley 570 on main frame base strut 515, before extending through the base strut around another pulley 571, then extending upward and anchoring to floating pulley 572. Floating pulley 572 is linked to the weight stack by a second cable 574 extending from an anchor 575 on an upper end portion 573 of upright strut 520, around floating pulley 572, around a second pulley 576 on the upper end of strut 520, and then anchoring to the weight stack.

Figure 46:
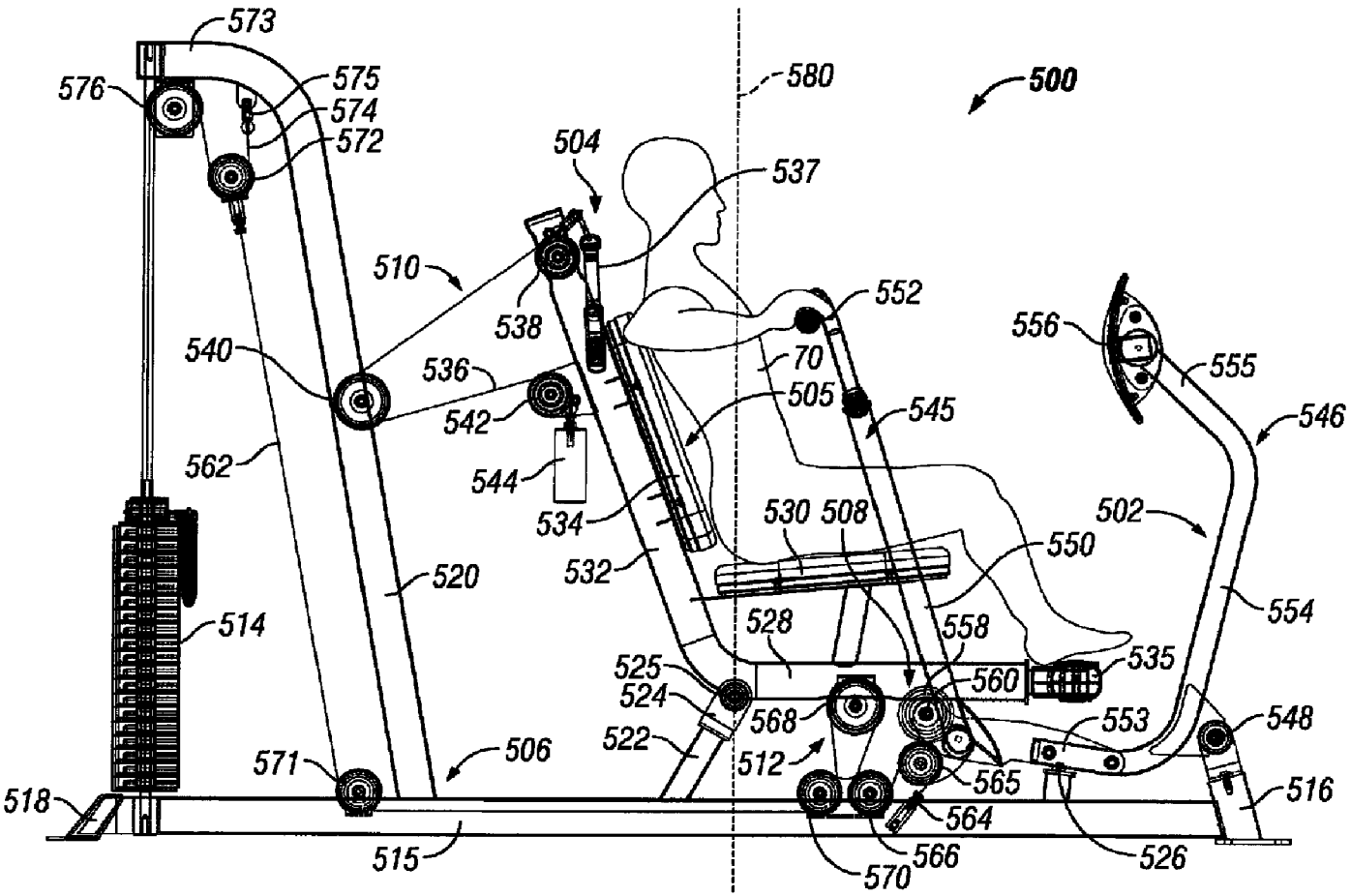
FIG. 46 is a side elevation view with the machine in the start position of FIG. 45 and a user seated on the machine and positioned at the start of a chest press exercise.
Figure 47:
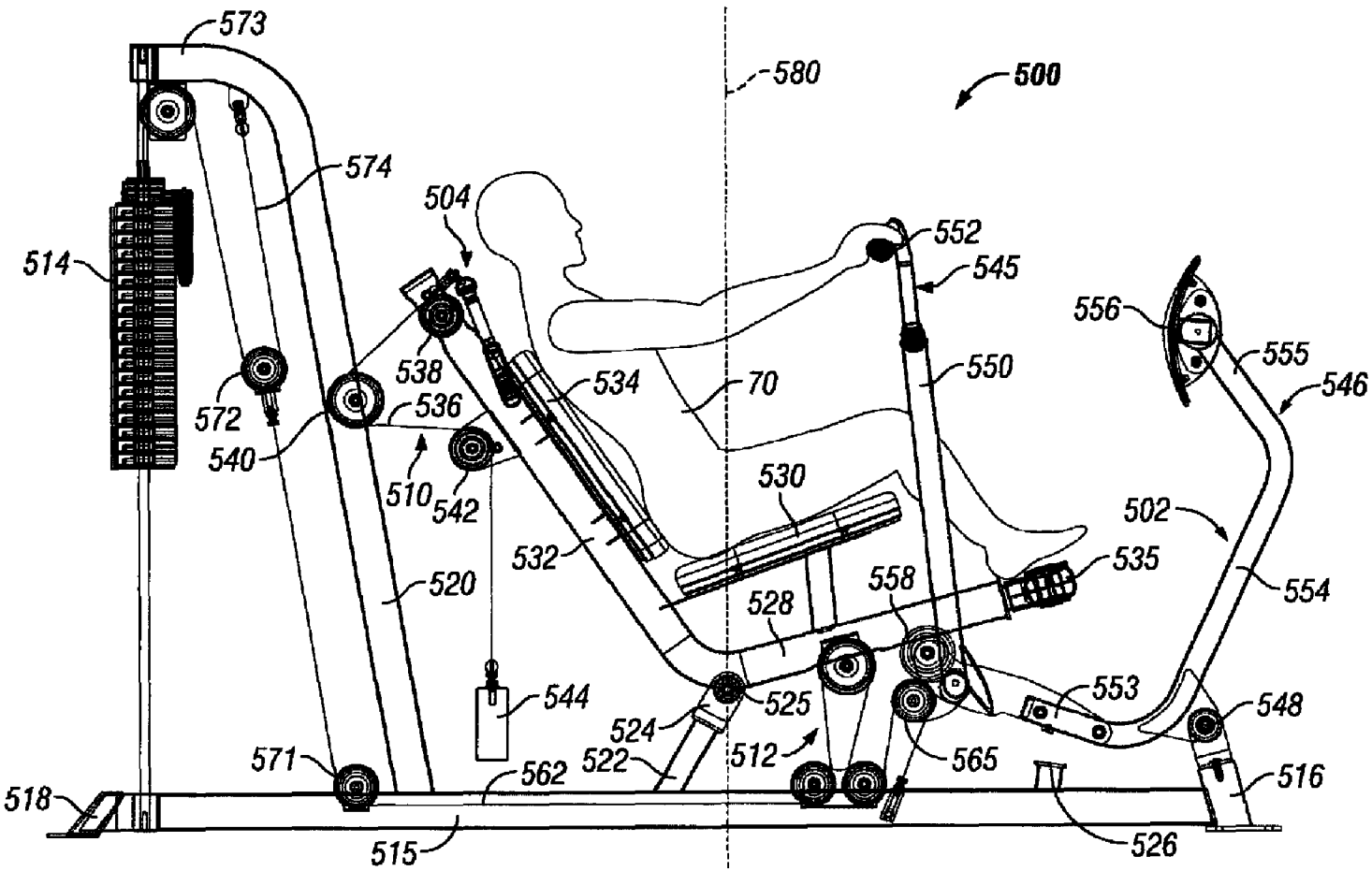
FIG. 47 is a side elevation view similar to FIG. 46 illustrating the end position of a chest press exercise.

FIGS. 46 and 47 illustrate the start and end positions for a chest press exercise using the chest press exercise arms 550 of the multi-function user support or exercise arm assembly 502. In the start position, the arm assembly 502 is in the lower position with the first portion 553 of the leg exercise part resting against stop post 526. In order to perform the exercise, the user 70 sits on seat pad 530 with their back against back pad 534 and their feet resting on foot rest 535. The handles 552 of exercise arms 550 are located just in front of the user's chest in this position. The user then grips handles 552 with their arms bent, as illustrated in FIG. 46, and pushes the arms forward away from their chest. This rotates the arm assembly 502 about pivot axis 548, rotating the rear end of the arm assembly upwards and the forward end downwards. Roller wheel 558 acts as the connecting linkage which translates movement of exercise arm assembly 502 into movement of the user support 505. As the rear end of arm assembly rotates upward, the roller wheel ramps up against the base 528 of the user support, and rocks the user support rearward about pivot axis 525. In the end position of FIG. 47, the user support is inclined rearward, and the user is placed in a rearward lean with their arms extending straight out in front of their chest. At the same time, movement of the user support upward at its forward end pulls on cable 562, pulling floating pulley 572 downward and lifting weight stack 514, as seen in FIG. 47.

Figure 48:
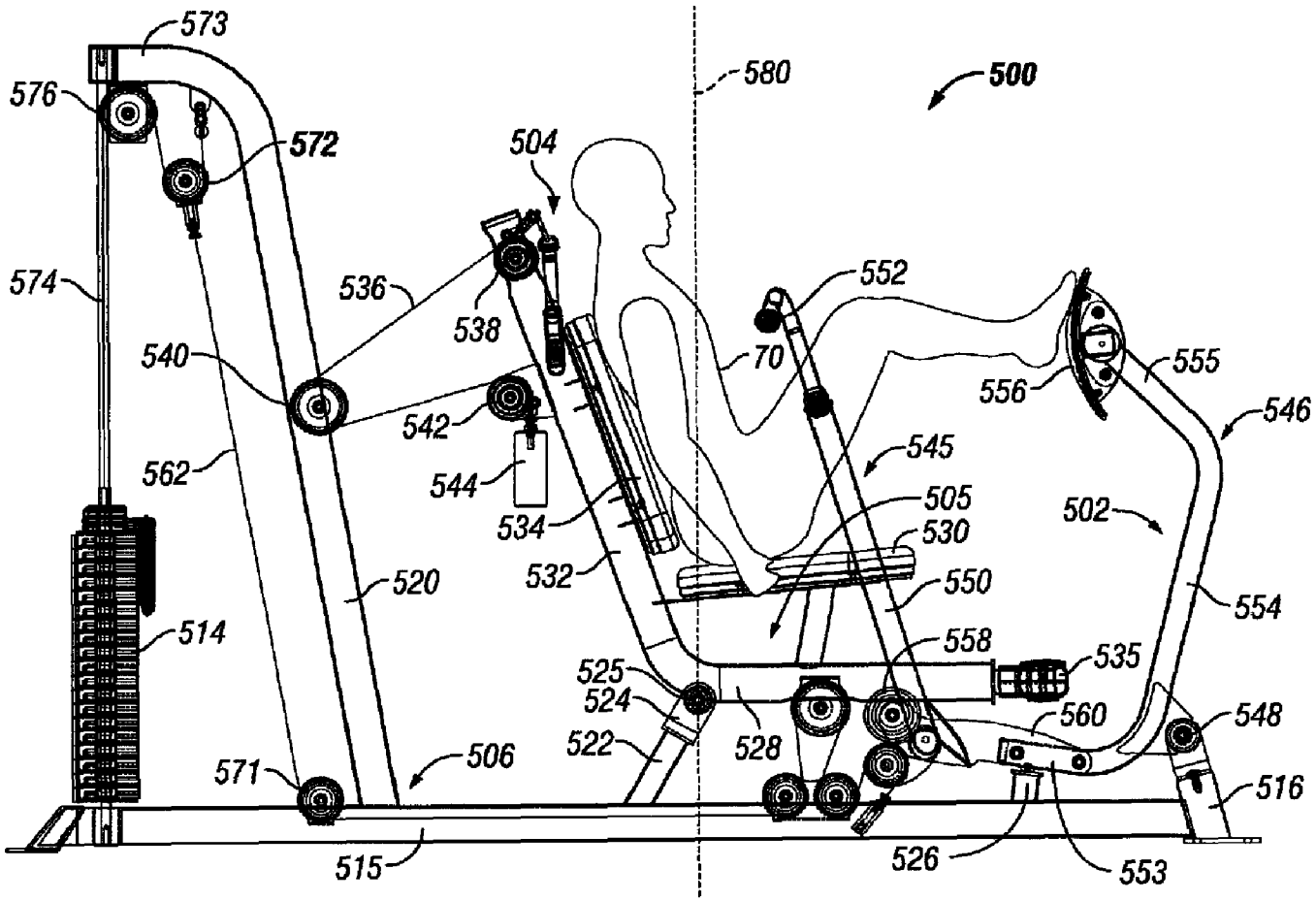
FIG. 48 is a side elevation view with the machine in the start position of FIG. 45 and a user seated on the machine and positioned in the start position for a leg press exercise.
Figure 49:
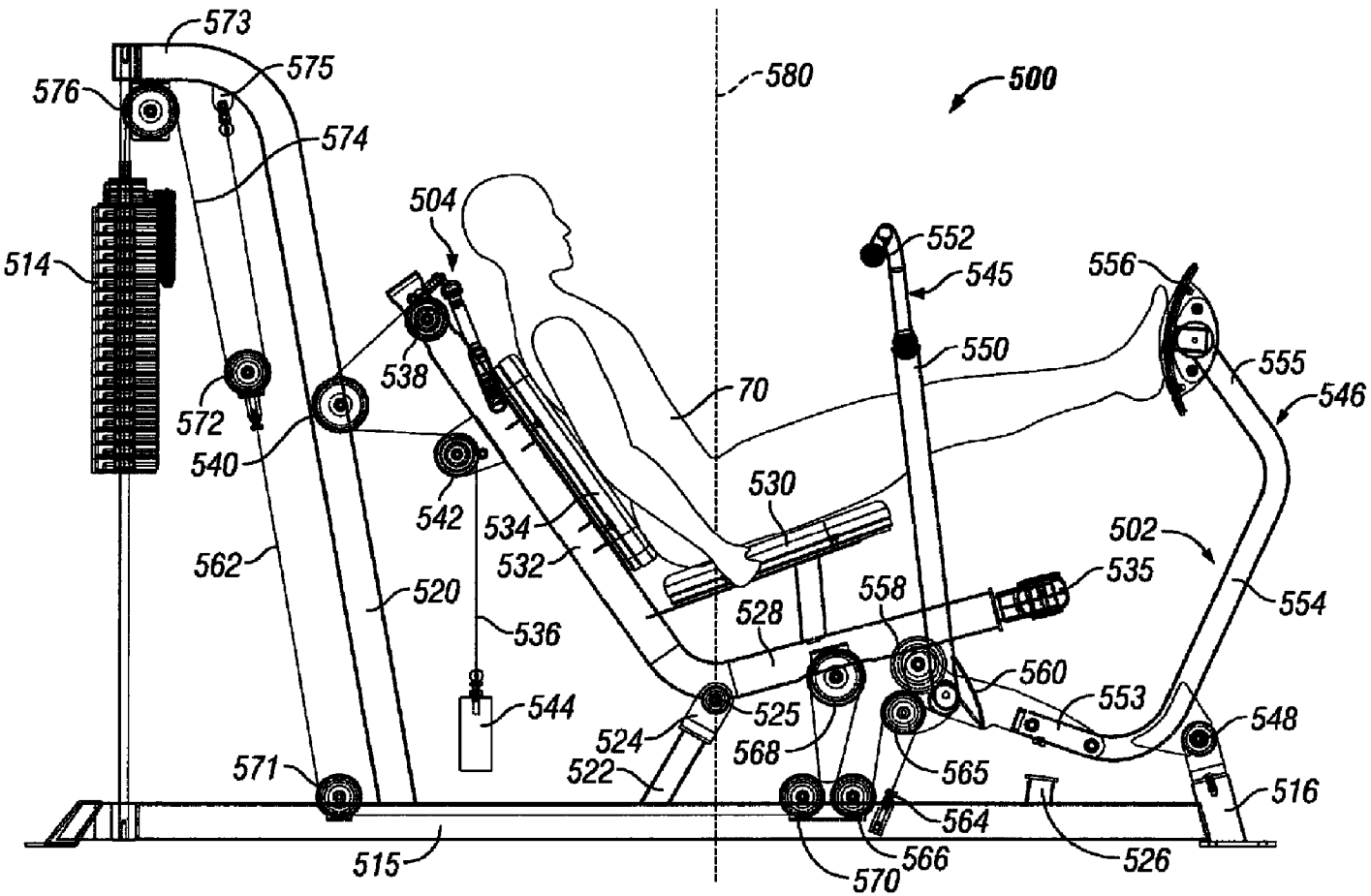
FIG. 49 is a side elevation view similar to FIG. 48 but illustrating the end position of a leg press exercise.

FIGS. 48 and 49 illustrate start and end positions of a leg press exercise using the combined exercise arm assembly 502. The start position of the user support and exercise arm assembly 502 is the same as for a chest press, but the user 70 is positioned differently on the user support. In order to start a leg press exercise, the user sits on seat pad 530 with their back against back pad 534 and their feet engaging foot plates 556 with their knees bent. They may grip the sides of the seat pad for added stability. Optionally, handles may be provided on opposite sides of the seat for this purpose. They then push their legs outward, simultaneously rotating the combined exercise arm assembly 502 about pivot axis 548, lifting the rear end of arm 546 and the entire arm 545 upwards. Roller wheel 558 again ramps up and rolls against the base of the user support, rocking the user support back into the end position of FIG. 49. In the end position, the user's feet extend substantially straight out and the user is rocked from a relatively upright position into a rearward reclined position.

In both exercises, exercise resistance is provided by the weight stack which is linked to both the combined exercise arm assembly 502 and to the user support 505, with rotation of both of these parts from the start to the finish position pulling on the weight bearing cable 562. Counterweight 544 reduces or eliminates slack in the flexible line of the second user engagement device 504 as the seat rocks back to the end position.

As can be seen in FIGS. 47 and 48 and FIGS. 49 and 50, the gravitational center line 580 which extends through the user support pivot axis 525 also extends through the user and user support in both the start and end position for either a chest press or leg press exercise. Again, this helps to reduce exercise starting resistance and resistance drop off at the end of an exercise, as has been described in connection with the previous embodiments.

The user 70 may also perform other exercises on machine 500 using the second user engagement device 504. Pulling on handles 537 simultaneously pulls on cable 536, which in turn pulls the user support rearward from the start position of FIG. 46 or 48.

Figure 50:
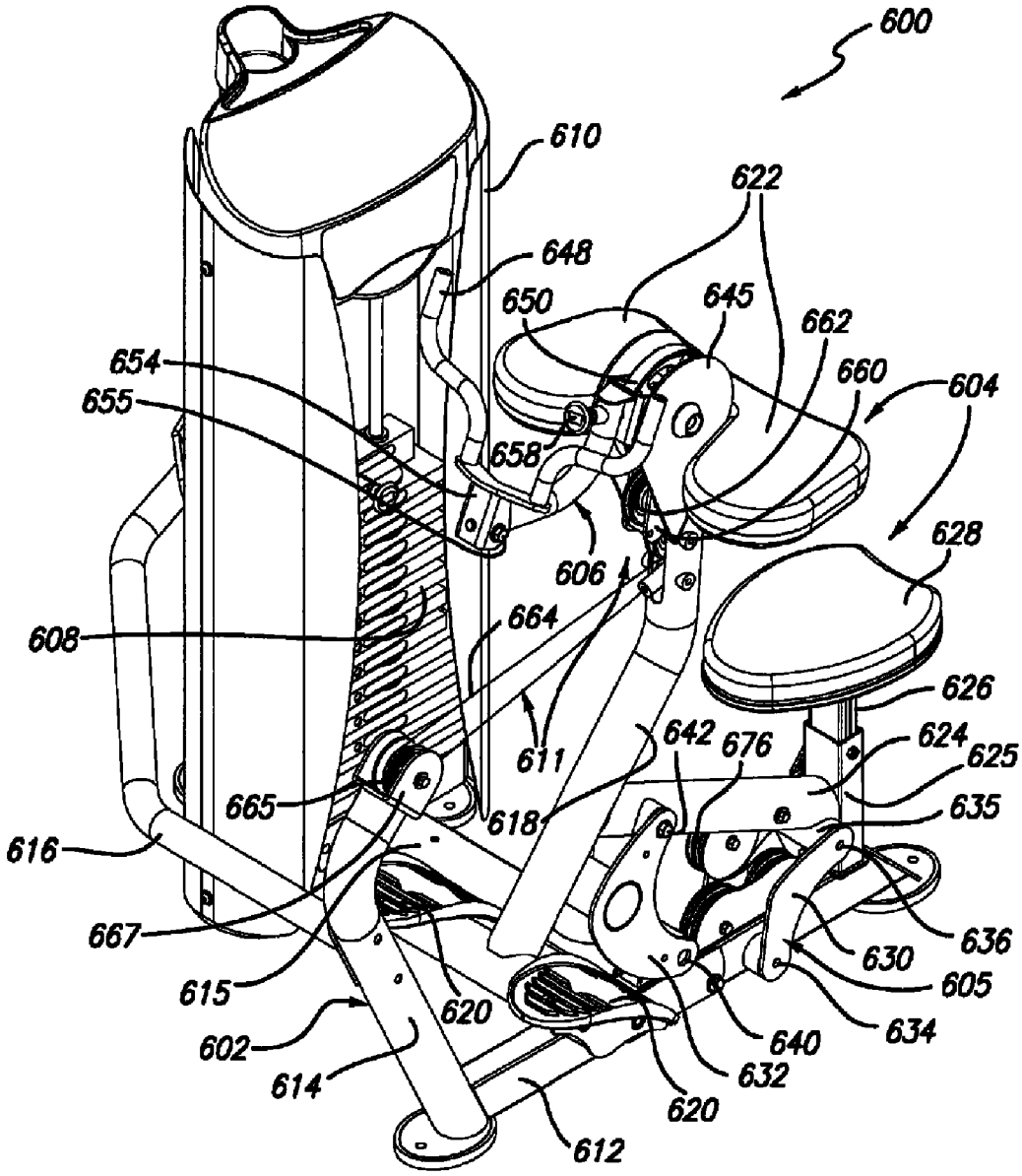
FIG. 50 is a front perspective view of another embodiment of an exercise machine having a combination biceps curl/triceps extension user engaging arm according to another embodiment, with the machine in a starting position for a biceps curl exercise.
Figure 53A:
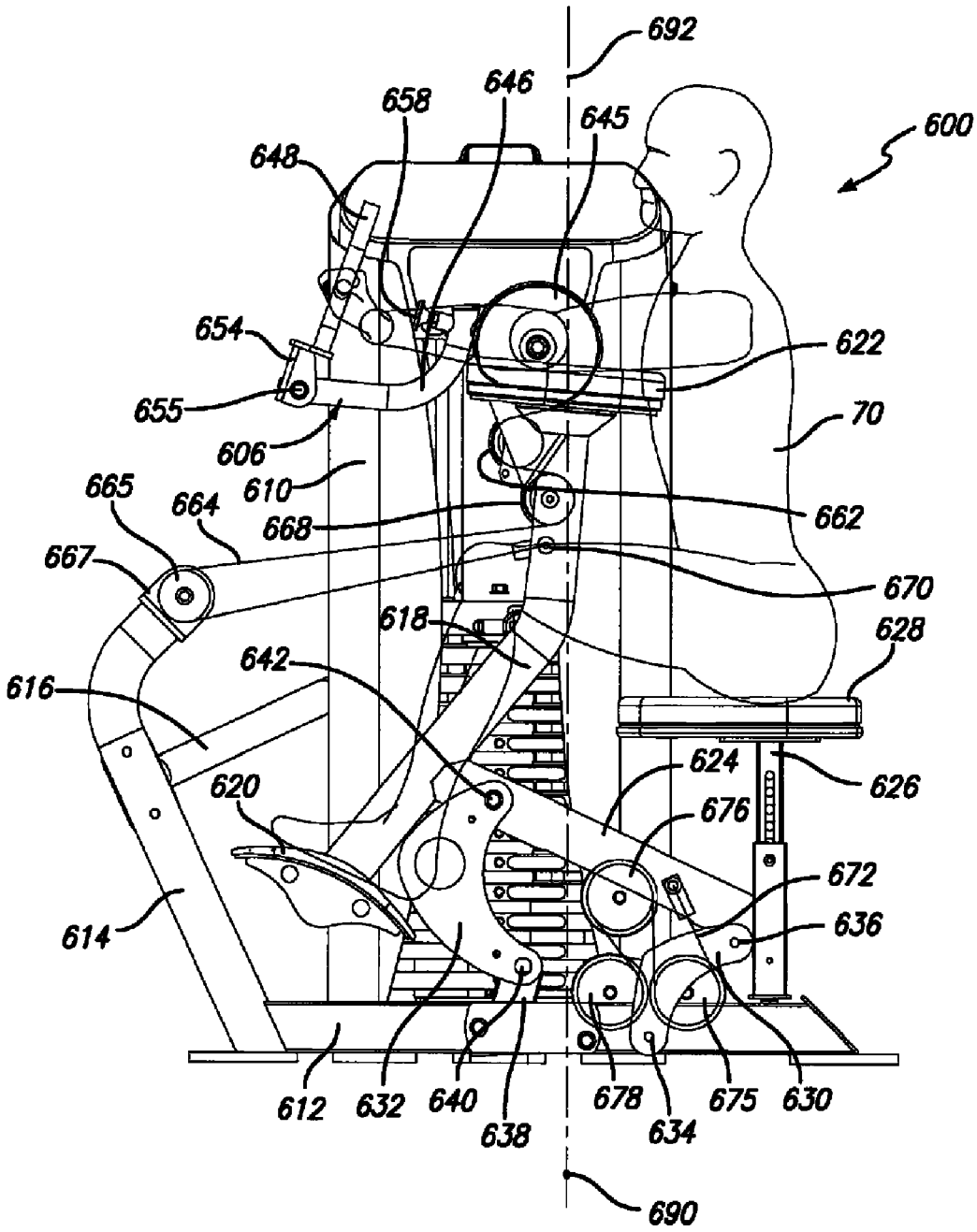
FIG. 53A is a side elevation view similar to FIG. 52A with a user seated on the machine and ready to perform the exercise.
Figure 53B:
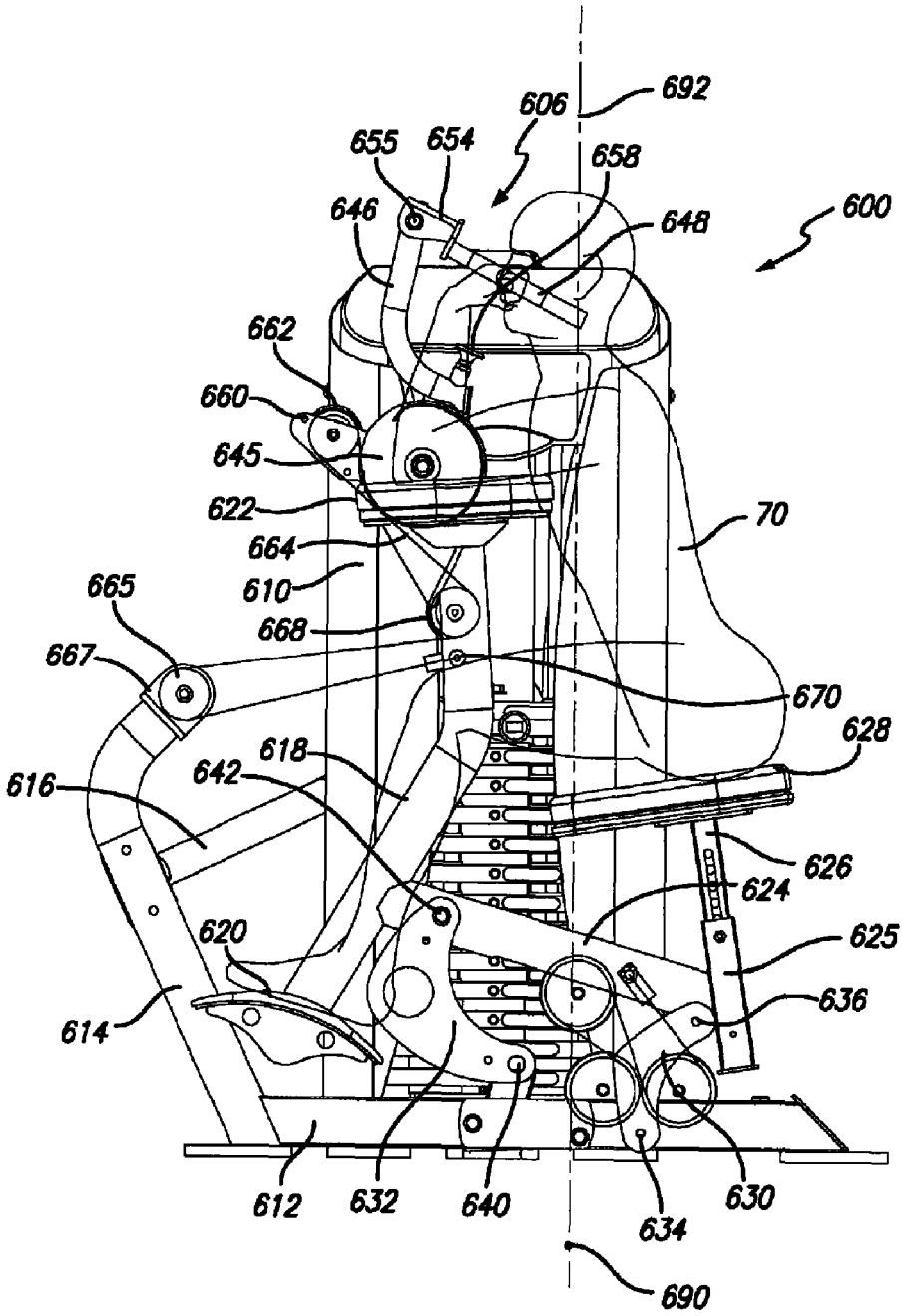
FIG. 53B is a side elevation view similar to FIG. 53A but illustrating a finish position for the biceps curl exercise.
Figure 54:
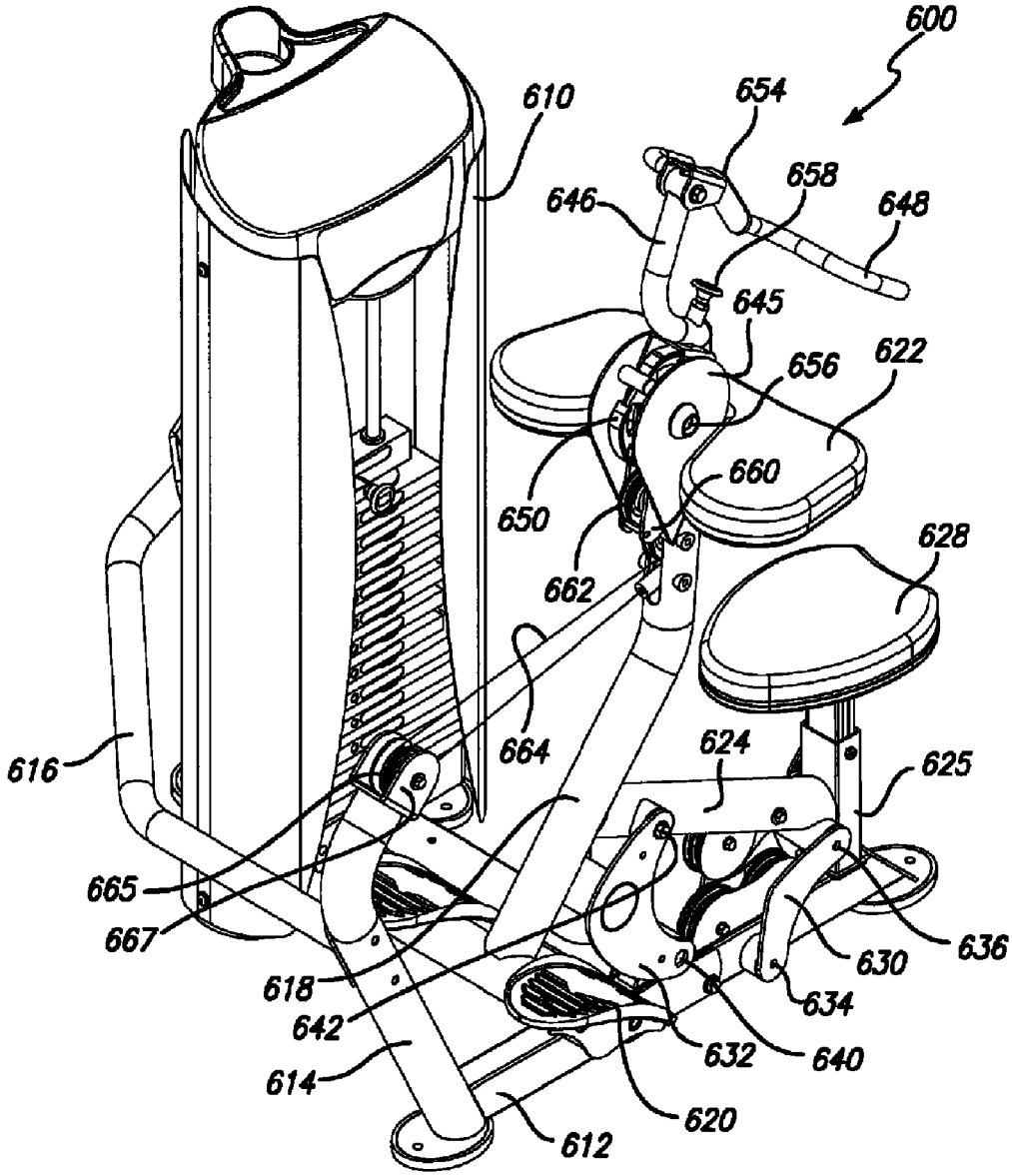
FIG. 54 is a front elevation view of the machine of FIGS. 50 to 53 in a start position for a triceps extension exercise.

FIGS. 50 to 57 illustrate another embodiment of an exercise machine 600 which has a multi-function, bi-directional exercise arm having two different modes of operation allowing a user to perform different exercises. Exercise machine 600 is also described in co-pending application Ser. No. 11/848,012 referenced above, the entire contents of which are incorporated herein by reference. This machine can perform both biceps curl and triceps extension exercises, with FIG. 50 illustrating the start position for a biceps curl and FIG. 54 illustrating the start position for a triceps extension.

The machine 600 has a main frame 602, a user support 604 pivotally mounted on the main frame by a four-bar pivot linkage 605, and a multi-function, bi-directional exercise arm assembly 606 pivotally mounted on the user support. A weight stack 608 mounted in weight stack frame or housing 610 is linked to the user support by a cable and pulley linkage to provide exercise resistance. A connecting link comprising a cable and pulley system 611 extends between the main frame, user support, and exercise arm, as explained in more detail below.

The main frame 602 has a base section 612 for engaging the floor and an inclined upright tube 614 located at the forward end on the base section. The base section 612 is connected to the weight stack support frame 610 by a guide tube 615 for the cable and pulley linkage. A connecting rod 616 is connected at one end to the upright tube 614 and at the other end to the outer face of the weight stack support frame or housing 610.

The user support 604 has an angled upright tube 618 at its forward end with user supporting foot rests 620 mounted on its lower end and a user supporting arm pad 622 mounted at its upper end. A downwardly angled seat support tube 624 is attached by welding or other fastening means at an intermediate position along upright tube 618 and projects rearward from the tube 618. A seat pad support tube 625 is attached transversely to the rear end of seat support tube 624 and has an open end in which a seat post 626 is telescopically engaged. Seat post 626 has a mounting plate at one end for attaching seat pad 628 for supporting a user. This arrangement is designed to accommodate users of different heights by varying the distance between the seat and the arm support pads.

The user support four-bar pivot linkage system 605 comprises two spaced, parallel rearward links 630 and a forward link 632. The rearward links are pivotally connected at one end to main frame base section 612 for rotation about first pivot axis 634, and are pivotally connected at the other end to a pivot housing 635 on the underside of seat support tube 624 for rotation about second pivot axis 636. The forward link 632 comprises two spaced plates connected by a central connecting tube 637. Link 632 is pivotally connected at one end to the upper end of a stand-off 638 on the base section 612 of the main frame, for rotation about third pivot axis 640 spaced forward and upward from first pivot axis 634. The opposite end of link 632 is pivotally connected to the seat support tube 624 for rotation about a fourth pivot axis 642 spaced forward from second pivot axis 635. By using the four-bar linkage as the user support pivot system, all the pivoting action can take place under the user with the pivot mounts conveniently located on the main frame and user support. However, the theoretical pivot for the user support is actually located elsewhere. The theoretical pivot 690 is the point where a single pivot would have to be located in order to mimic the same user support movement and gravitational centerline of the user support movement, and is located beneath the user support frame, as illustrated in FIGS. 53A and 53B, and in FIGS. 57A and 57B.

The advantage of the four-bar pivot system with the theoretical pivot is that it takes the movement pattern of a single point pivot that might normally be located in an area impossible to access due to either structural or user interference and provides pivot mounts in accessible locations which together provide for rotation of the user support about the otherwise inaccessible location. The vertical gravitational center line 692 of the pivotal movement is also shown in FIGS. 53 and 57.

The arm pad 622 of the user support has an indented region 644 at its center, and a pair of cam mounting pivot brackets 645 protrude upward from tube 618 through the center of the arm support pad 622. The exercise arm assembly 606 has a curved main tube or arm 646, user engaging handles 648, and a range-of-motion (ROM) adjuster 650. The main tube 646 has a first pivot mount or sleeve 652 attached at a first or outer end (see FIG. 51). The user engaging handles 648 have an angled step that places the outer ends wider than the lower, inner ends. This design allows multiple gripping positions for the user's hands. A connecting bracket 654 is located at the lower ends of the handles 648 and is pivotally connected to the main arm 646 at first pivot mount 652 for rotation about pivot axis 655. This connection enables the user engaging handles to self-align to the user during the exercise and automatically adjust to the user's arm length. A pair of mounting brackets (not visible in the drawings) project outward from the main tube near the second end of the main tube or arm 646. The ROM adjuster 650 comprises a round cam which is pivotally mounted together with the mounting brackets on the end of main arm 646 to the cam mounting pivot brackets 645 on the user support for rotation about pivot axis 656. The ROM adjuster cam 650 has spaced adjustment holes 651 around its perimeter (see FIG. 55), and an adjuster pin or pull pin 658 is mounted approximate the second end of exercise arm main tube 646 for selective engagement in the cam adjustment holes to secure the exercise arm at a selected position around cam 650, depending on the exercise to be performed. This arrangement is designed to provide bi-directional exercise movement. A cam lever arm 660 pivotally associated with the cam 650 has a pulley 662 mounted on is outboard edge.

As noted above, the connecting link in this embodiment comprises a pulley and cable system. The connecting link pulley and cable system 611 has a first cable or flexible line 664 attached to the upright tube 618 of the user support at anchor 670 and then reeved around a pulley 665 mounted on a link connecting pivot mount 667 on the main frame upright 614. The cable 664 is then reeved around a pulley 668 mounted on user support upright tube 618 at a location above the cable attachment point or anchor 670. The cable is then reeved around the pulley 662 located on the outer edge of cam lever arm 660 before finally attaching to cam 650.

The user support 604 is linked to the weight stack by a load-bearing cable 672 (see FIG. 52A) which extends from an anchor or attachment point 674 on the seat support 624 around a first pulley 675 on main frame base section 612, then around a pulley 676 on the underside of seat support 624 forward of anchor 674, and finally around pulley 678 on base section 612, before linking to the weight stack 608 through guide tube 615 in any suitable manner.

Figure 51:
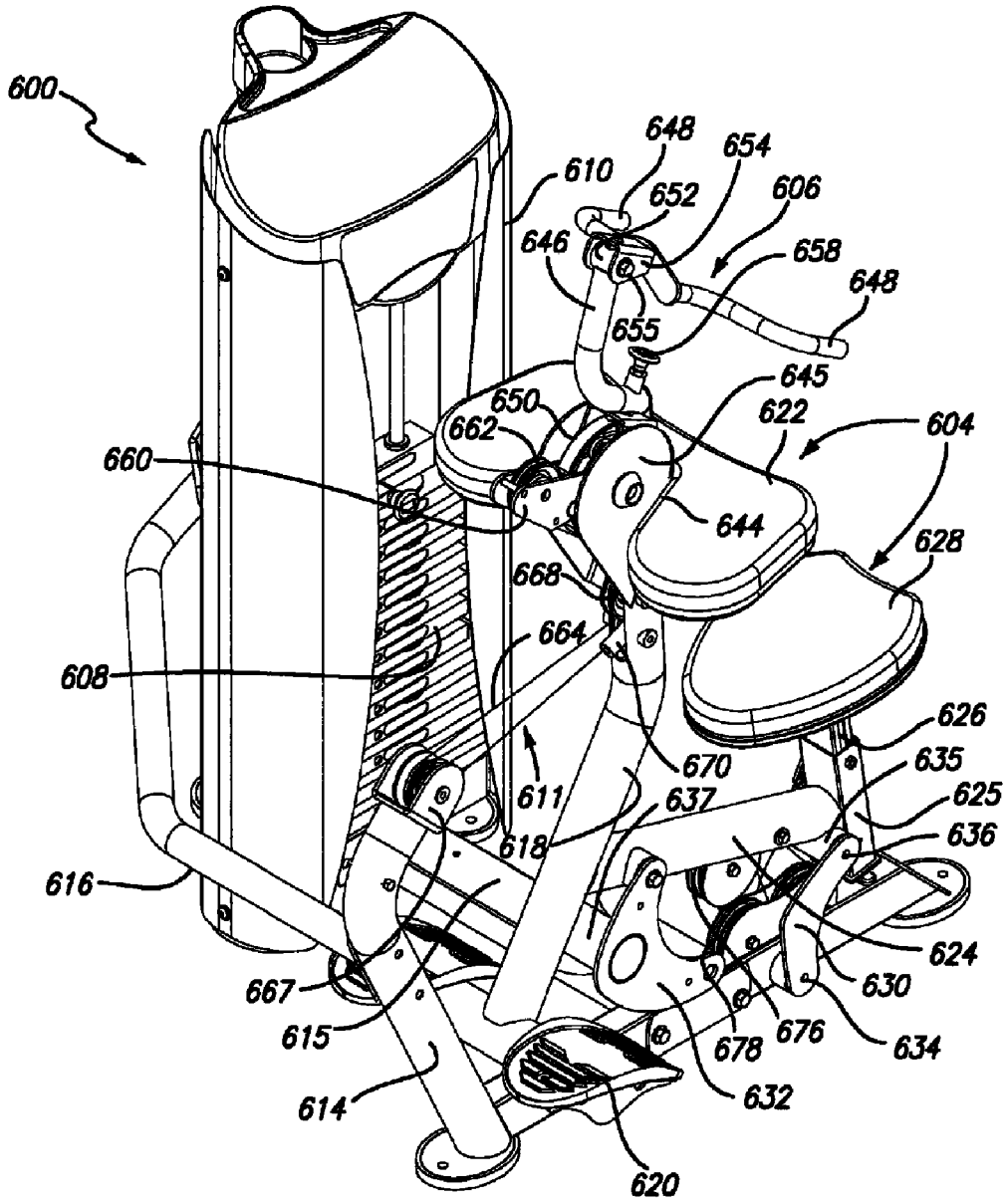
FIG. 51 is a front perspective view of the machine in the finish position for a biceps curl exercise.
Figure 52A:
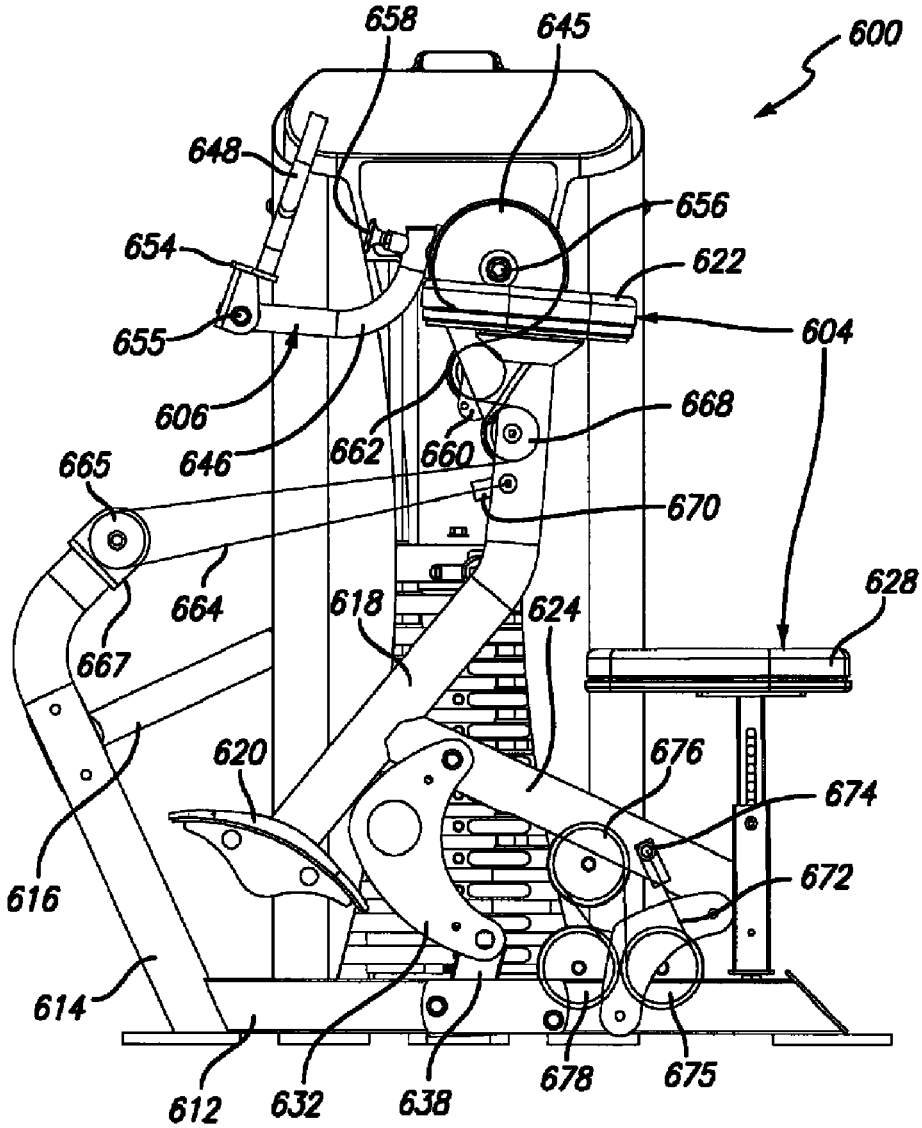
FIG. 52A is a side elevation view illustrating the machine in the start position of FIG. 50.
Figure 52B:
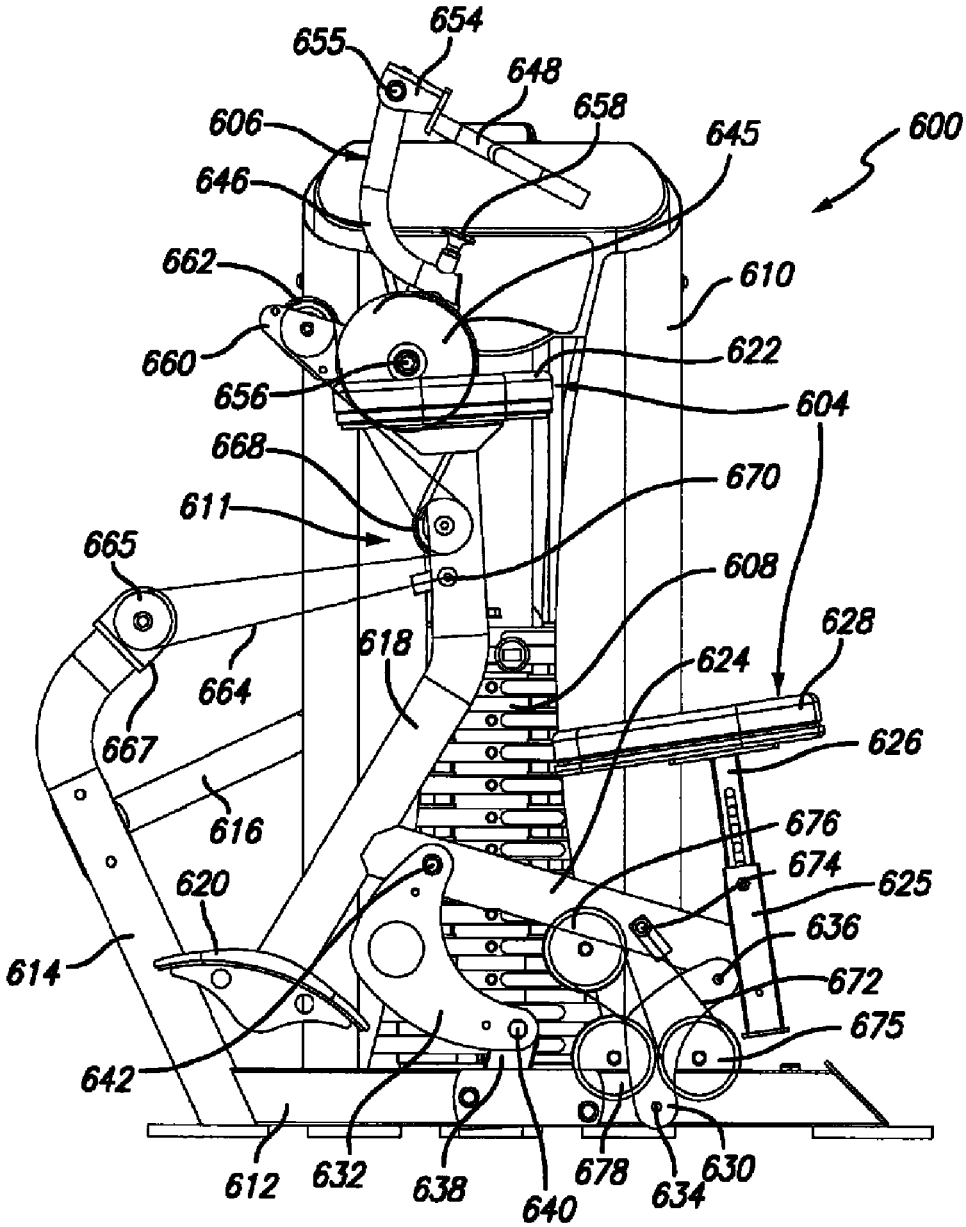
FIG. 52B is a side elevation view similar to FIG. 52A illustrating a finish position for a biceps curl exercise.

FIGS. 50, 52A, and 53A illustrate the machine 600 configured for performing a biceps curl exercise, with a user 70 shown seated on the machine in FIG. 53A. In order to perform this exercise, the exercise arm assembly 606 is positioned as indicated in FIGS. 50, 52A and 53A, with the main arm 646 extending downward and the handles 648 pivoted into a generally upright, slightly rearward inclined orientation. To perform a biceps curl exercise, the user 70 sits on the seat, places their feet on the foot rests 620 and rests their upper arms on the arm support pad 622. This places the user in a generally upright orientation. They then adjust the exercise arm to extend downward, by pulling lock pin or pull pin 658 out of the aligned opening in cam or ROM adjuster cam 650, rotating the exercise arm assembly to the desired start position of FIG. 53A, and then releasing the pin to re-engage in another opening in the cam or ROM plate. The user 70 then grabs the user engaging handles 648 with their arms extending straight and starts the exercise movement by pulling the handle upward, towards their head. This movement causes the exercise arm 646, cam 650, and cam lever arm 660 to pivot about their connection to the user support at pivot point 656, which pulls the connecting link cable 664 as it wraps around the cam. This causes the user support to pivot about its connection to the main frame, tilting forward and pulling the load bearing cable 672. The rotation continues until the finish position of FIGS. 51, 52B and 53B is reached, with the user's arms bent and their hands adjacent their head.

Figure 55:
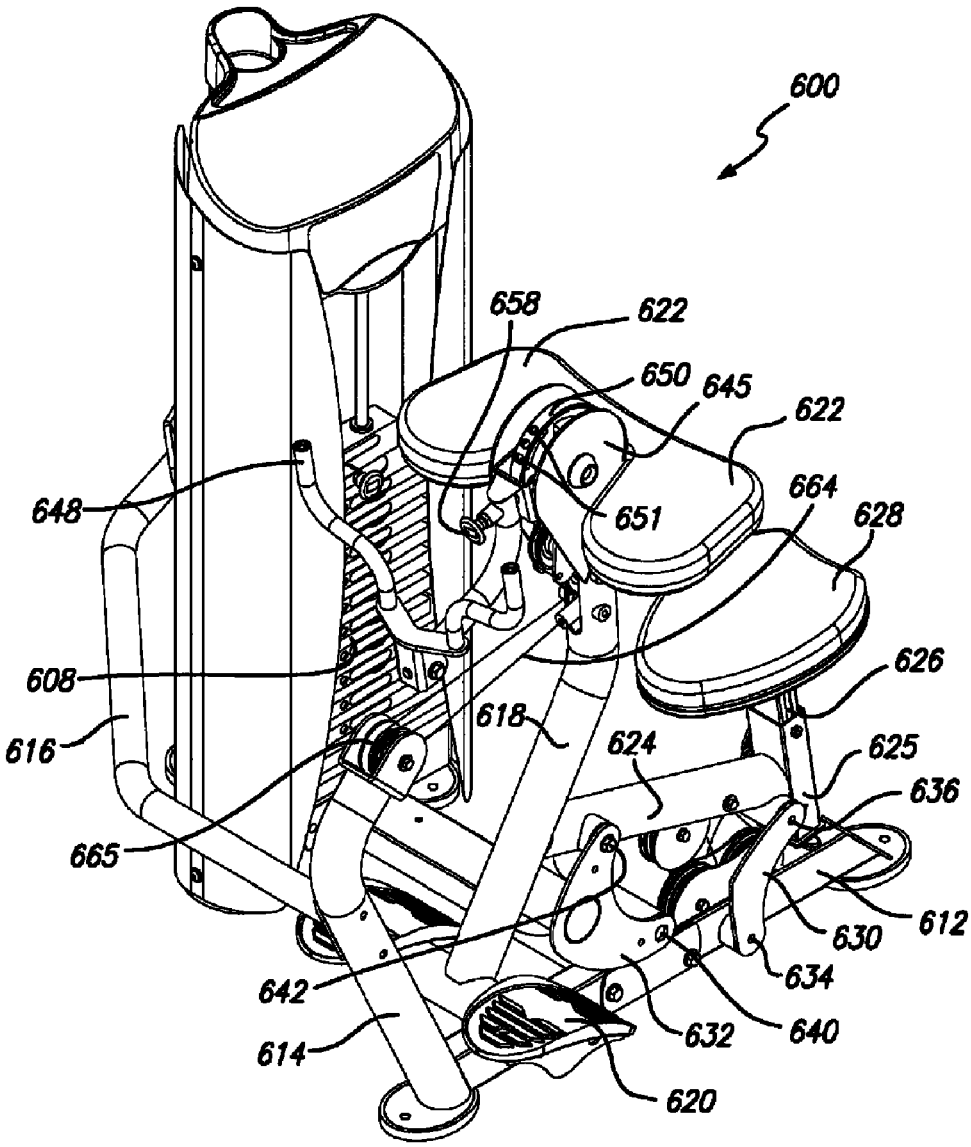
FIG. 55 is a front perspective view of the machine of FIG. 54 in the finish position.
Figure 56A:
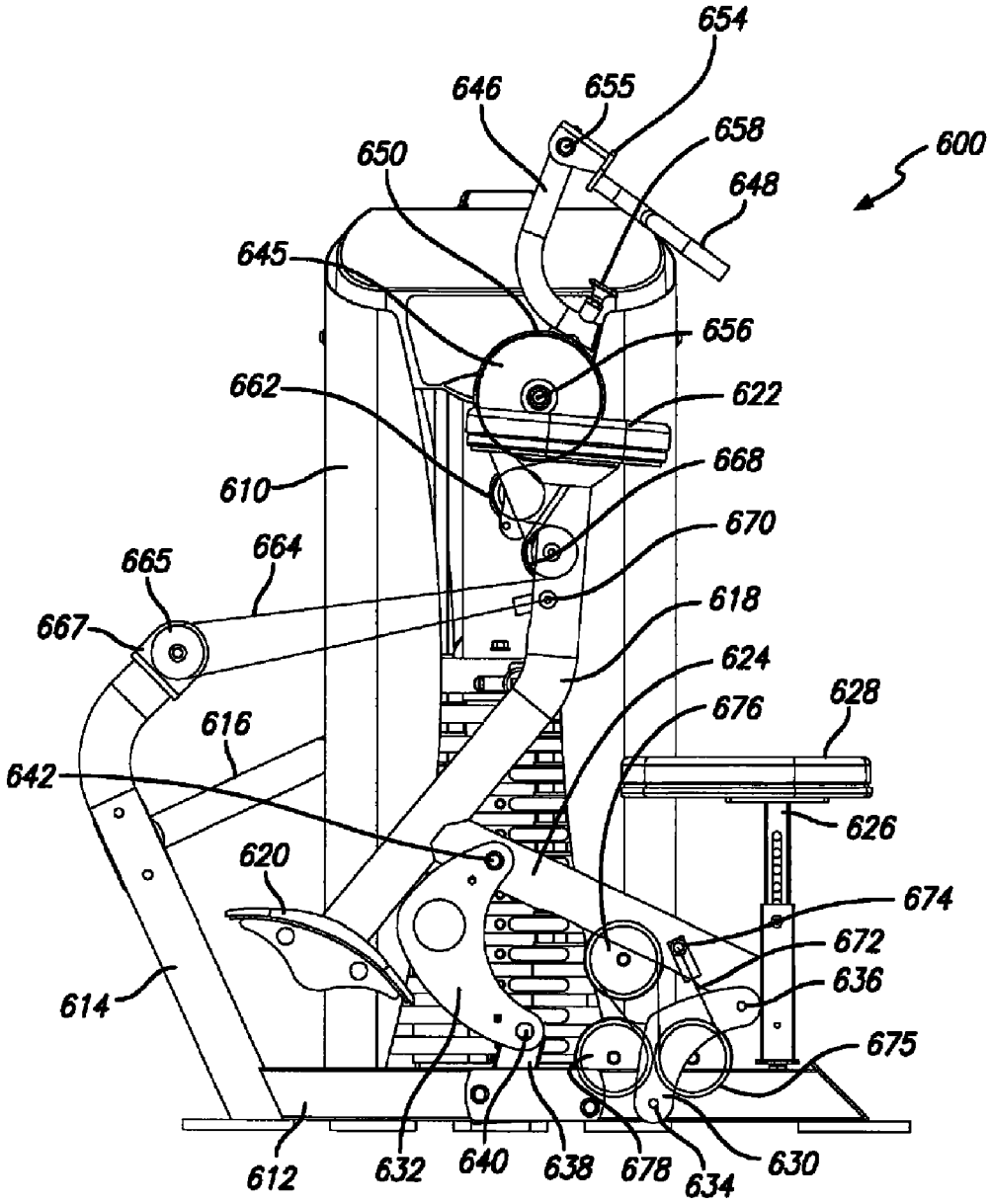
FIG. 56A is a side elevation view illustrating the machine in the start position of FIG. 54 for a triceps extension exercise.
Figure 56B:
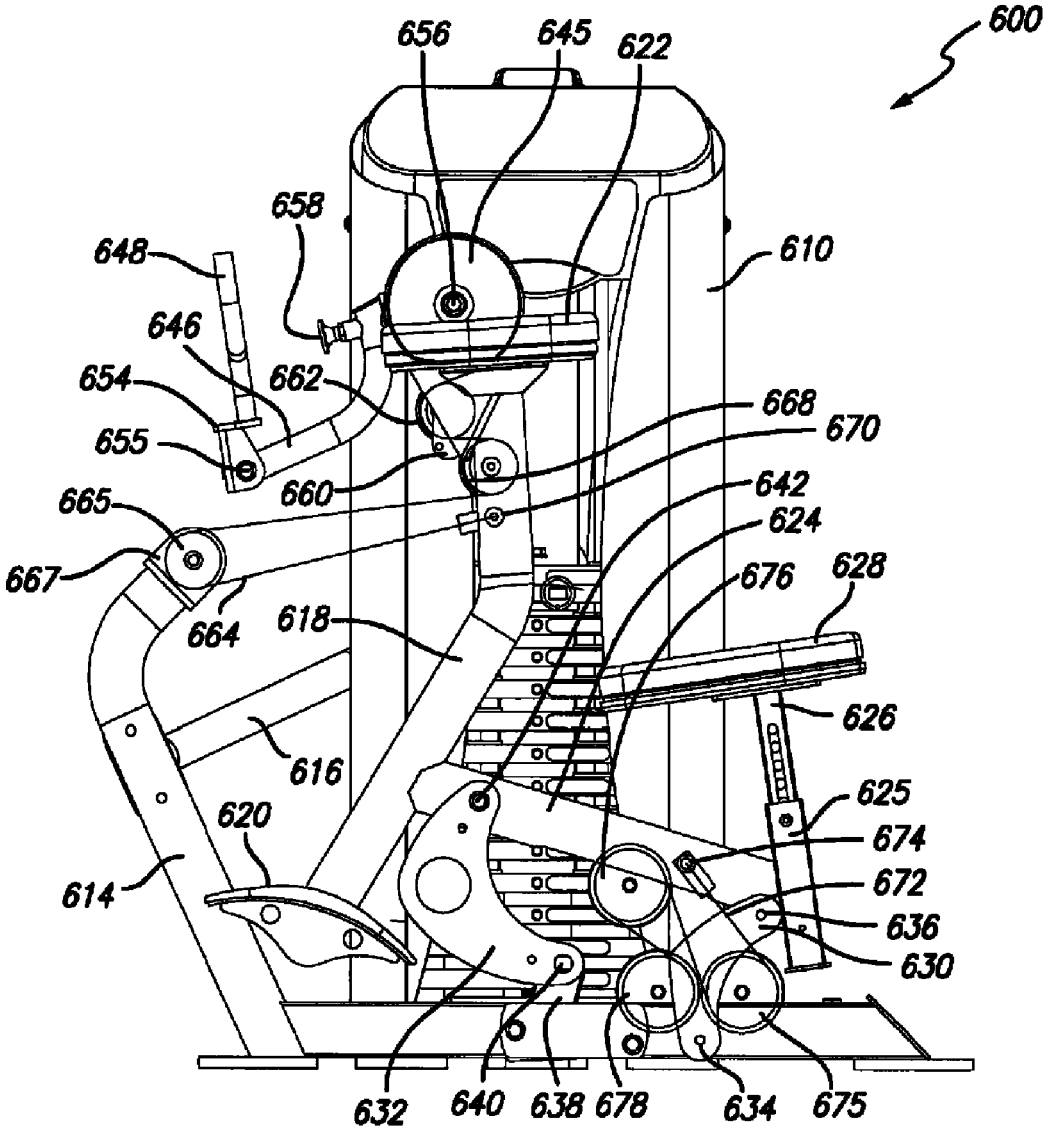
FIG. 56B is a side elevation view similar to FIG. 56A but illustrating the finish position of a triceps extension exercise.
Figure 57A:
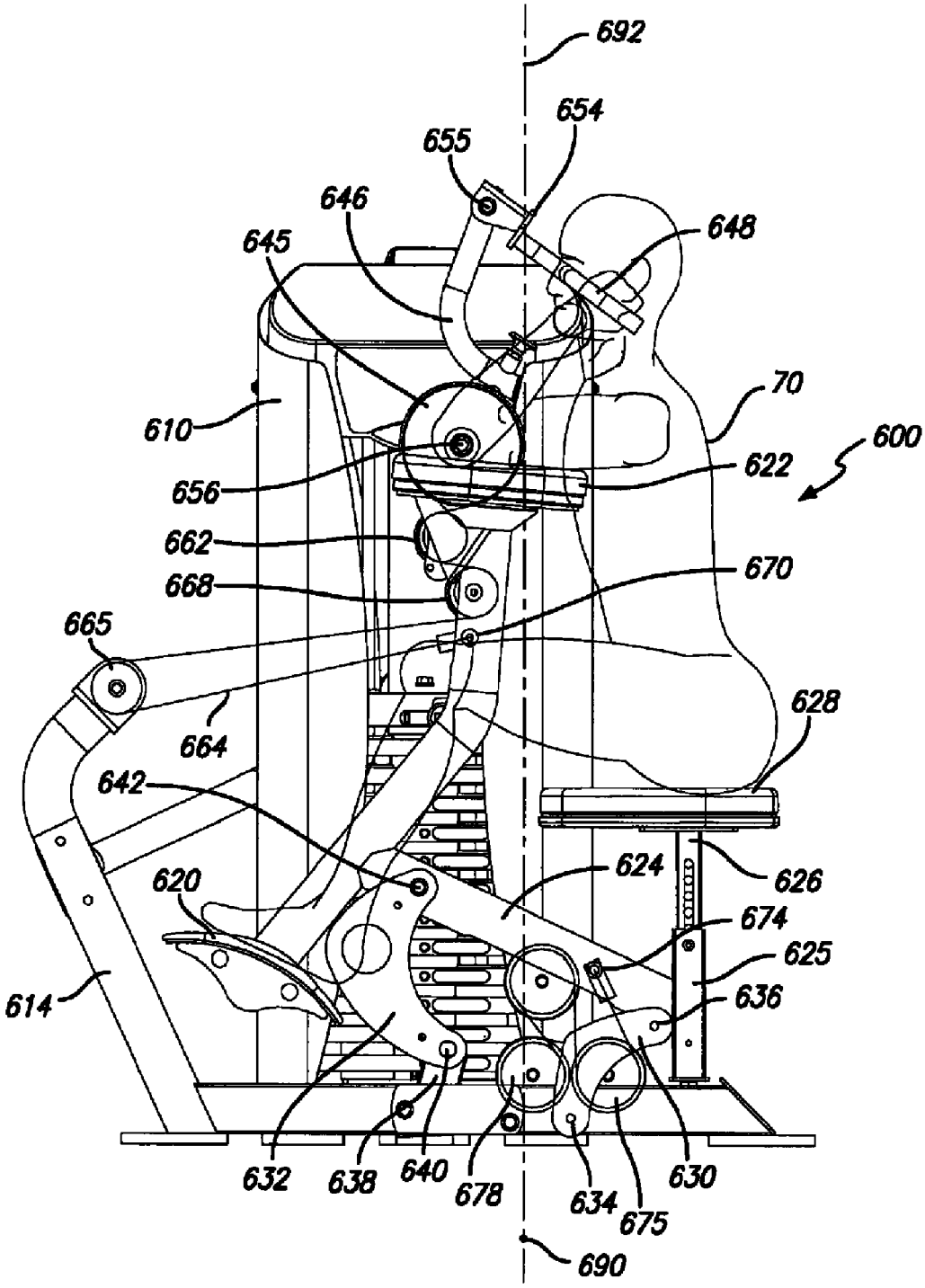
FIG. 57A is a side elevation view of the machine in the position of FIG. 56A but with a user seated on the machine and ready to perform the triceps extension exercise.
Figure 57B:
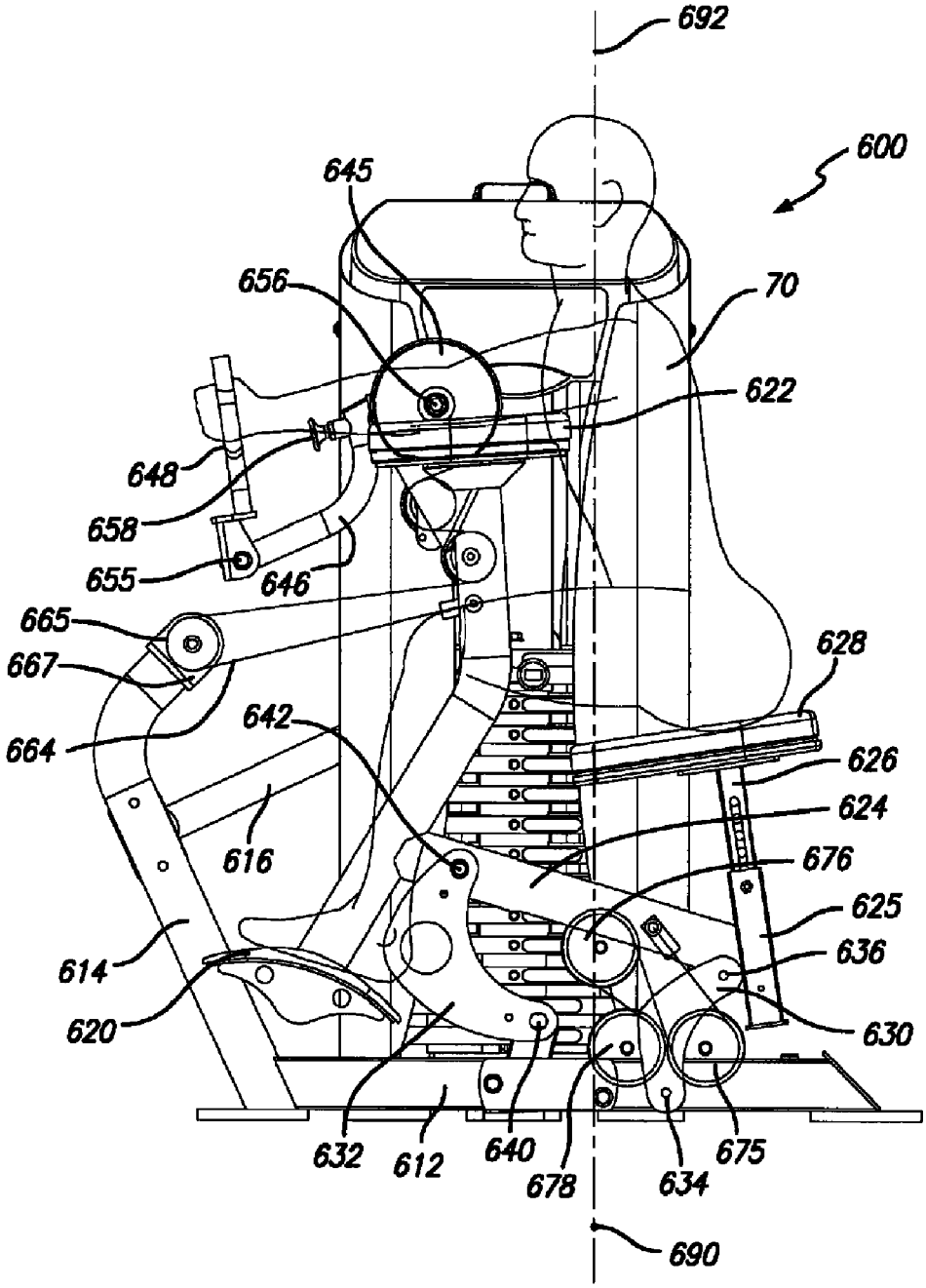
FIG. 57B is a side elevation view similar to FIG. 56A but illustrating a machine and user finish position for a triceps extension exercise.

FIGS. 54, 56A and 57A illustrate the start position for a triceps extension exercise while FIGS. 55, 56B and 57B illustrate a finish position for this exercise, with a user 70 shown on the machine performing the exercise in FIGS. 57A and 57B. To perform a triceps extension exercise, the user simply adjusts the exercise arm to extend upward as illustrated in FIGS. 54, 56A and 57A, using the ROM adjuster mechanism, then grabs the user engaging handles 648 with their arms bent upwardly and rearward, as illustrated in FIG. 57A. User 70 starts the exercise movement by pushing the handles 648 downward, away from their head. This movement causes the exercise arm 646 and cam 650 to pivot about pivot axis 656 at their connection to the user support, which pulls the connecting link cable 664 as it wraps around the cam, all of which causes the user support 604 to rotate and pull on load-bearing cable 672. During this movement, cam lever arm 660 does not rotate with the cam.

In the exercise finish position of FIG. 57B, the user has their arm extending straight out in front, and the user support seat has moved from a generally horizontal to a forward inclined orientation, and the user moves from upright to a slight forward lean.

Through out the entire "explosive" movement of either a biceps curl or triceps extension exercise, the user is in a stabilized position with their feet and upper torso supported. This stabilized position provides a strict exercise movement by reducing or eliminating any involvement of other muscle groups and focusing effort just on the biceps or triceps depending on the chosen exercise. In each exercise, the vertical gravitational center line 692 of the user support theoretical pivot axis extends through the user and user support in both the exercise start and end position. This helps to reduce starting resistance as well as resistance drop off at the end of an exercise.

Figure 58A:
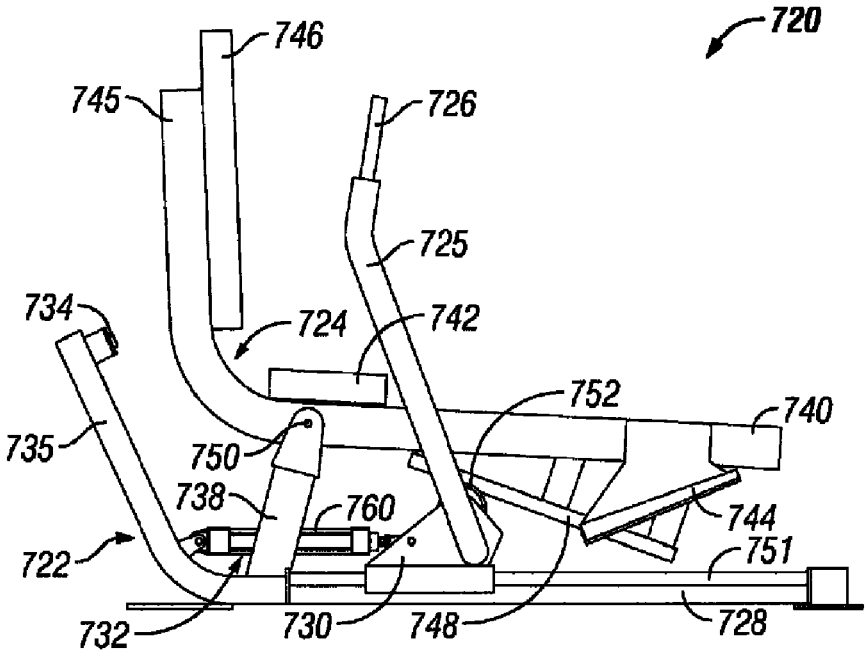
FIG. 58A is a side elevation view of another embodiment of an exercise machine having a multi-function user engagement arm for performing chest press or mid row exercises, with the machine in a start position for a chest press exercise and the end position for a mid row exercise.
Figure 58B:
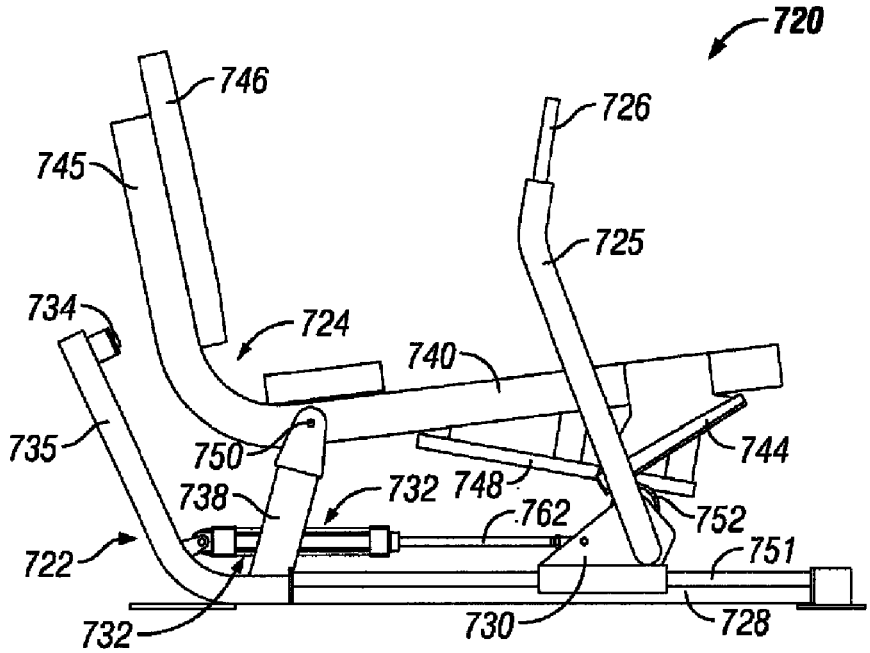
FIG. 58B is a side elevation view similar to FIG. 58A illustrating the end position for a chest press exercise and the start position for a mid row exercise.
Figure 59A:
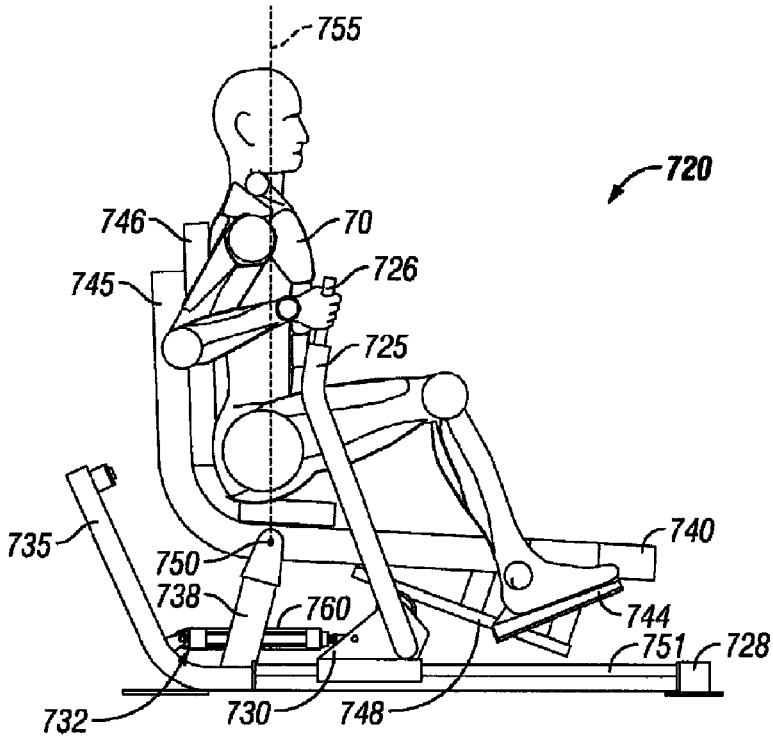
FIG. 59A is a side elevation view similar to FIG. 58A but illustrating a user in position on the user support while performing an exercise.
Figure 59B:
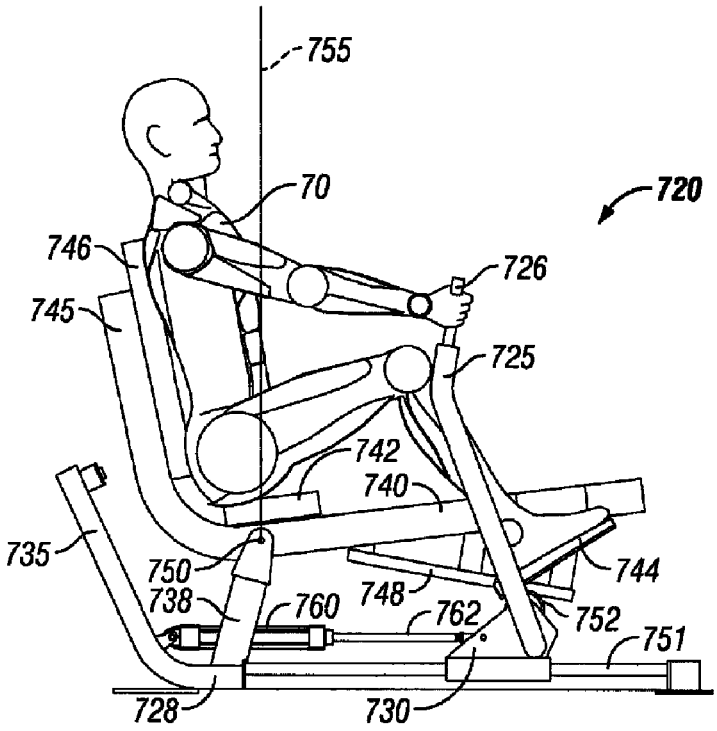
FIG. 59B is a side elevation view similar to FIG. 58B but illustrating a user in position on the user support while performing an exercise.

FIGS. 58A to 59B illustrate an exercise machine 720 which has a multi-function exercise arm 725 having two modes of operation, for performing a rowing exercise or a chest press exercise. FIG. 58A illustrates the machine in a start position for a chest press exercise and an end position for a mid row exercise. FIG. 58B illustrates the machine in an end position for a chest press exercise and a start position for a mid row exercise. FIGS. 59A and 59B illustrate the same positions with a user 70 performing the exercise.

The exercise machine 720, as in the previous embodiments, comprises a main frame 722, and a user support 724 pivotally mounted on the frame. In this case, a U-shaped exercise arm 725 with handles 726 at its free, upper ends is slidably mounted for linear motion on the base 728 of the frame 722 via linear slide or sliding wedge 730. The linear slide 730 is linked to a bi-directional exercise resistance comprising a hydraulic cylinder or ram assembly 732, similar to the exercise resistance in the embodiment of FIGS. 9 to 16. Hydraulic cylinder assembly 732 is connected between the linear slide 730 and the lower end of a rear, upwardly extending strut 735 of the main frame. Assembly 732 comprises a cylinder 760 containing hydraulic fluid and a ram or piston telescopically engaged in the cylinder with a piston rod 762 extending out of the cylinder and having an end attached to sliding wedge 730. The piston is movable back and forth between a retracted position as in FIG. 58A and an extended position as in FIG. 58B. Movement of the piston in both directions is resisted by the fluid in cylinder 760. Strut 735 is inclined rearward and a stop pad 734 is provided adjacent the upper end of the strut for limiting rearward motion of the user support.

The linear slide or sliding wedge 730 forms one part of a multi-part connecting linkage which translates movement of the exercise arm 725 into movement of the pivotally mounted user support 724. A roller 752 rotatably mounted on an upper part of wedge 730 forms a second part of the linkage, and engages a rail or track 748 secured to the user support 724, as described in more detail below. The multiple part connecting linkage between the exercise arm and user support is similar to that described in U.S. Pat. No. 6,916,278 of Webber, the contents of which are incorporated herein by reference.

The main frame also has a pivot mounting post 738 extending upwardly from the base at a position spaced forwards from upright strut 735. The user support 724 is generally L-shaped, and has a base 740 on which a seat pad 742 is mounted, with a pair of foot rests or foot plates 744 secured adjacent the forward end of base 740, and an upright 745 supporting back pad 746. Guide bar or track 748 is mounted on the underside of the base 740 of the user support so as to extend at a downwardly inclined angle from the rear end to the forward end. The user support is pivoted to the pivot mount 738 for rotation about pivot axis 750 at a location spaced below the seat pad 742.

The linear slide or wedge 730 of the connecting linkage is slidably engaged on a pair of parallel, linear guide bars 751 on the base 728 of the frame, only one of which is seen in the drawings, and the wheel 752 at its upper end is in rolling engagement on the guide bar or track 748 on the underside of the user support base. The central portion of the U-shaped exercise arm is mounted on the slide or wedge 730. With this arrangement, forward linear motion of the exercise arm is translated into rearward rotational movement of the user support, while rearward linear motion of the exercise arm is translated into forward rotational movement of the user support.

FIGS. 59A and 59B illustrate a user 70 performing an exercise on the exercise machine 720. In order to perform a chest press exercise, the user sits on the user support with the exercise arm 725 in the rear position of FIG. 58A, places their feet on foot supports 744, and grabs the handles 726. They then press their arms out away from their chest into the end position of FIG. 58B. The exercise arm 725 slides along guide bars 751, simultaneously extending the piston rod 762 out of cylinder 760. At the same time, the roller 752 at the top of sliding wedge 730 travels along the inclined track 748 on the user support, causing the user support to pivot rearward about axis 750, ending the exercise in the rearwardly inclined position of FIG. 58B.

If the user wishes to perform a rowing type of exercise, also known as a mid row exercise, on the machine 720, they start the exercise with the exercise arm 725 in the position of FIG. 58B. The user sits on user support 724 with their feet on foot supports 744 and grabs the handles 726 with their arms extended out in front of their body at a slight downward inclination. They then pull the handles inward towards their chest, moving the exercise arms back along guide bars 751 to the mid row end position of FIG. 58A. This simultaneously retracts piston rod 762 back into the cylinder 760, while roller 752 travels along inclined track 748 and the user support pivots back into the generally upright, slightly forwardly inclined orientation of FIG. 59A.

When performing a chest press exercise on machine 720, the user's hands travel in a slightly downward path, resulting in a "decline" pressing movement which works the lower region of the pectoral muscles. When performing a mid row exercise, the user's hands travel in a slightly upward direction. The chest press exercise moves the user from a slightly forwardly inclined position to a reclined position, ending with their arms extended and their hands at a slightly lower elevation, relative to their shoulders, than the starting position. The mid row exercise moves the user from a slight rearward recline into a slight forward incline with their arms at a slightly higher elevation, relative to their shoulders, than in the start position. The combination of the exercise arm linear movement and the user support rotational movement causes the user's hands to follows a natural arcing motion.

In the exercise machine of this embodiment, the user support pivot 750 is positioned directly under the exerciser. In FIGS. 59A and 59B, dotted line 755 is the gravitational centerline of the user support pivot axis 750. The gravitational centerline 755 runs very close to the centerline of the user's hip, allowing a balanced portion of the user and user support to be positioned on each side of the gravitational centerline in both the start and finish position.

In each of the above embodiments, one or more user engagement devices or exercise arms is multi-functional, and can be used to perform two different exercises which exercise distinct muscles or muscle groups. In each case, the machine has a user support which is pivotally mounted for pivotal movement relative to a main frame, and a connecting linkage which translates movement of the exercise arm or user engagement device into movement of the user support. The exercises may be compound or isolation exercises.

Exercise machines of the above embodiments all have a vertical gravitational center line extending through the pivot axis (where there is a single user support pivot) or theoretical pivot axis (where there is a multiple pivot assembly for the user support). In at least some embodiments, the gravitational centerline of the user support's pivotal movement is positioned so that the combined weight of the user support and user is distributed on both sides of the gravitational centerline in at least one of the exercise start and end positions. Because of this arrangement, the user support provides a counterbalancing effect on the exercise arm as it moves and its weight is re-distributed. This balanced weight distribution positions a portion of the user and user support on each side of the gravitational centerline in either the start or end position, or both the start and end position. As the exercise arm is moved, a portion of this combined weight passes through the gravitational centerline redistributing the weight. This re-distribution is gradual and continuous throughout the exercise motion and is not noticed by the user.

The multi-function user engagement devices or exercise arms of the above embodiments can each be used for performing at least two different exercises which exercise two distinct muscles or muscle groups, for example upper back exercises as well as biceps curl exercises, shoulder press and lat pulldown exercises, pectoral fly and rear deltoid exercises, leg extension and leg curl exercises, chest press and mid row exercises, chest press and leg press exercises, biceps curl and triceps extension exercises, as well as other possible combinations of exercises. This provides a more compact arrangement than prior art machines with moving user supports, which typically allowed performance of only one exercise type or had separate exercise arms for different exercises.

The user support frame has a primary user support which supports the majority of the user's weight in at least one of the start and end positions of the exercise, as well as at least one additional or secondary user support which stays in the same position relative to the primary user support throughout the exercise, and supports a spaced portion of the user's body. An additional user support which supports another part of the user's body may also be provided. The multiple user supports provide secure and safe positioning, placing the user in the proper exercise alignment from start to finish, without any adjustment required by the user. The primary and secondary supports may be a seat pad and back pad, a seat pad and chest pad, a seat pad and arm pad, a seat pad and foot support, a back pad and shoulder pads, or other combinations of supports. In some embodiments, a pad acts as a back pad for at least one exercise with a user facing in a first direction, and acts as a chest pad for at least one exercise with the user facing in a second, opposite direction. The primary and secondary support travel together in fixed alignment to keep the user in the same position throughout the exercise motion so that the user does not have to worry about balancing on a moving platform or pad. In some embodiments, more than two user support portions may be provided on the user support frame, and also travel together with the primary and secondary supports for increased stability. For example, in some embodiments a foot plate to provide a rest for the user's feet during travel of the user support may be provided in addition to a back pad, chest pad, or arm pad, or hand grips may be provided in addition to a back pad.

In each machine, the connecting linkage which translates the user engagement device movement into movement of the user support is associated with at least two of the user engagement device, user support, and main frame. In some embodiments, such as the first embodiment of FIGS. 1 to 8, the connecting linkage is associated with all three of the user engagement device, user support, and main frame. The connecting linkage may have multiple parts or comprise a single rigid link, articulated links, completely flexible links, a roller on one part in rolling engagement with another part, and the like, and the connecting linkage may be made adjustable.

The exercise arm or user engagement device could be unidirectional or bi-directional, and may be in one piece (dependent) or two pieces for independent arm movement. The exercise arm may be mounted on the user support, main frame, or connecting linkage, and the exercise arm movement may be rotational, linear, converging, or diverging, and may be user-defined. The user engagement device may be partially flexible, completely flexible or articulated to allow user-defined movement of the user engagement device, or may be rigid exercise arms. In those stations where the exercise arm is engaged by the user's hands rather than their feet, the handles may be rigid or flexible, and may self-align during an exercise. The exercise arm may provide for two-dimensional or three-dimensional movement. The user engagement device or exercise arm may require adjustment by the user to convert from one type of exercise to another, or may require no adjustment.

The exercise machines in the above embodiments may be a stand-alone unit, part of a multi-station gym, or may be optional attachments to another machine. Each machine may have one multi-function user engagement device or exercise arm, or may have additional exercise arms which may be used to perform a single exercise, or which may also be multi-function exercise arms for performing different exercises.

In the above embodiments, operation of the user engagement device causes a rocking movement of the user support. Due to the position of the user support pivot or the theoretical pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used.

The user support and user engagement device could be designed to travel in the same or opposite directions. The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack linked to part of the apparatus by a cable and pulley arrangement, or may be hydraulic. Any other type of resistance known in the art may alternatively be used, such as weight plates, pneumatic, electromagnetic, or elastic bands, in place of the weight stack or hydraulic resistance.

In each machine, the user support is positioned relatively low to the ground in the start and end position, making the stations quicker, easier, and safer to enter and exit. The user does not have to climb up or down in order to get into, or out of, the exercise position. The low profile also makes the machines more economical to produce and less intimidating to the user. The user's position is continuously adjusted throughout the exercise. The combined exercise arm and user support movement produces an automatic and continuous self-aligning exercise motion.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a stationary main frame;

a user support frame movably mounted relative to the main frame for rotation between a start position and an end position during an exercise;

the user support frame having a primary support and at least one secondary support which are configured to engage different parts of a user's body, the primary support configured to support the majority of a user's weight in the start position of the support frame and the secondary support being fixed at a predetermined angular orientation and not moving relative to the primary support throughout an exercise movement;

at least one multi-function user engagement device movably mounted relative to the frames which is configured for engagement by the user in performing exercises, the multi-function user engagement device configured for performance of at least first and second different exercises adapted to exercise different muscles or muscle groups in first and second modes of operation, respectively;

the user engagement device being configured for movement in first and second predetermined paths, the first predetermined path corresponding to the first mode of operation and the second predetermined path corresponding to the second mode of operation, the user engagement device being switchable between the first and second modes of operation without adding any parts to the machine or removing any parts from the machine;

a connecting linkage which is configured to translate movement of the user engagement device in the first and second modes of operation to movement of the user support frame;

the secondary support moving together with the primary support at said predetermined fixed angular orientation throughout the first and second exercises; and a load configured for resisting movement of at least one of the user support frame, user engagement device, and connecting linkage in both the first and the second mode of operation of the user engagement device.

2. The machine of claim 1, wherein the user support frame is configured to support a user in a seated position and the primary support comprises a seat pad.

3. The machine of claim 2, wherein the secondary support comprises a back pad.

4. The machine of claim 3, wherein the back pad is configured to provide low back support.

5. The machine of claim 3, wherein the back pad is configured to provide upper back support.

6. The machine of claim 2, wherein the secondary support comprises a chest pad.

7. The machine of claim 2, wherein the secondary support comprises a back pad in the first mode of operation of the multi-function user engagement device and comprises a chest pad in the second mode of operation of the multi-function user engagement device, the secondary support being configured to support the user facing in opposite directions on the primary support in the first and second modes of operation.

8. The machine of claim 2, wherein the secondary support comprises an arm support pad.

9. The machine of claim 2, wherein the secondary support comprises a foot rest.

10. The machine of claim 1, wherein the user support frame has an additional support which is configured to support a different part of a user's body from the primary and secondary supports.

11. The machine of claim 1, further comprising a pivot mount on the main frame and at least one pivot connection on the pivot mount which pivotally connects the user support frame to the main frame for rotation about a user support pivot axis.

12. The machine of claim 11, wherein the pivot mount is located beneath the user support frame.

13. The machine of claim 1, wherein the user engagement device comprises a lower body exercise arm adjustable between the first mode in which the exercise arm is configured for performing a first lower body exercise and the second mode in which the exercise arm is configured for performing a second lower body exercise.

14. The machine of claim 13, wherein the lower body exercise arm comprises a leg exercise arm which is configured for performing leg extension exercises in the first mode and for performing leg curl exercises in the second mode.

15. The machine of claim 1, wherein the user engagement device comprises an exercise arm configured for performing two different arm exercises.

16. The machine of claim 15, wherein the exercise arm is adjustable between the first mode in which it is configured for performing biceps curl exercises and the second mode in which it is configured for performing triceps extension exercises.

17. The machine of claim 1, wherein the user engagement device is rotatably mounted relative to one of the user support frame and main frame.

18. The machine of claim 1, wherein the user engagement device is movable in a linear path.

19. The machine of claim 1, wherein the user engagement device comprises first and second handles and first and second arm portions extending from the respective handles and associated with at least one of the main frame, user support frame, and connecting linkage.

20. The machine of claim 1, wherein the user engagement device is configured for performance of an upper body exercise in the first mode of operation and an arm exercise in the second mode of operation.

21. The machine of claim 20, wherein the upper body exercise is an upper back exercise.

22. The machine of claim 1, wherein the user engagement device is configured for performance of an upper body exercise in the first mode of operation and a lower body exercise in the second mode of operation.

23. The machine of claim 1, wherein the user engagement device is configured for performance of at least two different torso exercises in first and second modes of operation.

24. The machine of claim 23, wherein the torso exercises are upper torso exercises.

25. The machine of claim 23, wherein the user engagement device is configured for performance of a chest exercise in the first mode of operation and an upper back exercise in the second mode of operation.

26. The machine of claim 25, wherein the chest exercise is a pectoral fly exercise.

27. The machine of claim 1, wherein the user engagement device comprises first and second rigid exercise arms rotatable relative to the frame, at least one exercise arm having a handle for gripping by a user positioned on the user support frame.

28. The machine of claim 27, wherein the exercise arms are joined to move together about a common pivot axis in each exercise movement.

29. The machine of claim 27, wherein the first exercise arm is configured for performance of an upper body exercise and the second exercise arm configured for performance of a lower body exercise.

30. The machine of claim 29, wherein the second exercise arm has a foot or leg engaging device configured for engagement by the user's feet or legs when performing a lower body exercise.

31. The machine of claim 27, wherein the exercise arms are independently movable.

32. The machine of claim 1, wherein the user engagement device travels in a fixed path in each mode of operation.

33. The machine of claim 1, wherein the user engagement device travels in a converging path in at least one mode of operation.

34. The machine of claim 1, wherein the user engagement device is configured for engagement by a user's upper body in at least one mode of operation.

35. The machine of claim 1, wherein the user engagement device is configured for engagement by a user's lower body in at least one mode of operation.

36. The machine of claim 1, further comprising a second multi-functional user engagement device movably mounted relative to the frames which is configured for engagement by the user in performing exercises, the second multi-function user engagement device configured for performance of a third exercise different from the first and second exercises in a third mode of operation and for performance of a fourth exercise different from the first, second and third exercises in a fourth mode of operation, the second user engagement device configured to exercise third and fourth distinct muscles or muscle groups of the user in the third and fourth modes of operation, respectively, the third and fourth muscles or muscle groups being different from the first and second muscles or muscle groups.

37. The machine of claim 36, wherein the exercises include upper and lower body exercises.

38. The machine of claim 36, wherein the exercises are selected from the group consisting of chest exercises, back exercises, shoulder exercises, leg exercises, and arm exercises.

39. The machine of claim 1, wherein the moving user support frame is configured to rock forward between the start and end position of both exercises.

40. The machine of claim 1, wherein the moving user support frame is configured to rock rearward between the start and end position of both exercises.

41. The machine of claim 1, wherein the moving user support frame is configured to travel through a horizontal orientation during an exercise movement.

42. The machine of claim 1, wherein the user engagement device comprises at least one elongate exercise arm which is flexible along at least part of its length.

43. The machine of claim 42, wherein the exercise arm comprises a flexible elongate exercise arm.

44. The machine of claim 43, wherein the exercise arm comprises a cable having a user engageable device at least at one end.

45. The machine of claim 44, wherein the cable has first and second handles at opposite ends and is movably mounted on at least one of the frames between the opposite ends.

46. An exercise machine, comprising:

a stationary main frame;

a user support frame;

a pivot assembly pivotally mounting the user support frame relative to the main frame, whereby the user support frame is configured for rotation between a start position and an end position during an exercise, the pivot assembly defining a pivot axis about which the user support frame rotates and a vertical gravitational center line passing through the pivot axis;

the user support frame having at least a primary support and a secondary support which are configured to engage different parts of a user's body, the primary support configured to support the majority of a user's weight in the start position of the support frame and being fixed at a predetermined angular orientation relative to the secondary support throughout an exercise movement;

at least one multi-function user engagement device movably mounted relative to the frames which is configured for engagement by the user in performing exercises, the multi-function user engagement device having at least first and second different modes of operation and being configured for performance of a first exercise which exercises a first muscle or muscle group in the first mode of operation and for performance of a second exercise which exercises a second muscle or muscle group distinct from the first muscle or muscle group in the second mode of operation;

a connecting linkage which is configured to translate movement of the user engagement device in the first and second modes of operation to movement of the user support frame;

the secondary support configured to move together with the primary support at said predetermined fixed angular orientation throughout the first and second exercise;

a load configured to resist movement of at least one of the user support frame, user engagement device, and connecting linkage; and the user support frame and pivot assembly being configured such that portions of the user support frame are distributed on each side of the vertical gravitational center line during pivotal movement of the user support frame and only a portion of the user support frame passes through the gravitational center line during each of the first and second exercises.

47. The machine of claim 46, wherein the user support frame is configured to support a user in a seated position and the primary support comprises a seat pad.

48. The machine of claim 46, wherein the secondary support comprises a back pad.

49. The machine of claim 47, wherein the secondary support comprises a chest pad.

50. The machine of claim 47, wherein the secondary support comprises a foot rest.

51. The machine of claim 47, wherein the secondary support is configured to support a user facing in opposite directions in the first and second modes of operation, the secondary support comprising a back pad in the first mode of operation of the multi-function user engagement device and a chest pad in the second mode of operation of the multi-function user engagement device.

52. The machine of claim 46, wherein the secondary support comprises an arm support pad.

53. The machine of claim 46, wherein the user support frame has an additional support which is configured to support a different part of a user's body from the primary and secondary supports.

54. The machine of claim 46, wherein the user engagement device comprises an exercise arm adjustable between the first mode in which the exercise arm is configured for performing a first lower body exercise and the second mode in which the exercise arm is configured for performing a second lower body exercise.

55. The machine of claim 54, wherein the exercise arm comprises a leg exercise arm which is configured for performing leg extension exercises in the first mode and for performing leg curl exercises in the second mode.

56. The machine of claim 46, wherein the user engagement device comprises an exercise arm configured for performing two different arm exercises.

57. The machine of claim 56, wherein the exercise arm is adjustable between the first mode in which it is configured for performing biceps curl exercises and the second mode in which it is configured for performing triceps extension exercises.

58. The machine of claim 46, wherein the user engagement device is configured for performance of an upper body exercise in the first mode of operation and an arm exercise in the second mode of operation.

59. The machine of claim 58, wherein the upper body exercise is an upper back exercise.

60. The machine of claim 46, wherein the user engagement device is configured for performance of an upper body exercise in the first mode of operation and a lower body exercise in the second mode of operation.

61. The machine of claim 45, wherein the user engagement device is configured for performance of at least two different torso exercises in first and second modes of operation.

62. The machine of claim 61, wherein the exercises are upper torso exercises.

63. The machine of claim 61, wherein the user engagement device is configured for performance of a chest exercise in the first mode of operation and an upper back exercise in the second mode of operation.

64. The machine of claim 63, wherein the chest exercise is a pectoral fly exercise.

65. The machine of claim 46, wherein the pivot assembly comprises a pivot mount on the main frame and a single pivot connection on the pivot mount which pivotally connects the user support frame to the main frame for rotation about the user support pivot axis.

66. The machine of claim 65, wherein the pivot mount is located beneath the user support frame.

67. The machine of claim 46, wherein the pivot assembly comprises a four bar pivot linkage between the user support frame and main frame.

68. The machine of claim 46, wherein the user engagement device is rotatably mounted relative to one of the user support frame and main frame.

69. The machine of claim 46, wherein the user engagement device comprises first and second handles and first and second arm portions extending from the respective handles and associated with at least one of the main frame, user support frame, and connecting linkage.

70. The machine of claim 46, wherein the user engagement device comprises first and second rigid exercise arms rotatable relative to the frame, at least the first exercise arm having a handle configured for gripping by a user when positioned on the user support frame.

71. The machine of claim 70, wherein the exercise arms are joined to move together about a common pivot axis in each exercise movement.

72. The machine of claim 70, wherein the first exercise arm is configured for performance of an upper body exercise and the second exercise arm configured for performance of a lower body exercise.

73. The machine of claim 72, wherein the second exercise arm has a foot or leg engaging device configured for engagement by the user's feet or legs when performing a lower body exercise.

74. The machine of claim 70, wherein the exercise arms are independently movable.

75. The machine of claim 46, wherein the user engagement device comprises at least one bi-directional exercise arm configured to move in a first direction in the first mode of operation and in a second direction in the second mode of operation.

76. The machine of claim 75, wherein the user engagement device comprises first and second pivotally mounted, bi-directional exercise arms configured to extend on opposite sides of the user support, each exercise arm having at least one user engaging portion configured for engagement by a user.

77. The machine of claim 76, further comprising first and second pivot mounts pivotally mounting the first and second exercise arms for rotational movement relative to the frames, respectively, the pivot mounts having relatively skewed pivot axes, whereby the user engaging portions are configured to move in a converging path on rotation of the exercise arms in the first direction about the respective pivot axes to perform the first exercise and are configured to move in a diverging path on rotation of the exercise arms in the second, opposite direction to perform the second exercise.

78. The machine of claim 46, wherein the user engagement device is configured to move in a converging path in at least one mode of operation.

79. The machine of claim 46, further comprising a second multi-functional user engagement device movably mounted relative to the frames which is configured for engagement by the user in performing exercises, the second multi-function user engagement device configured for performance of a third exercise different from the first and second exercises in a third mode of operation and for performance of a fourth exercise different from the first, second and third exercises in a fourth mode of operation, the second user engagement device configured to exercise third and fourth distinct muscles or muscle groups of the user in the third and fourth modes of operation, respectively, the third and fourth muscles or muscle groups being different from the first and second muscles or muscle groups.

80. The machine of claim 79, wherein the exercises are selected from the group consisting of chest, back, shoulder, leg and arm exercises.

81. The machine of claim 46, wherein the user engagement device and user support frame move in the same direction during an exercise.

82. The machine of claim 46, wherein the user engagement device is movable in a linear path.

83. The machine of claim 46, wherein the user engagement device comprises at least one elongate exercise arm which is flexible along at least part of its length.

84. The machine of claim 83, wherein the exercise arm comprises a flexible elongate exercise arm.

85. The machine of claim 84, wherein the exercise arm comprises a cable having a user engageable device at least at one end.

86. The machine of claim 85, wherein the cable has first and second handles at opposite ends and is movably mounted on at least one of the frames between the opposite ends.

* * * * *